US012312760B2

(12) United States Patent
Lundell

(10) Patent No.: US 12,312,760 B2
(45) Date of Patent: May 27, 2025

(54) SEGMENTED WALL SYSTEMS HAVING TAIL BLOCKS

(71) Applicant: Keystone Retaining Wall Systems, LLC, Minneapolis, MN (US)

(72) Inventor: Robert Lundell, Stillwater, MN (US)

(73) Assignee: Keystone Retaining Wall Systems, LLC, Minneapolis, MN (US)

( * ) Notice: Subject to any disclaimer, the term of this patent is extended or adjusted under 35 U.S.C. 154(b) by 223 days.

(21) Appl. No.: 17/949,122

(22) Filed: Sep. 20, 2022

(65) Prior Publication Data

US 2023/0090438 A1 Mar. 23, 2023

Related U.S. Application Data

(60) Provisional application No. 63/391,192, filed on Jul. 21, 2022, provisional application No. 63/311,890, filed on Feb. 18, 2022, provisional application No. 63/277,909, filed on Nov. 10, 2021, provisional application No. 63/246,183, filed on Sep. 20, 2021.

(51) Int. Cl.
*E02D 29/02* (2006.01)

(52) U.S. Cl.
CPC ..... *E02D 29/0258* (2013.01); *E02D 29/025* (2013.01)

(58) Field of Classification Search
CPC ..... E02D 29/0258; E02D 29/025; E02D 29/0225; E04C 1/395; E04B 2002/0252
See application file for complete search history.

(56) References Cited

U.S. PATENT DOCUMENTS

| | | | | |
|---|---|---|---|---|
| D295,790 | S | 5/1988 | Forsberg | |
| D300,253 | S | 3/1989 | Forsberg | |
| D300,863 | S | 4/1989 | McNeely | |
| 4,831,802 | A | 5/1989 | Cromrich et al. | |
| 4,896,999 | A * | 1/1990 | Ruckstuhl | E04C 1/395 405/262 |

(Continued)

FOREIGN PATENT DOCUMENTS

| | | | |
|---|---|---|---|
| KR | 20110003841 | * | 4/2011 |
| WO | 2004020207 | A1 | 3/2004 |

(Continued)

OTHER PUBLICATIONS

International Preliminary Report on Patentability issued in International Application No. PCT/US2022/044156, mailed on Apr. 4, 2024, 8 pages.

(Continued)

*Primary Examiner* — Carib A Oquendo
(74) *Attorney, Agent, or Firm* — Dorsey & Whitney LLP

(57) ABSTRACT

A segmented wall system includes a first course extending in a first direction and comprising a first wall block and a second wall block. A rear side of the first wall block is connected to a first side of a first tail block and a rear side of the second wall block is connected to a first side of a second tail block. The segmented wall system further includes a second course stacked on the first course. The second course includes a third wall block having a rear side connected to a first side of a third tail block. The rear side of the third tail block has a width in the first direction that is equal to or greater than a width in the first direction of the rear side of the third wall block.

19 Claims, 82 Drawing Sheets

(56) References Cited

U.S. PATENT DOCUMENTS

| | | | | |
|---|---|---|---|---|
| 4,963,305 | A | 10/1990 | Cromrich et al. | |
| 4,982,544 | A | 1/1991 | Smith | |
| D317,209 | S | 5/1991 | Forsberg | |
| D341,215 | S | 11/1993 | Blomquist et al. | |
| 5,350,256 | A | 9/1994 | Hammer | |
| D363,787 | S | 10/1995 | Powell | |
| 5,474,405 | A * | 12/1995 | Anderson | E04C 1/395 405/262 |
| 5,490,363 | A | 2/1996 | Woolford | |
| 5,505,034 | A | 4/1996 | Dueck | |
| 5,570,551 | A | 11/1996 | Koc et al. | |
| 5,624,211 | A | 4/1997 | Anderson et al. | |
| 5,788,423 | A | 8/1998 | Perkins | |
| D405,543 | S | 2/1999 | Shillingburg | |
| D408,930 | S | 4/1999 | Behunin | |
| 5,913,790 | A | 6/1999 | Dawson | |
| 5,941,042 | A | 8/1999 | Dueck | |
| D429,004 | S | 8/2000 | Blomquist et al. | |
| 6,168,354 | B1 | 1/2001 | Martin et al. | |
| D439,989 | S | 4/2001 | Winters | |
| 6,233,897 | B1 | 5/2001 | Jurik | |
| 6,474,036 | B2 | 11/2002 | Martin et al. | |
| D467,009 | S | 12/2002 | Agee | |
| 6,709,201 | B2 | 3/2004 | Race | |
| D500,864 | S | 1/2005 | Klettenberg et al. | |
| D511,579 | S | 11/2005 | Risi et al. | |
| D517,221 | S | 3/2006 | Keys et al. | |
| 7,114,887 | B1 | 10/2006 | Rainey | |
| D537,533 | S | 2/2007 | Strand | |
| D569,010 | S | 5/2008 | Strand et al. | |
| 7,390,146 | B2 | 6/2008 | Rainey | |
| 7,441,887 | B2 | 10/2008 | Senga et al. | |
| 7,445,407 | B2 | 11/2008 | Rainey | |
| D589,163 | S | 3/2009 | Manthei et al. | |
| 7,497,341 | B2 | 3/2009 | Hardy et al. | |
| 7,645,098 | B1 | 1/2010 | Rainey | |
| D633,629 | S | 3/2011 | MacDonald et al. | |
| D645,575 | S | 9/2011 | Bone | |
| D652,153 | S | 1/2012 | Hammer | |
| D655,425 | S | 3/2012 | Wauhop | |
| 8,141,315 | B1 | 3/2012 | Shillingburg | |
| D667,138 | S | 9/2012 | Rainey | |
| 8,607,522 | B2 | 12/2013 | MacDonald | |
| 8,684,633 | B2 | 4/2014 | Rainey | |
| D708,765 | S | 7/2014 | MacDonald | |
| 9,070,261 | B2 | 6/2015 | Hardy | |
| 9,102,079 | B2 | 8/2015 | Scherer | |
| D781,455 | S | 3/2017 | Risi | |
| 9,706,857 | B2 | 7/2017 | Hardy et al. | |
| 9,744,697 | B2 | 8/2017 | Karau | |
| 9,999,993 | B2 | 6/2018 | Karau | |
| D844,857 | S | 4/2019 | Pegg | |
| D846,760 | S | 4/2019 | Lundell et al. | |
| 10,349,755 | B2 | 7/2019 | Dipaolo et al. | |
| D867,620 | S | 11/2019 | Pegg | |
| 10,486,344 | B2 | 11/2019 | Karau | |
| 10,899,049 | B2 | 1/2021 | Karau | |
| 10,907,350 | B1 * | 2/2021 | Shillingburg | E04C 1/395 |
| 11,401,714 | B2 | 8/2022 | Lacroix | |
| 11,554,521 | B2 | 1/2023 | Karau | |
| D980,459 | S | 3/2023 | Bott | |
| D1,017,837 | S | 3/2024 | Freitas | |
| 2004/0134154 | A1 | 7/2004 | Bott | |
| 2006/0130420 | A1 | 6/2006 | McNear | |
| 2008/0289283 | A1 | 11/2008 | Shin | |
| 2009/0196695 | A1 | 8/2009 | Rainey | |
| 2011/0318100 | A1 | 12/2011 | Rainey | |
| 2018/0044915 | A1 | 2/2018 | Castonguay et al. | |
| 2018/0100283 | A1 | 4/2018 | Lonero | |
| 2021/0172171 | A1 | 6/2021 | MacDonald | |
| 2023/0150174 | A1 | 5/2023 | Karau | |

FOREIGN PATENT DOCUMENTS

| | | | |
|---|---|---|---|
| WO | 2006060820 | A1 | 6/2006 |
| WO | 2007059454 | A2 | 5/2007 |
| WO | 2009067642 | A2 | 5/2009 |
| WO | 2010071760 | A1 | 6/2010 |

OTHER PUBLICATIONS

"AB Fieldstone Collection", Product information page, retrieved from https://www.allanblock.com/products/fieldstone-collection.aspx retrieved on Mar. 20, 2023, Allan Block.

"BroadStone®", Product information page, retrieved from https://www.keystonehardscapes.com/productfamily/BroadStone retrieved on Mar. 20, 2023, 3 pages, Keystone Hardscapes.

"Classic® 6", Product information page, retrieved from https://rockwoodwalls.com/classic-6 retrieved on Mar. 20, 2023, 10 pages, Rockwood Retaining Walls.

"Classic® 8", Product information page, retrieved from https://rockwoodwalls.com/classic-8 retrieved on Mar. 22, 2023, 10 pages, Rockwood Retaining Walls.

"CornerStone 100 Retaining Wall Block", product information page, retrieved from https://cornerstonewallsolutions.com/cornerstone-100/ retrieved on Mar. 22, 2023, 4 pages.

"CornerStone Positive", Product Information Page, retrieved from https://cornerstonewallsolutions.com/cornerstone-positive/?portfolioCats=4 retrieved on Mar. 22, 2023, 6 pages.

"Fortus Square Foot", Product information page, retrieved from https://cornerstonewallsolutions.com/fortus-square-foot/?portfolioCats=4 retrieved on Mar. 22, 2023, 4 page, CornerStone Wall Solutions.

"FrogStone", Product information page, retrieved from https://cornerstonewallsolutions.com/frogstone/?portfolioCats=4 retrieved on Mar. 22, 2023, 6 pages, CornerStone Wall Solutions.

"GravityStone® Edge", Product information page, retrieved from https://www.westblocksystems.com/gravitystone-edge retrieved on Mar. 20, 2023, 3 pages, WestBlock Systems.

"GravityStone® EnCore", Product information page, retrieved from https://www.westblocksystems.com/gravitystone-encore retrieved on Mar. 20, 2023, 2 pages, WestBlock Systems.

"GravityStone® Tradition", Production information page, retrieved from https://www.westblocksystems.com/gravitystone retrieved on Mar. 22, 2023, 4 pages, WestBlock Systems.

"Mega-Tandem 3-in-1 Wall System", Production information page, retrieved from https://www.belgardcommercial.com/products/segmental_retaining_walls/mega-tandem# retrieved on Mar. 22, 2023, 3 pages, Belgard.

"MiraStone", Product Information Page, retrieved from https://cornerstonewallsolutions.com/mirastone-retaining-wall/?portfolioCats=4 retrieved on Mar. 22, 2023, 3 pages, CornerStone Wall Solutions.

"Premier 6", Production information page, retrieved from https://rockwoodwalls.com/premier-6 retrieved on Mar. 20, 2023, 2 pages, Rockwood Retaining Walls.

"Premier 8", Production information page, retrieved from https://rockwoodwalls.com/premier-8 retrieved on Mar. 20, 2023, 2 pages, Rockwood retaining Walls.

"Tandem® Wall System", Production Information Page, retrieved from https://www.belgard.com/tandem/ retrieved on Mar. 22, 2023, 12 pages, Belgard.

"The Building Blocks of Future Communities and Infrastructure", retrieved from https://magnumstone.com/ retrieved on Mar. 20, 2023, 8 pages, Magnum Stone Retaining Walls.

"Trinity Segmental Block Wall System", Product information page, retrieved from https://earthwallproducts.com/retaining-wall-systems/trinity/ retrieved on Mar. 22, 2023, 6 pages, Earth Wall Products.

"Vertica Pro® Retaining Wall System, Straight Face", Product information page, retrieved from https://anchordiamond.com/walls/vertica-pro-retaining-wall-system-straight-face retrieved on Mar. 22, 2023, 8 pages, Anchor Diamond.

(56) References Cited

OTHER PUBLICATIONS

"Vertica® Retaining Wall System, Straight Face", Product information page, retrieved from https://anchordiamond.com/walls/vertica-retaining-wall-system-straight-face retrieved on Mar. 22, 2023, Anchor Diamond.
International Search Report and Written Opinion issued in International Application No. PCT/US2022/044156, mailed on Feb. 16, 2023, 12 pages.
"CornerStone Wall Block", Product information page, customer review oldest date Jul. 21, 2020, available from https://www.homedepot.com/p/CornerStone-Flat-Face-8-in-x-18-in-x-12-in-Grey-Concrete-Retaining-Wall-Block-MF100COSP001/207104149.
"Glen-Gery Glazed Brick", product listing in masonmasonry.com, announced 2015, retrieved from chrome-extension://efaidnbmnnnibpcajpcglclefindmkaj/https://www.masonsmasonry.com/usercontent/pdfs/Glen-gery-glazed-spec-sheet.pdf.
"Hewnstone Face Walls Design and Installation", Announced in YouTube on Apr. 12, 2015, available from https://www.youtube.com/watch?app=deskto&v=TwnWJRZRgjU.
"Keystone Sierra Blend Concrete Paver", Product listing, available in lowes.com, customer review oldest date Mar. 12, 2016, available at https://www.lowes.com/pd/Keystone-Campton-Sierra-Blend-Concrete-Paver-Common-6-in-x-18-in-Actual-5-921-in-x017-921-in/50328165.
"ProMuro Wall Block", product information page, customer review oldest date May 23, 2017, retrieved from https://www.homedepot.com/Pavestone-ProMuro-6-in-x-18-in-x-12-in-Harvest-Blend-Concrete-Retaining-Wall-Block-40-Pcs-30-sq-ft-Pallet-11016079/301043.
"Hewnstone Face Walls Design and Installation", Announced in YouTube on Apr. 12, 2015, picture of product described.
"Keystone Compac® Smooth Stone", Retreived from https://www.barkmanconcrete.com/products/hardscapes/walls/product/keystone-compac-smooth-stone/.
Ridgerock Gravity Link System, product brochure 3 pages, Jun. 14, 2021, RidgeRock Retaining Walls, Inc.
"GeoHold Retaining Wall Systems; Straight Individual Block Details", Product specification, Anchor Diamond, 2023.
"Geohold: Retaining Wall Straight Split Face", Product brochure, Anchor Diamond Group, 2023.

* cited by examiner

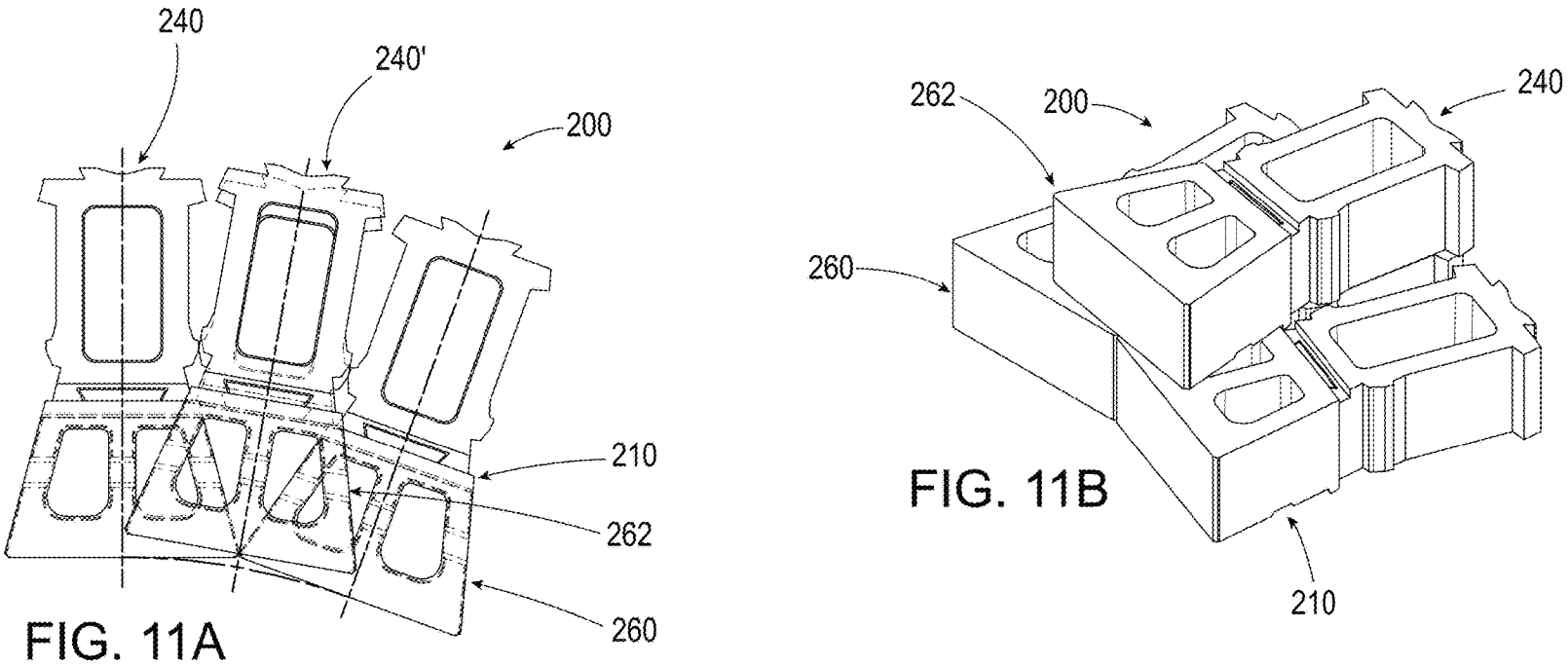
FIG. 11A
FIG. 11B
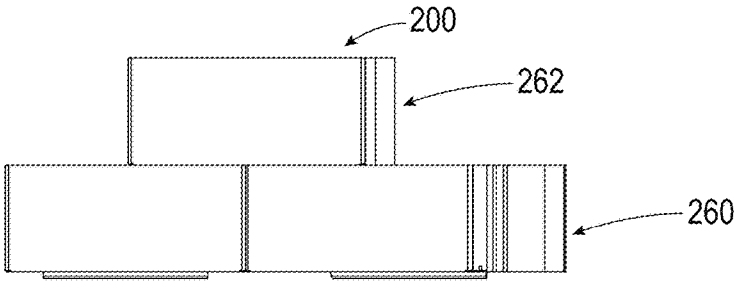
FIG. 11C
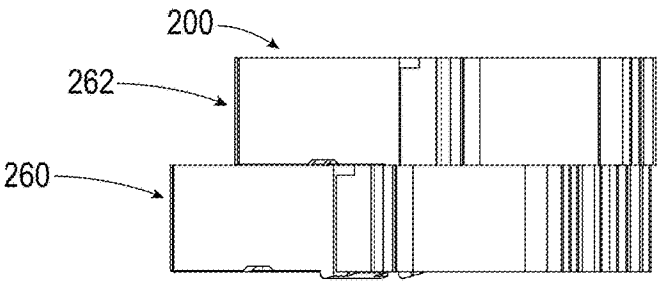
FIG. 11D

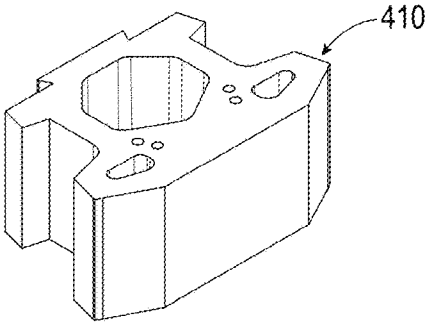
FIG. 32A
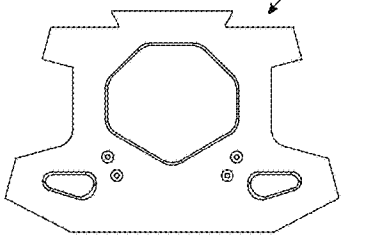
FIG. 32B
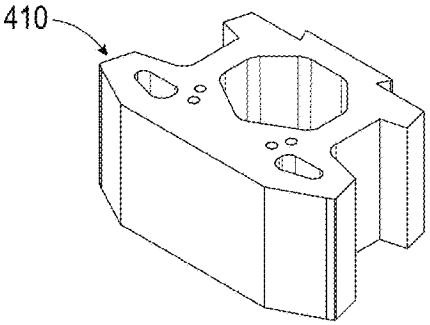
FIG. 32C
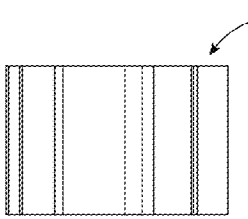
FIG. 32D
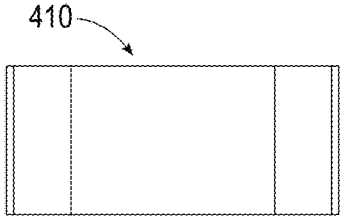
FIG. 32E
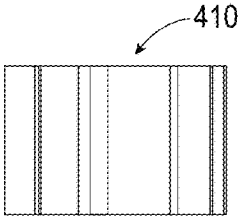
FIG. 32F
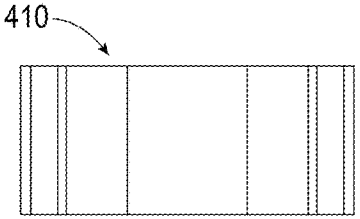
FIG. 32G
FIG. 32H
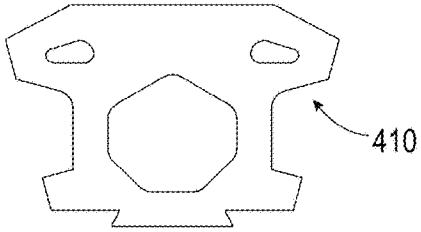
FIG. 32I
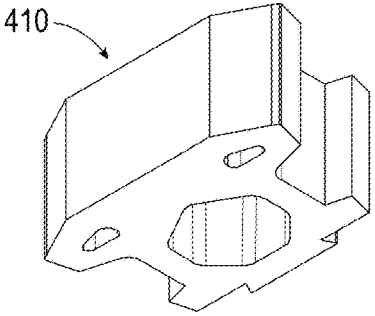
FIG. 32J

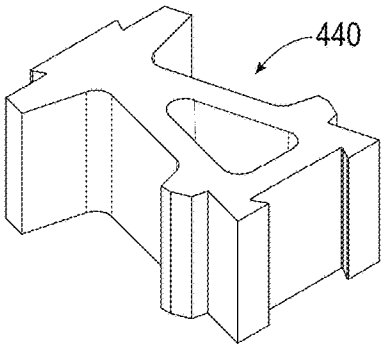
FIG. 33A
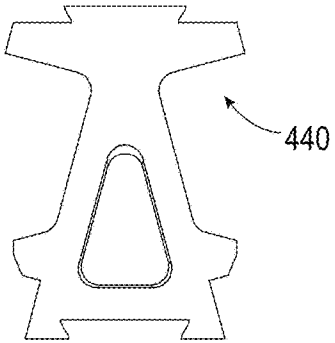
FIG. 33B
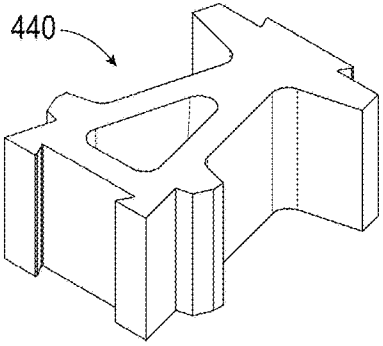
FIG. 33C
FIG. 33D
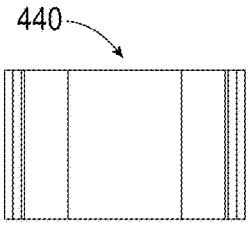
FIG. 33E
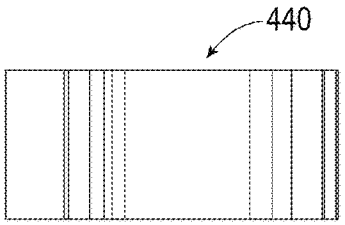
FIG. 33F
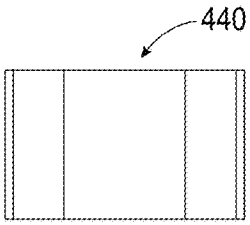
FIG. 33G
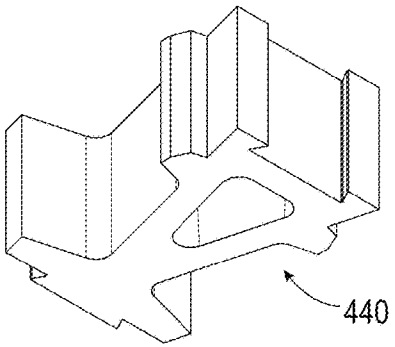
FIG. 33H
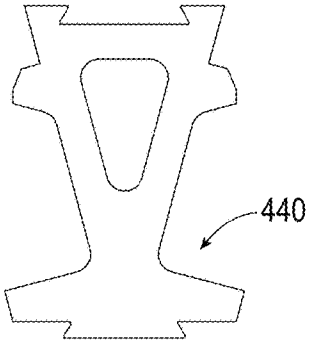
FIG. 33I
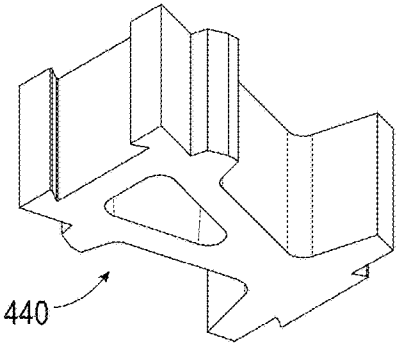
FIG. 33J

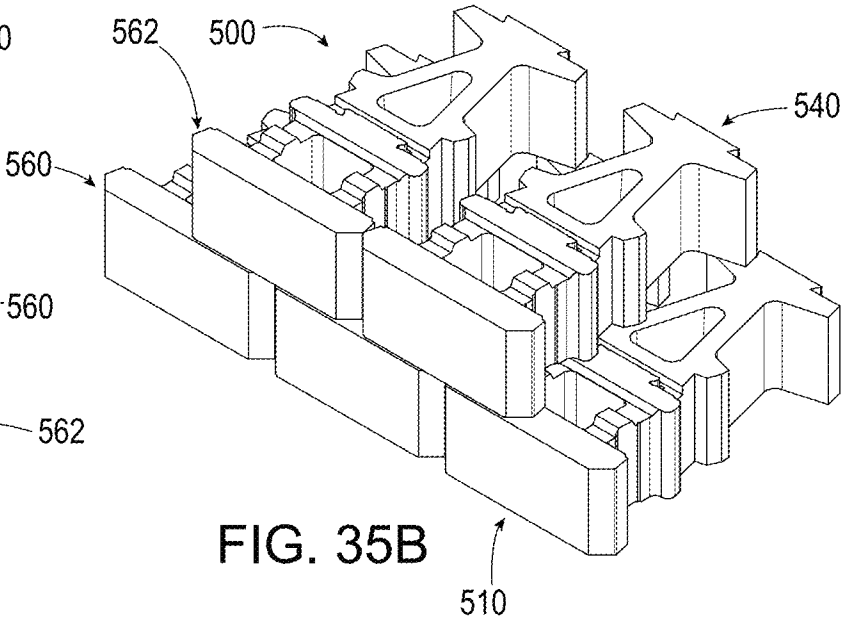
FIG. 35B
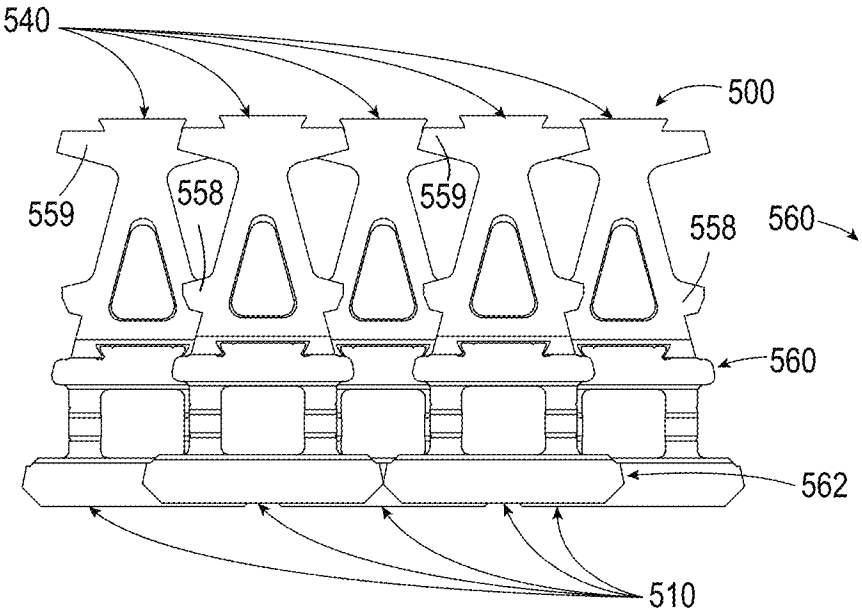
FIG. 35A
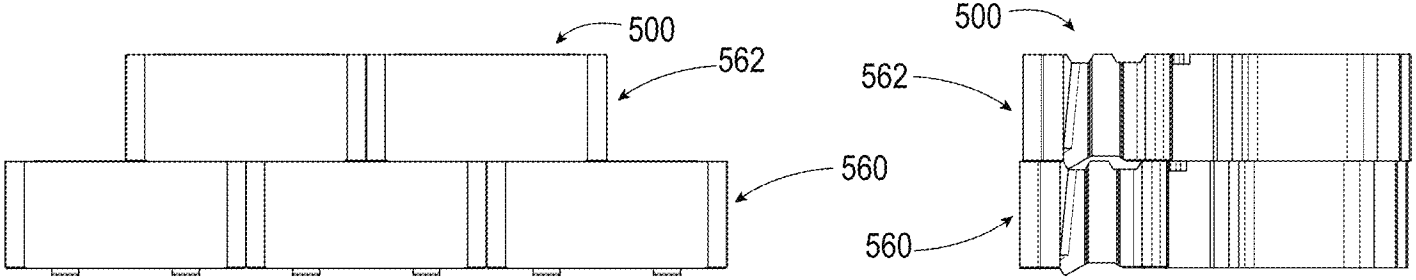
FIG. 35C
FIG. 35D

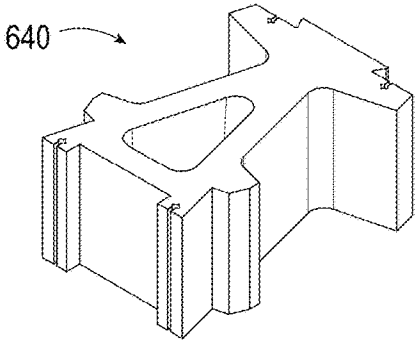
FIG. 45A
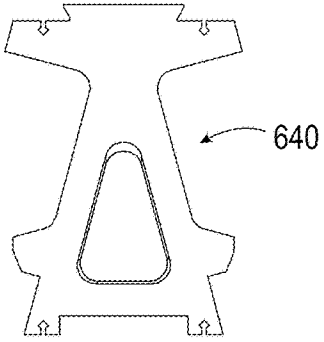
FIG. 45B
FIG. 45C
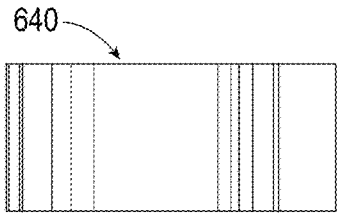
FIG. 45D
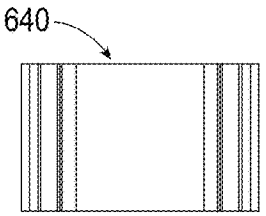
FIG. 45E
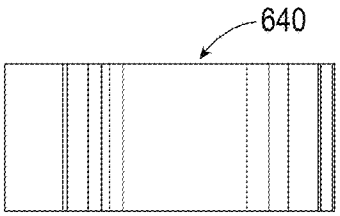
FIG. 45F
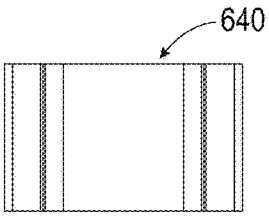
FIG. 45G
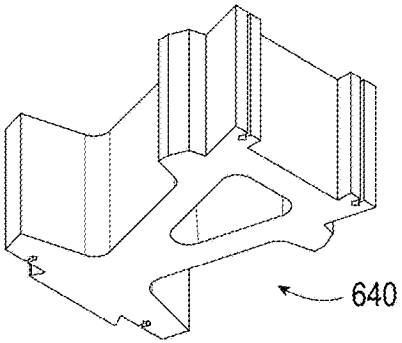
FIG. 45H
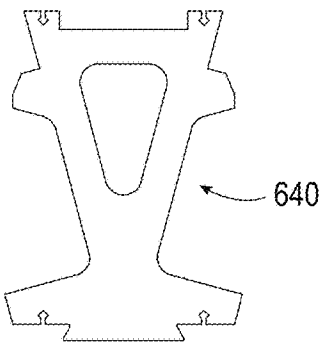
FIG. 45I
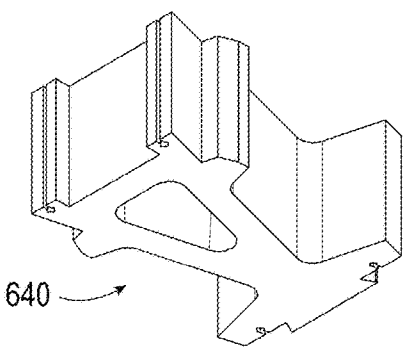
FIG. 45J

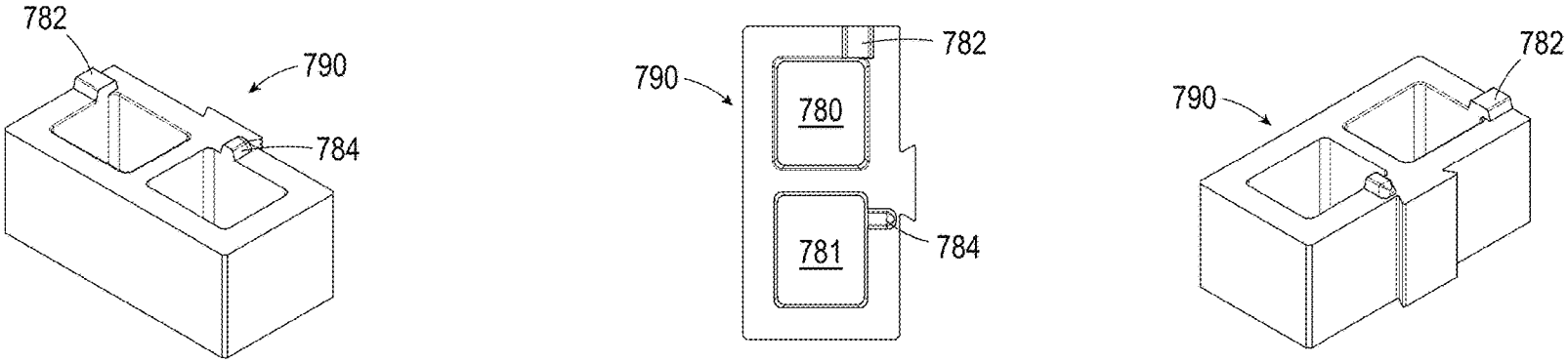
FIG. 55A
FIG. 55B
FIG. 55C
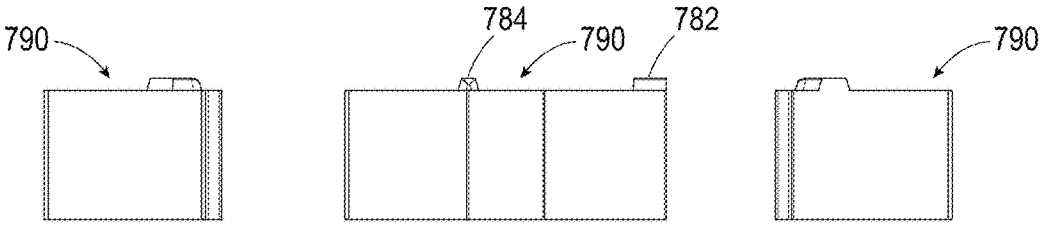
FIG. 54D
FIG. 54E
FIG. 54F
FIG. 54G
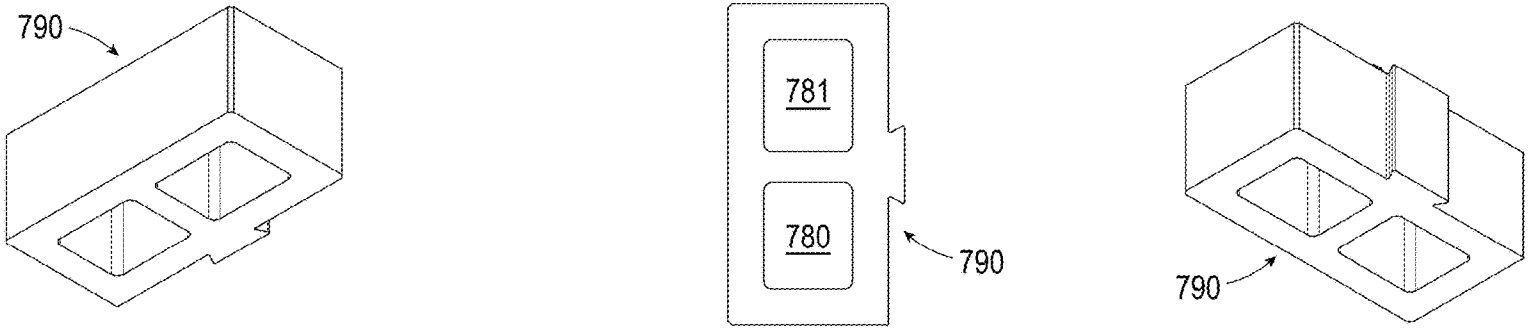
FIG. 55H
FIG. 55I
FIG. 55J

810

810

810

810

810

810

810

810

810

810

SEGMENTED WALL SYSTEMS HAVING TAIL BLOCKS

CROSS REFERENCE TO RELATED APPLICATIONS

This application claims priority to U.S. Provisional Patent Application No. 63/246,183, filed Sep. 20, 2021, U.S. Provisional Patent Application No. 63/277,909, filed Nov. 10, 2021, U.S. Provisional Patent Application No. 63/311,890, filed Feb. 18, 2022, and U.S. Provisional Patent Application No. 63/391,192, filed Jul. 21, 2022, each entitled "Segmented Wall Systems Having Tail Blocks and Methods of Manufacturing," and incorporated by reference herein, in the entirety and for all purposes.

BACKGROUND

Numerous methods and materials exist for the construction of retaining walls and landscaping walls, including dry-stacked (e.g., built without the use of mortar) segmental concrete retaining wall (SRW) units. SRW units have become a widely accepted product for the construction of retaining walls, because they are relatively inexpensive and can be mass produced. They also tend to be structurally sound, easy and relatively inexpensive to install, and couple the durability of concrete with the attractiveness of various architectural finishes.

Building a retaining wall using SRWs often involves adding reinforcing materials to ensure the integrity of the wall over time. Depending upon their location, the soil type, the amount of water that can flow through the retaining wall, and the mineral content of the water, can affect the structural integrity of the retaining wall. Thus, many retaining wall systems use geogrids, geosynthetic reinforcement, or geogrid soil reinforcement. These terms sometimes are used interchangeably, and "geogrid" as used herein is intended as a generic term. Reinforcement materials may be inextensible, such as steel mesh, or extensible geosynthetic materials, such as mats and oriented polymeric materials. For example, flat polymeric sheets are used to form geogrids by forming holes in the sheets and then drawing them to orient the polymer and increase the modulus. Such polymeric materials include high density polyethylene (HDPE) and these materials form relatively stiff geogrids commercially available under the trade designation TENSAR. However, these reinforcing materials can add quite a bit of expense to install projects, as they often involve quite a bit of extra labor. A SRW system that improves known reinforcement systems is desired.

BRIEF DESCRIPTION OF THE DRAWINGS

FIGS. 8-16 depict second embodiments of a segmented wall system with tail blocks, in accordance with the present disclosure.

FIGS. 25-33 depict fourth embodiments of a segmented wall system with tail blocks, in accordance with the present disclosure.

FIGS. 34-42 depict fifth embodiments of a segmented wall system with tail blocks, in accordance with the present disclosure.

FIGS. 43-46 depict sixth embodiments of a segmented wall system with tail blocks and connectors, in accordance with the present disclosure.

FIGS. 47-60 depict seventh embodiments of a segmented wall system with tail blocks and inter-course or inter-layer lug connections, in accordance with the present disclosure.

DETAILED DESCRIPTION

Figure 1B:
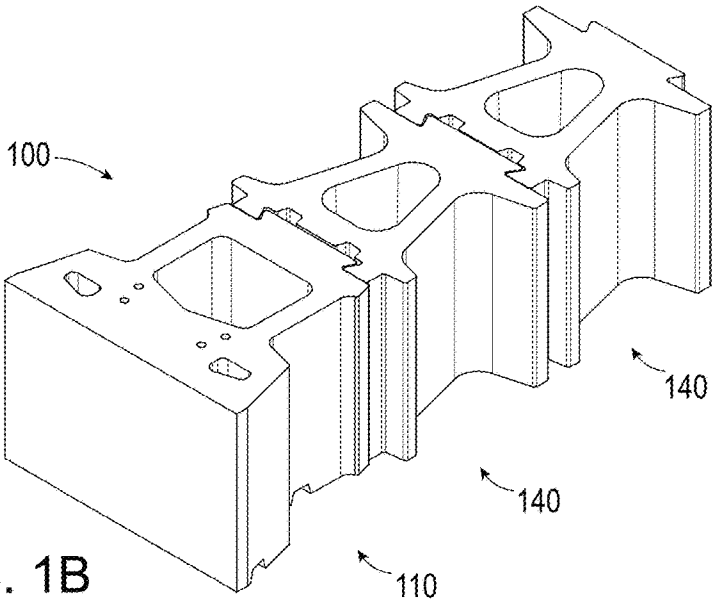
FIGS. 1-7 depict first embodiments of a segmented wall system with tail blocks, in accordance with the present disclosure.
Figure 1D:
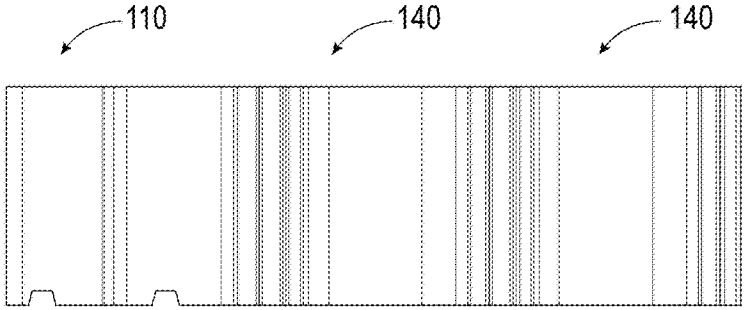

Certain details are set forth below to provide a sufficient understanding of embodiments of the present disclosure. However, it will be clear to one skilled in the art that embodiments of the present disclosure may be practiced without these particular details. Moreover, the particular embodiments of the present disclosure described herein are provided by way of example and should not be used to limit the scope of the disclosure to these particular embodiments.

This application includes examples of segmented wall systems having one or more tail blocks attached to a rear side of outward-facing structural wall blocks forming a segmented wall. In some examples, a segmented wall may be constructed from several vertically stacked courses or layers of wall blocks. Each course or layer of the segmented wall may generally extend in a first horizontal direction to form a face of the segmented wall and in second horizontal direction extending rearward from the face of the segmented wall. To form the segmented wall, each course or layer may include a respective set of wall blocks positioned side-by-side in a level plane. A number of respective wall blocks in each course or layer may be based on a horizontal length of the segmented wall in the first direction and a respective width in the first direction of each of the wall blocks.

In addition, one or more courses or layers of the segmented wall may include a respective tail block attached to (e.g., interlocked with) with a rear side of one or more of the respective set of wall blocks. For example, if the front of the segmented wall is straight or has a concave shape, a respective tail block may be attached to each of the set of wall blocks of one or more courses or layers. If the segmented wall has a concave shape that exceeds a particular curvature, additional tail blocks not connected to any wall blocks may be interleaved between tail blocks attached to the wall blocks to provide lateral support between the tail blocks. In some examples, if the front of the segmented wall has a corner or a convex shape, a respective tail block may be attached to fewer than all of the set of wall blocks of one or more courses or layers.

The wall blocks may each have a uniform size and shape, and the tail blocks may each have a uniform size and shape that is different than the size and shape of the wall blocks. In some examples, the wall blocks and the tail blocks may have a same, as installed, vertical height. In some examples, a length of the tail blocks may be greater than a length of the wall blocks. The wall blocks and the tail blocks may be made of a rugged, weather resistant material, such as precast concrete (e.g., dry cast or wet cast). Other suitable materials are plastic, reinforced fibers, wood, metal and stone.

In some examples, the wall block may include at least one opening formed between a front portion having the front side and a rear portion having the rear side, with opposing neck portions extending between the front portion and the rear portion on opposing sides of the opening. If more than one opening is included, additional, inner neck portions may be formed between each pair of openings.

In some embodiments, the tail block may include a front portion having a first end configured to connect to the wall block and a rear portion having a second opposing end, with the front portion and the rear portion being connected via one or more neck portions. In some examples, the front portion and the rear portion may include wing portions that are configured to interlock with adjacent tail blocks.

In some examples, the tail block may include two opposing neck portions that form an opening between the front portion and the rear portion. In some examples, the opposing neck portions of the tail block have a non-parallel relationship from the front portion to the rear portion (e.g., the first distance between the opposing neck portions at the front portion is greater than the second distance between the opposing neck portions at the rear portion).

In some examples, the opposing neck portions merge together at or near the rear portion. In some examples, the opposing neck portions of the tail block have a parallel relationship from the front portion to the rear portion (e.g., the first distance between the opposing neck portions at the front portion is equal to the second distance between the opposing neck portions at the rear portion).

In some examples, the first distance is approximately equal to a distance between the opposing neck portions of the wall block at the rear portion of the wall block such that the opposing neck portions of the wall block align with the opposing neck portions of the tail block. In alternative embodiments, the tail block may have single neck portion extending between a front portion having the first side and a rear portion having a second side.

In some examples, the second end of the rear portion of the tail blocks may be configured to attach to another tail block such that multiple tail blocks could be attached together in a chain-like manner. In some examples, the front portion of the tail blocks may connect to the wall blocks (or to another tail block) using a connection system formed in the wall block and the tail block. For example, the tail block may connect to the wall block (or to another tail block) using a vertical (e.g., extending from an as-installed, top side to a bottom side of the wall block) dovetail connection.

In some examples, the wall block (and the second end of the tail block) may include the male dovetail connection protruding from the rear side of the wall block and the tail block may include a female dovetail connection formed in the first side of the tail block. The dovetail connection between the tail block and the wall block (or another tail block) may extend an entire height of the rear side of the wall block (or the second side of the tail block). In some examples, male dovetail connection on the wall block may extend more than half of the width of the rear side of the wall block.

In some examples, as segmented walls are constructed, courses or layers of wall blocks are formed by vertically stacking wall blocks. For courses or layers that include tail blocks, the tail blocks from an upper layer may also stack on tail blocks from a lower layer in a similar manner.

In some examples, the shape of the wall may cause a neck portion of a tail block of a first course or layer to at least partially overlap in a vertical direction with a neck portion of a tail block of a second course or layer on which the first layer or course is stacked to form a column of vertically-supported neck portions. In some examples, a segmented wall having a concave shape exceeding a particular curvature may cause a neck portion of a tail block of a first course or layer to at least partially overlap in a vertical direction with a neck portion of a tail block of a second course or layer that is not connected to any wall blocks (e.g., interleaved between two tail blocks connected to wall blocks) to form vertically-supported column of neck portions. The stacking of the tail blocks may add additional stability to the segmented wall by adding additional interlocking structure between two adjacent courses of the segmented wall. As the tail blocks are covered with fill material, the interlocking between layers of the tail blocks may be further strengthened.

In some examples, the wall system may further include use of reinforced earth techniques such as geogrid reinforcement, geosynthetic reinforcement, or the use of inextensible materials such as steel matrices. After placement of a course or layer of the wall, a geogrid material may be placed over the course or layer before placement of a next course or layer. The weight of the upper course or layer on the geogrid material sandwiched between two layers may hold the geogrid material in place. In some examples, additional pins, stakes, or other connectors in the wall block, the tail block, or the fill material may be used to penetrate the apertures of the geogrid material to further hold it in place. The use of the geogrid material may form a lateral interlocking connection between wall blocks and tail blocks of a course or layer, which may further fortify the segmented wall.

FIGS. 1-7 depict first embodiments of a segmented wall system 100 with tail blocks 140, in accordance with the present disclosure. The segmented wall system 100 of FIGS. 1-7 may be formed using a combination of wall blocks 110 and tail blocks 140.

Figure 4B:
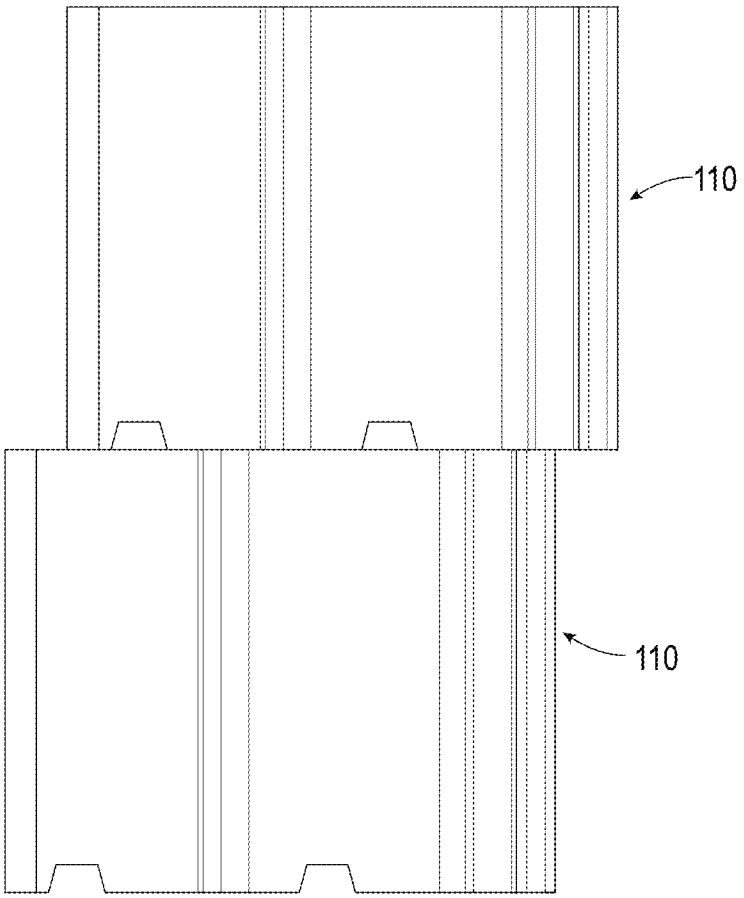
Figure 4A:
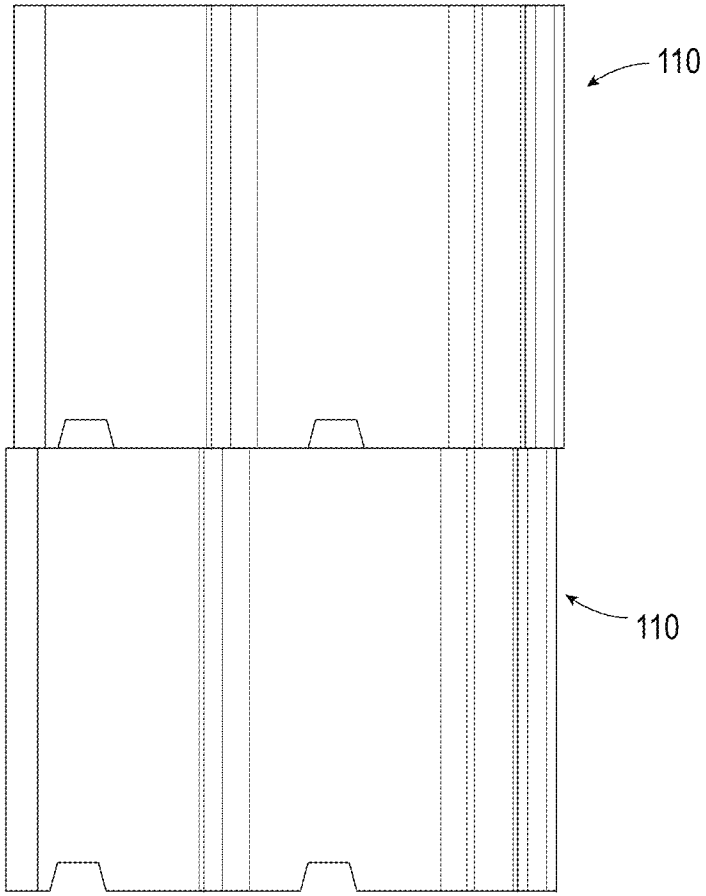

FIGS. 1A-1D depict various top plan, perspective, and front and side elevation views of a wall block 110 connected to a first tail block 140, and a second tail block 140 connected to the first tail block 140. FIGS. 2A-2D and 3A-3D depict different segmented wall shapes with various arrangements of the wall blocks 110 and tail blocks 140, in accordance with embodiments of the disclosure. FIGS. 4A and 4B depict examples of two different setback options (e.g., near vertical setback or full setback) between two adjacent courses or layers at a front of a segmented wall, in accordance with embodiments of the disclosure.

Figure 5A:
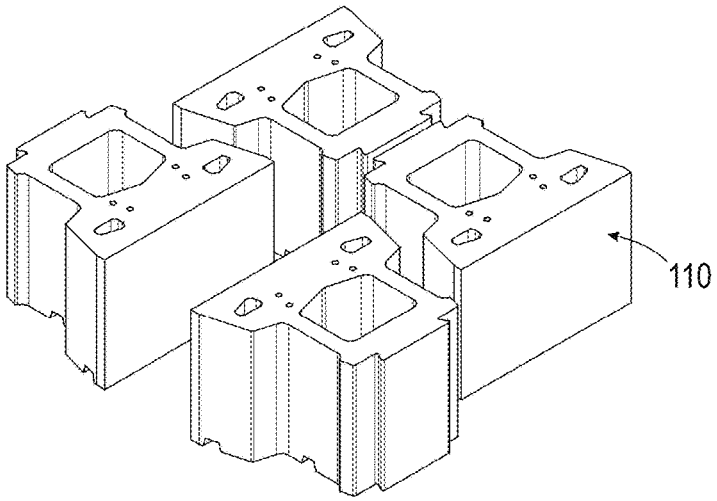
Figure 5B:
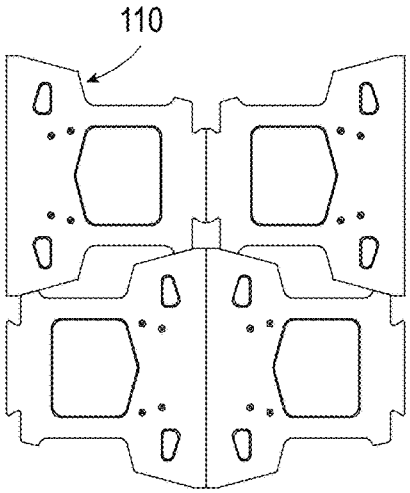
Figure 5C:
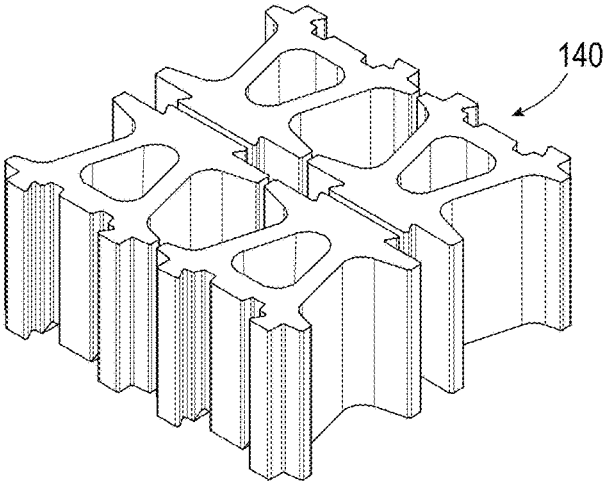
Figure 5D:
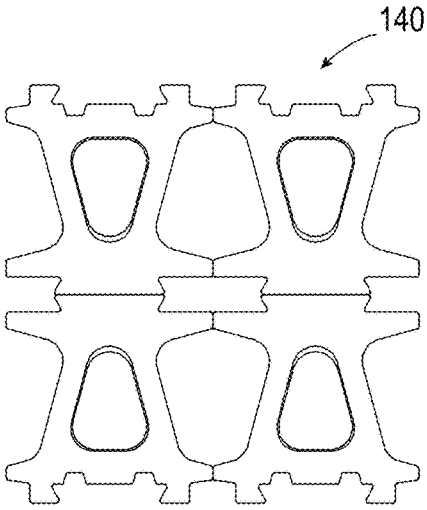
Figure 6D:
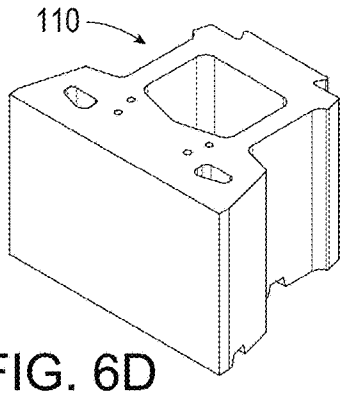
Figure 6C:
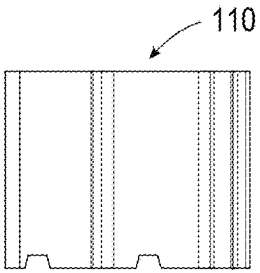
Figure 6B:
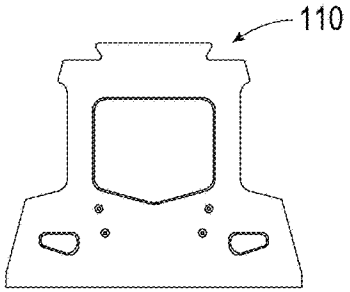
Figure 6A:
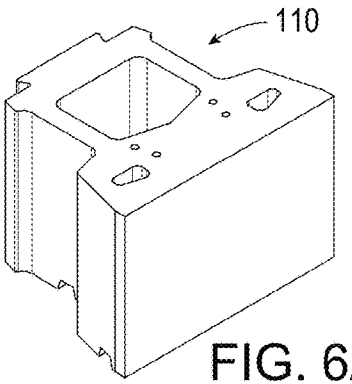
Figure 6G:
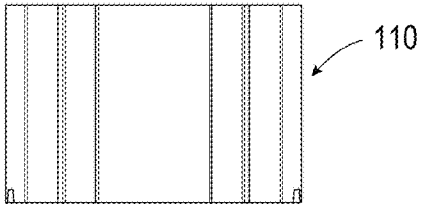
Figure 6F:
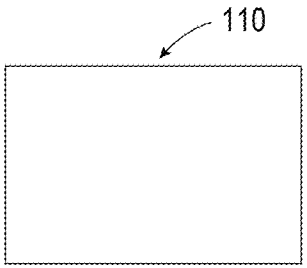
Figure 6E:
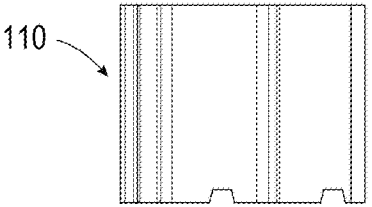
Figure 6J:
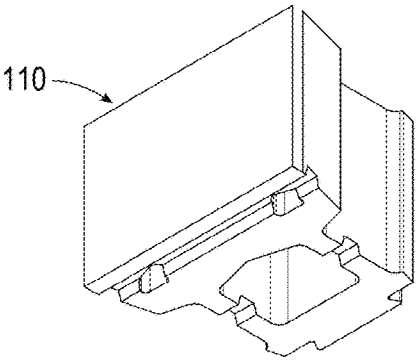
Figure 6I:
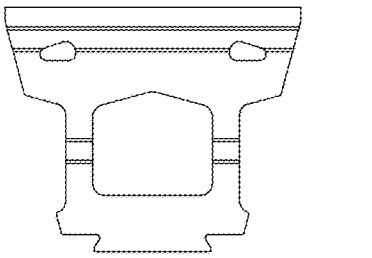
Figure 6H:
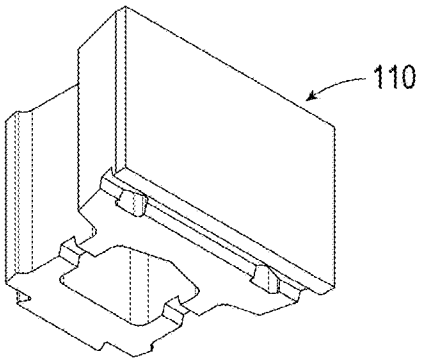
Figure 7A:
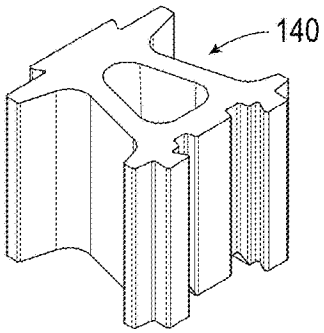
Figure 7B:
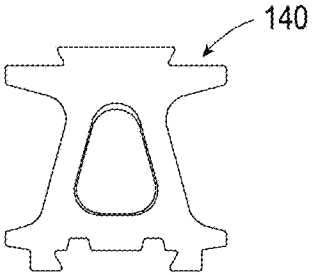
Figure 7C:
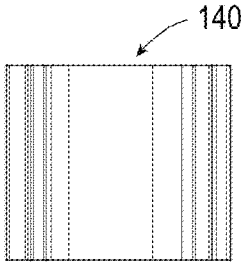
Figure 7D:
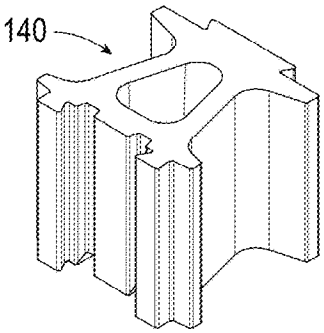
Figure 7E:
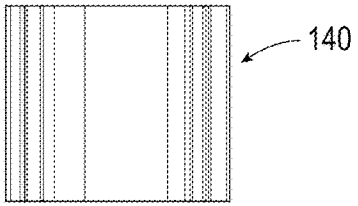
Figure 7F:
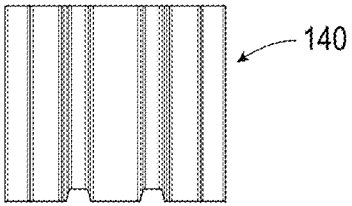
Figure 7G:
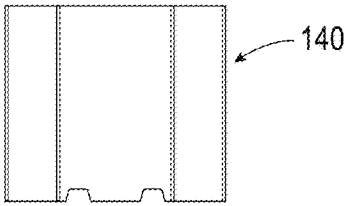
Figure 7H:
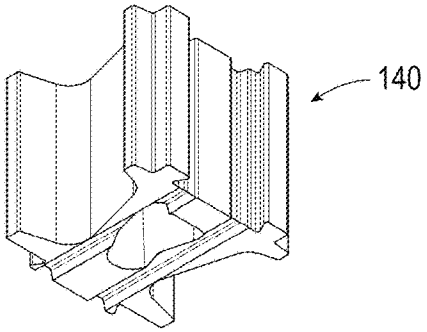
Figure 7I:
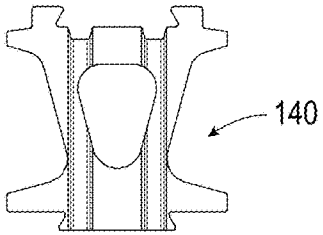
Figure 7J:
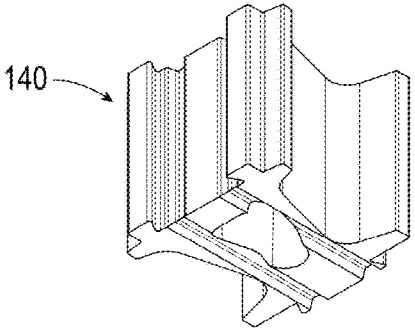
Figure 8B:
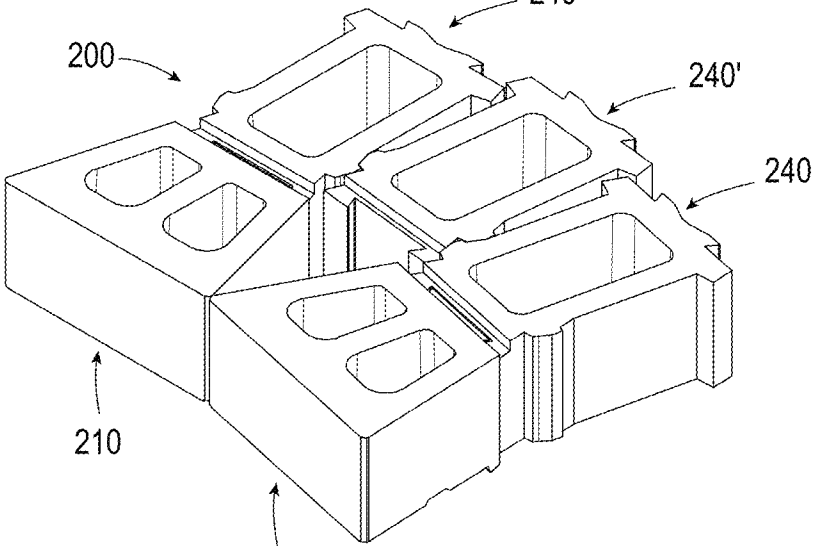
Figure 8D:
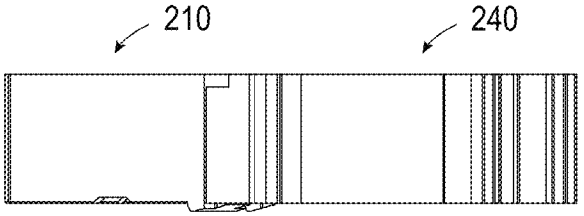
Figure 8A:
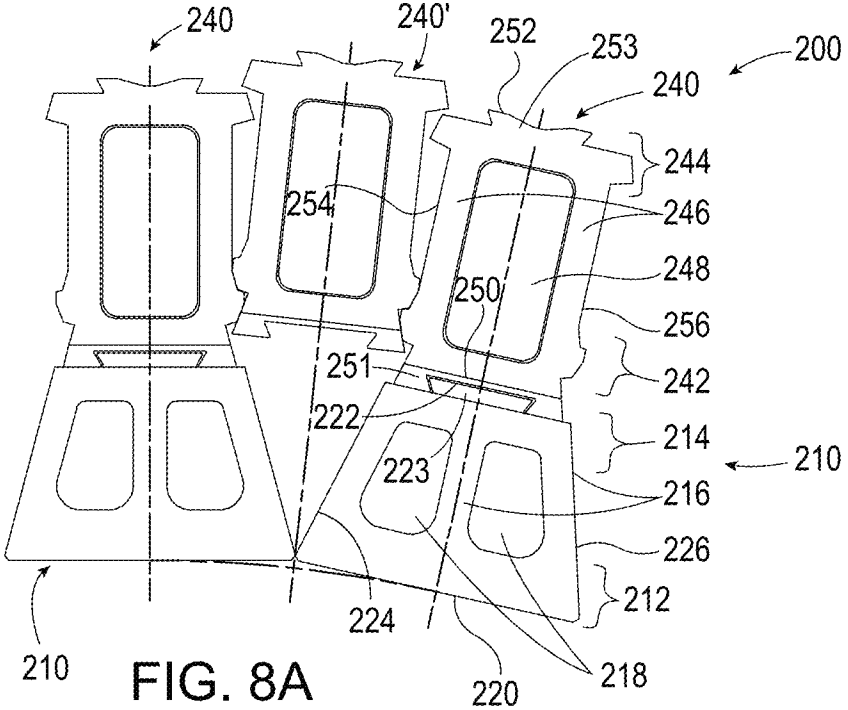
Figure 8C:
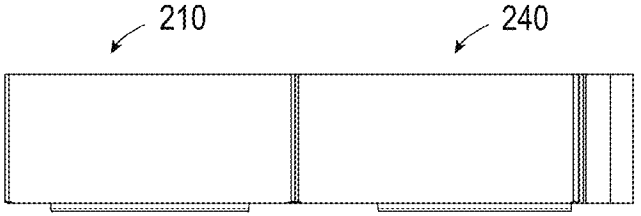

FIGS. 5A and 5B depict an example pallet layout of wall blocks 110 in accordance with embodiments of the disclosure. FIGS. 5C and 5D depict an example pallet layout of tail blocks 140 in accordance with embodiments of the disclosure. FIGS. 6A-6J depict various perspective, plan and elevation views of the wall block 110, in accordance with embodiments of the disclosure. FIGS. 7A-7J depicts various perspective, plan and elevation views of the tail block 140, in accordance with embodiments of the disclosure.

Figure 1A:
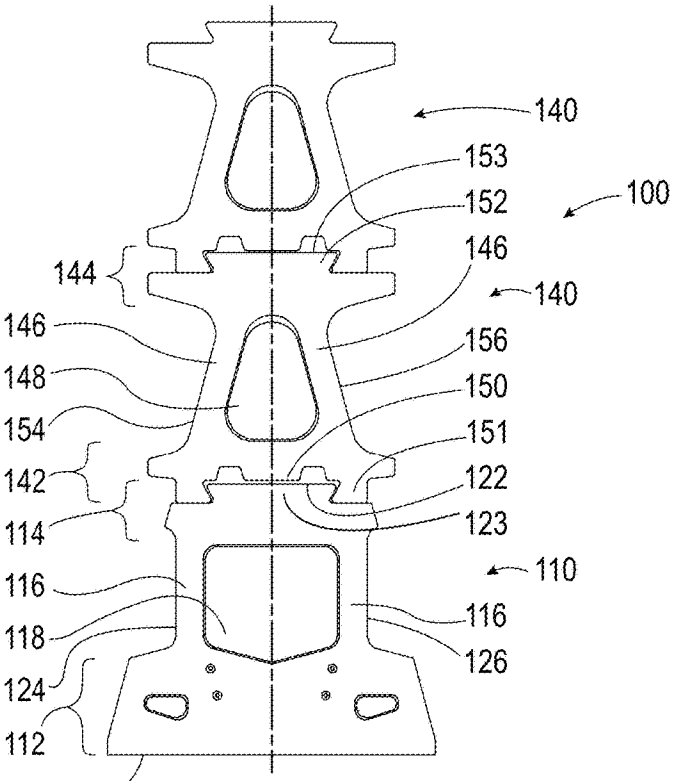
Figure 1C:
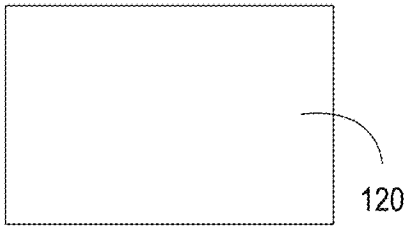
Figure 2B:
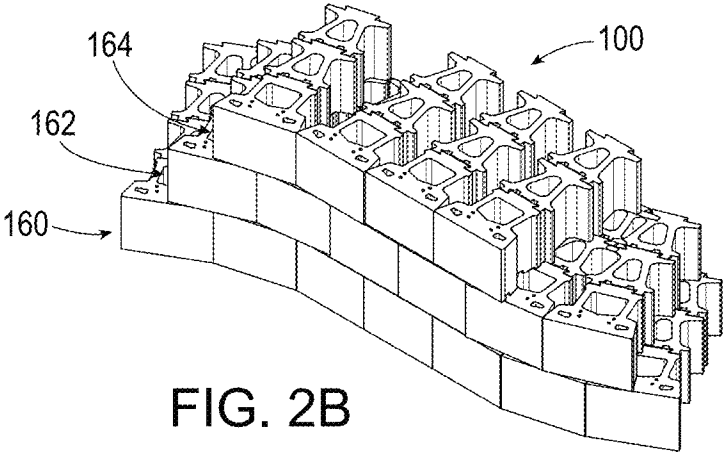
Figure 2D:
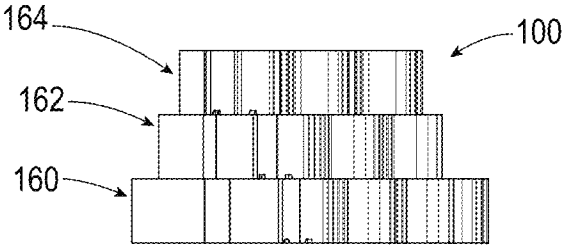
Figure 2A:
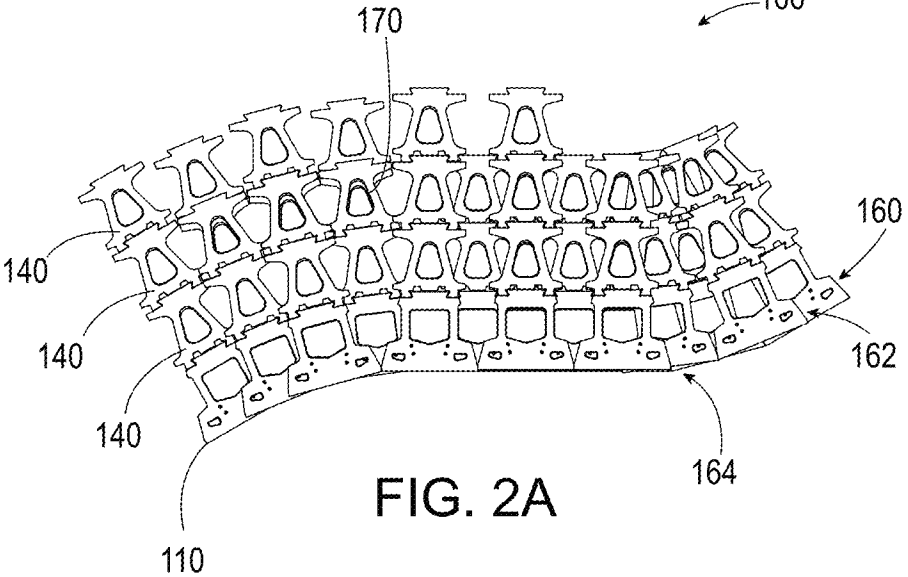
Figure 2C:
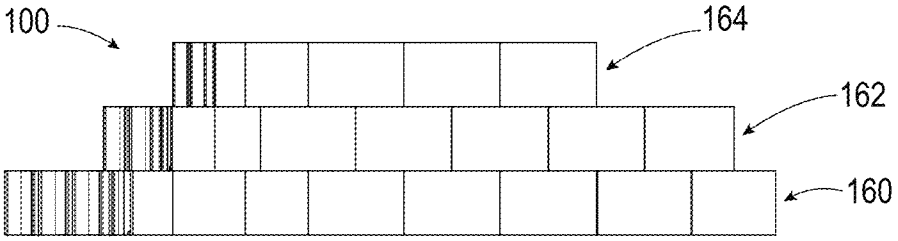
Figure 3B:
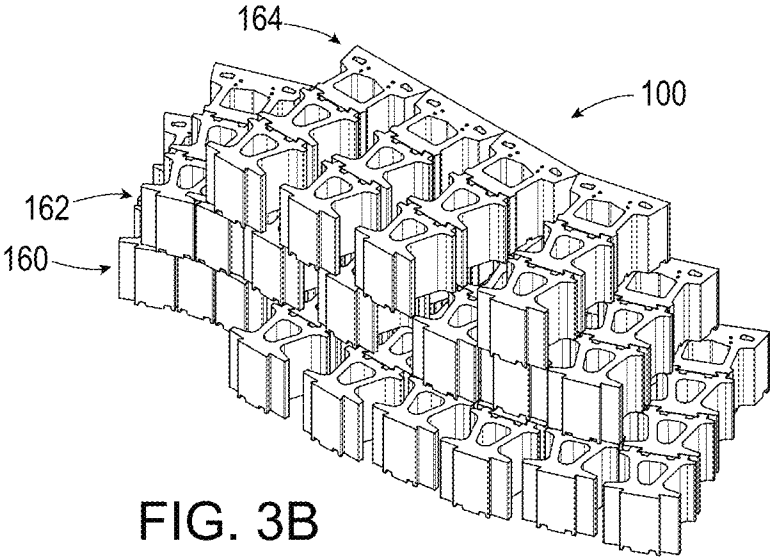
Figure 3D:
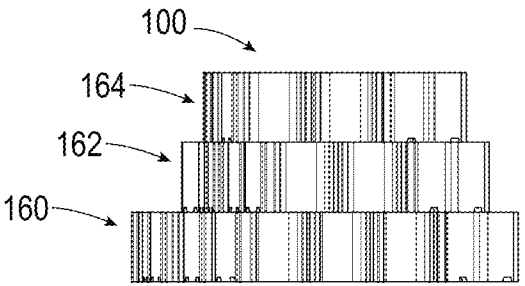
Figure 3A:
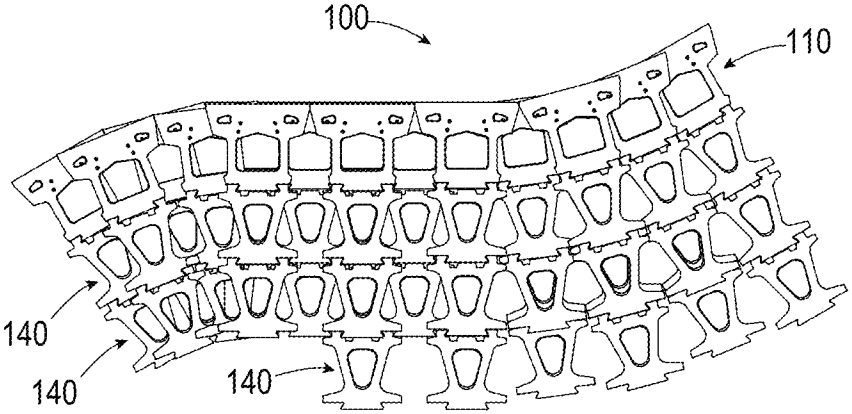
Figure 3C:
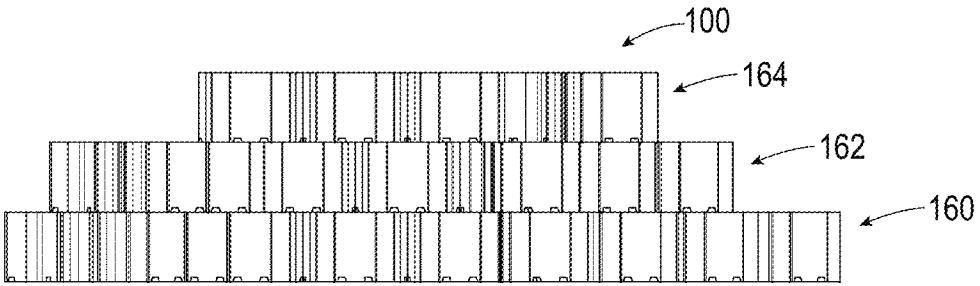

FIGS. 1A-ID identify detailed elements of the wall blocks 110 and the tail blocks 140 using reference numbers. Many of those reference numbers are not repeated in FIGS. 2-7 in the interest of clarity and brevity. One of skill in the art would appreciate that those common elements exist as described with reference to FIGS. 1A-1D.

The wall blocks 110 may each have a uniform size and shape, and the tail blocks 140 may each have a uniform size and shape that is different than the size and shape of the wall blocks 110. In some examples, the wall blocks 110 and the tail blocks 140 may have a same, as installed, vertical height H. In some examples, a length of the tail blocks 140 may be greater than a length of the wall blocks 110. The wall blocks 110 and the tail blocks 140 may be made of a rugged, weather resistant material, such as pre-cast concrete (e.g., dry cast or wet cast). Other suitable materials are plastic, reinforced fibers, wood, metal and stone.

In some examples, the wall block 110 may include at least one opening 118 formed between a front portion 112 having the front side 120 and a rear portion 114 having the rear side 122, with opposing neck portions 116 extending between the front portion 112 and the rear portion 122 on opposing sides of the opening 118. The outer surfaces of the opposing neck portions 116 may form sides 124 and 126 of the wall block 110. A top and bottom of the wall block 110 may include a flat surface to facilitate stacking of other wall blocks on top of one another.

The tail block 140 may include a front portion 142 having a first (front) end 150 configured to connect to the wall block 110 and a rear portion 144 having a second opposing (back) end 152, with the front portion 142 and the rear portion 144 being connected via one or more neck portions 146. In some examples, the front portion 142 and the rear portion 144 may include wing portions that are configured to interlock with adjacent tail blocks.

In some examples, the tail block 140 may include two opposing neck portions 146 that form an opening 148 between the front portion 142 and the rear portion 144. The outer surfaces of the opposing neck portions 146 may form sides 154 and 156 of the tail block 140. A top and bottom of the tail block 140 may include a flat surface to facilitate stacking of other tail blocks 140 on top of one another.

In some examples, the opposing neck portions 146 of the tail block 140 may have a non-parallel relationship from the front portion 142 to the rear portion 144 (e.g., the first distance between the opposing neck portions 146 at the front portion 142 is greater than the second distance between the opposing neck portions 146 at the rear portion 144). In some examples, the opposing neck portions 146 merge together at or near the rear portion 144.

In some examples, the front portion 142 of the tail blocks 140 may connect to the wall blocks 110 (or to another tail block 140) using a connection system 123 and 151 formed in the wall block 110 and the tail block 140, respectively. For example, the tail block 140 may connect to the wall block 110 (or to another tail block 140) using a vertical (e.g., extending from an as-installed, top side to a bottom side of the wall block 110) dovetail connection (e.g., using connectors 123 and 151).

In some examples, the wall block 110 (and the second end 152 of the tail block 140) may include the male dovetail connection 123 (or 153) protruding from the rear side 122 of the wall block 110 (or second end 152 of the tail block 140), and the tail block 140 may include a female dovetail connection 151 formed in the first end 150 of the tail block 140. The dovetail connection (using connectors 123 and 151) between the tail block 140 and the wall block 110 (or connector 153 and connector 151 on another tail block 140) may extend an entire height of the rear side 122 of the wall block 110 (or the second end 152 of the tail block 140). In some examples, male dovetail connection 123 on the wall block 110 may extend more than half of the width of the rear side 122 of the wall block 110.

As previously described, the second end 152 of the rear portion 144 of the tail blocks 140 may be configured to attach to another tail block 140 such that multiple tail blocks 140 could be attached together in a chain-like manner (e.g., such as at least three tail blocks, as shown in FIGS. 1A-ID). While the connection shown in FIGS. 1-7 includes a dovetail connection, other types of connections may be used, such as a rounded connection or additional slotted connections where a connector is slid into slots formed in each of the wall block 110 and the tail block 140.

FIGS. 2A-2D and 3A-3D depict front and rear views, respectively, of one example of a portion (e.g., courses 160, 162, and 164) of a segmented wall 100 with a non-linear shape formed using the wall blocks 110 and the tail blocks 140 in accordance with embodiments of the disclosure. As shown, the portion of the segmented wall 100 may be constructed from several vertically stacked courses or layers 160, 162, and 164 of wall blocks 110. Each course or layer 160, 162, and 164 of the segmented wall 100 may generally extend in a first horizontal direction to form a face of the segmented wall 100 and in second horizontal direction extending rearward from the face of the segmented wall 100. To form the segmented wall 100, each course or layer 160, 162, and 164 may include a respective set of wall blocks 110 positioned side-by-side in a level plane. A number of respective wall blocks 110 in each course or layer 160, 162, and 164 may be based on a horizontal length of the segmented wall 100 in the first direction and a respective width in the first direction of each of the wall blocks 110.

In addition, the courses or layers 160, 162, and 164 of the segmented wall 100 may include at least one respective tail block 140 attached to (e.g., interlocked with) with a rear side of one or more of the respective set of wall blocks 110. For example, if the front of the segmented wall 100 is straight or has a concave shape, a respective tail block 140 may be attached to each of the set of wall blocks of one or more courses or layers. If the segmented wall 100 has a concave shape that exceeds a particular curvature, additional tail blocks 140 not connected to any wall blocks may be interleaved between tail blocks 140 attached to the wall blocks 110 to provide lateral support between the tail blocks 140. In some examples, if the front of the segmented wall 100 has a corner or a convex shape, a respective tail block 140 may be attached to fewer than all of the set of wall blocks 110 of one or more courses or layers 160, 162, and 164.

In some examples, the segmented wall 100 is constructed, the courses or layers 160, 162, and 164 of wall blocks 110 are formed by vertically stacking wall blocks 110. For courses or layers 160, 162, and 164 that include tail blocks 140, the tail blocks 140 from an upper layer (e.g., 162 or 164) may also stack on tail blocks 140 from a lower layer (e.g., 160 or 162) in a similar manner.

In some examples, the shape of the segmented wall 100 may cause a neck portion of a tail block 140 of a first course or layer (e.g., 162 or 164) to at least partially overlap in a vertical direction with a neck portion of a tail block 140 of a second course or layer (e.g., 160 or 162) on which the first layer or course (e.g., 162 or 164) is stacked to form a column of vertically-supported neck portions. In some examples, a segmented wall 100 having a concave shape exceeding a particular curvature may cause a neck portion of a tail block 140 of a first course or layer (e.g., 162 or 164) to at least partially overlap in a vertical direction with a neck portion of a tail block 140 of a second course or layer (e.g., 160 or 162) that is not connected to any wall blocks 110 (e.g., interleaved between two tail blocks 140 connected to wall blocks 110) to form vertically-supported column of neck portions.

The stacking of the tail blocks 140 may add additional stability to the segmented wall 100 by adding additional interlocking structure between two adjacent courses or layer 160, 162, or 164 of the segmented wall 100. As the tail blocks 140 are covered with fill material, the interlocking between courses or layers 160, 162, and 164 of the tail blocks 140 may be further strengthened. As previously described, the use of a geogrid material in construction of the segmented wall system may fortify lateral connections between wall blocks and tail blocks in a course or layer.

The segmented wall 100 depicted in FIGS. 2A-2D and 3A-3D is exemplary. Thus, while FIGS. 2A-2D and 3A-3D depict the segmented wall 100 with three courses or layers 160, 162, and 164; it is appreciated that the segmented wall 100 may include more or fewer than three courses or layers. It is also appreciated that the segmented wall 100 may include more or fewer than a number of wall blocks 110 and tail blocks 140 in each course or layer than depicted. It is also appreciated that a segmented wall 100 may be constructed in a different shape than depicted without departing from the scope of the disclosure. Finally, it is appreciated that some courses or layers of the segmented wall 100 may include no tail blocks 140, a single row of tail blocks 140, or more than two rows of wall blocks without departing from the scope of the disclosure.

FIGS. 8-16 depict second embodiments of a segmented wall system 200 with tail blocks 240, in accordance with the present disclosure. The segmented wall systems 200 of FIGS. 8-16 may be formed using a combination of wall blocks 210 and tail blocks 240.

FIGS. 8A-8D depict examples of various top plan, perspective, and front and side elevation views of part of a course or layer of wall blocks 210 connected to tail blocks 240, with an additional tail block 240' between the two tail blocks 240, in accordance with embodiments of the disclosure. FIGS. 9-13 depict different segmented wall shapes with various arrangements of the wall blocks 210 and tail blocks 240, in accordance with embodiments of the disclosure.

Figure 14A:
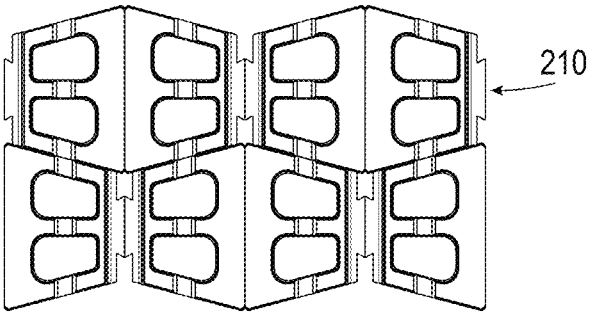
Figure 14C:
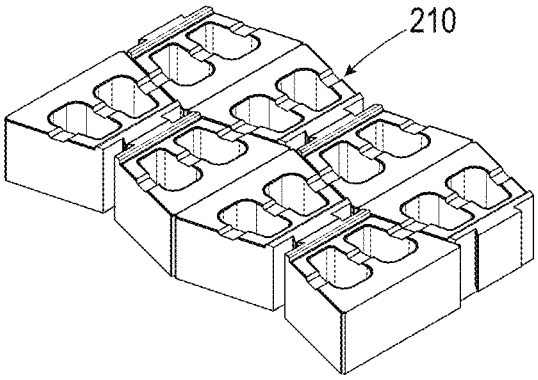
Figure 14B:
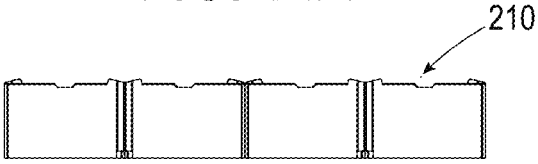
Figure 14D:
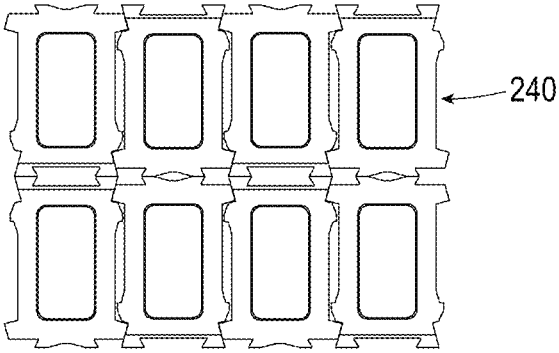
Figure 14F:
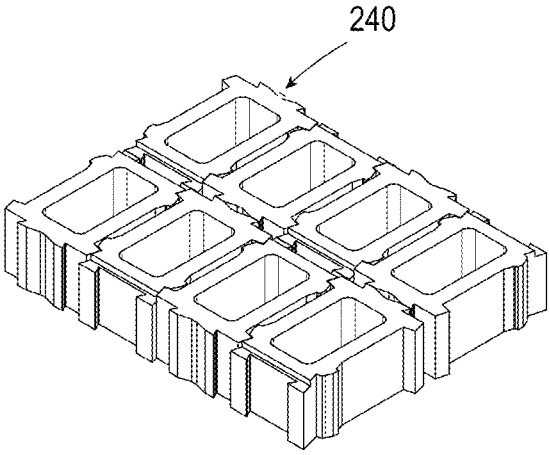
Figure 14E:
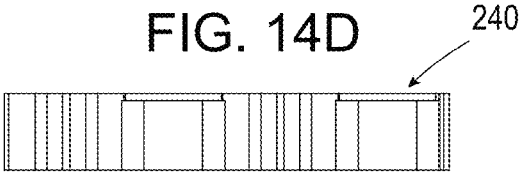
Figure 15A:
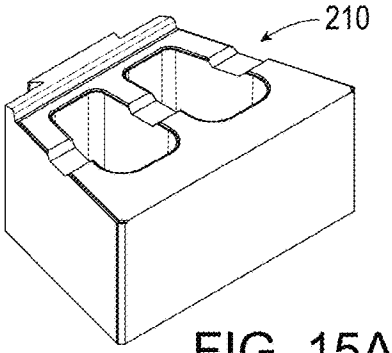
Figure 15B:
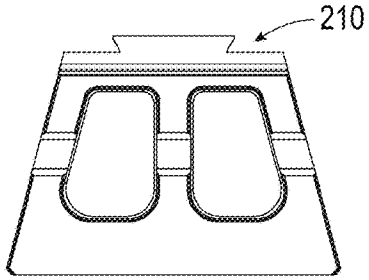
Figure 15C:
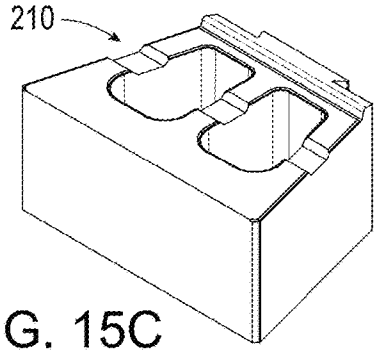
Figure 15D:
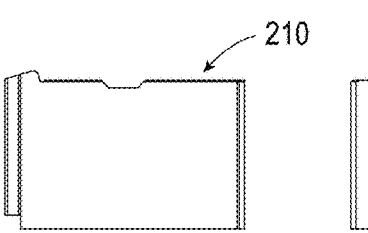
Figure 15E:
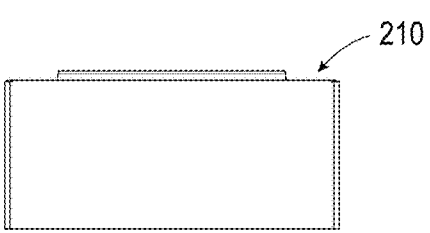
Figure 15F:
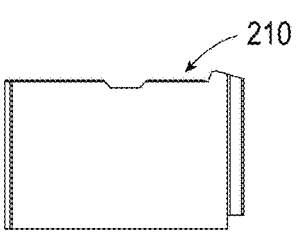
Figure 15G:
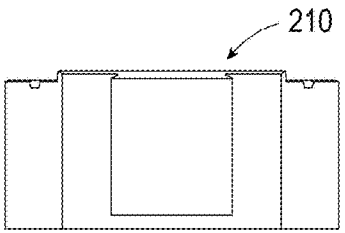
Figure 15H:
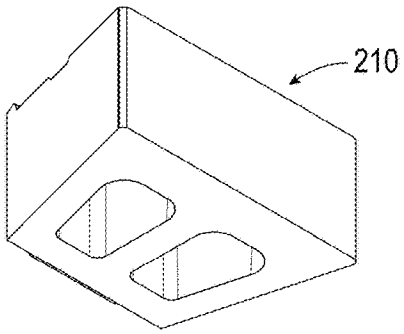
Figure 15I:
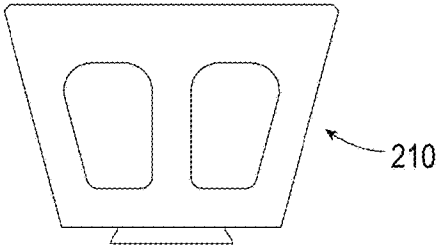
Figure 15J:
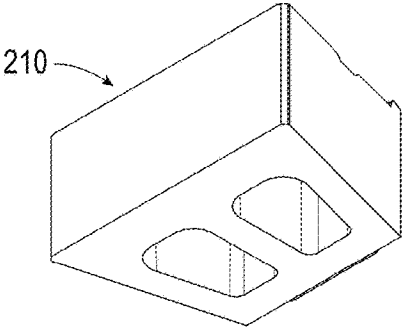
Figure 16A:
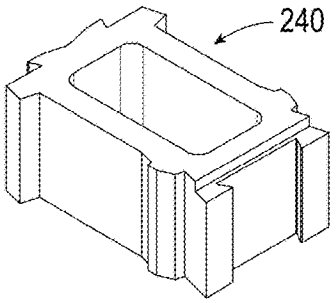
Figure 16B:
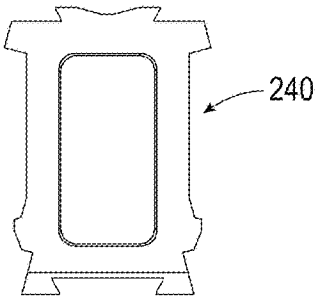
Figure 16C:
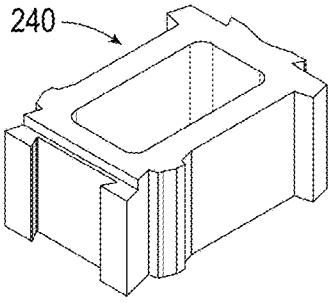
Figure 16D:
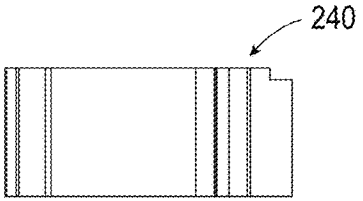
Figure 16E:
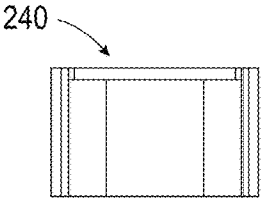
Figure 16F:
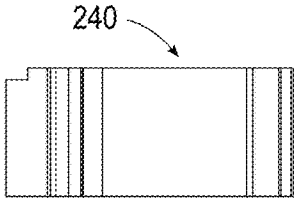
Figure 16G:
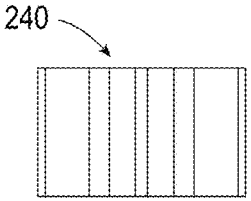
Figure 16H:
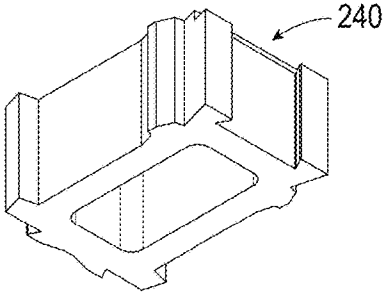
Figure 16I:
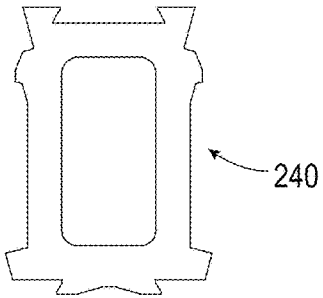
Figure 16J:
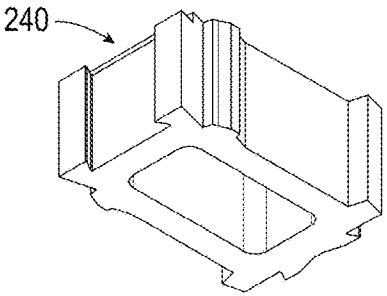
Figure 17B:
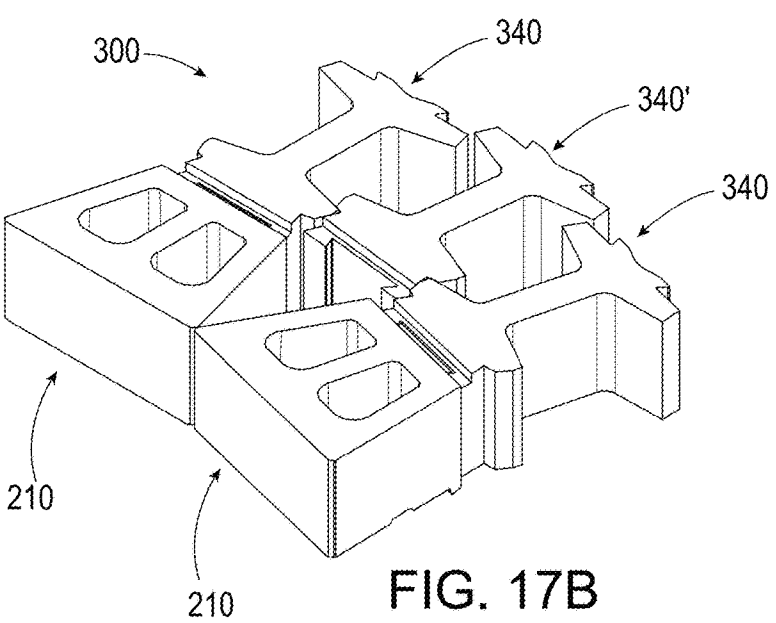
FIGS. 17-24 depict third embodiments of a segmented wall system with tail blocks, in accordance with the present disclosure.
Figure 17D:
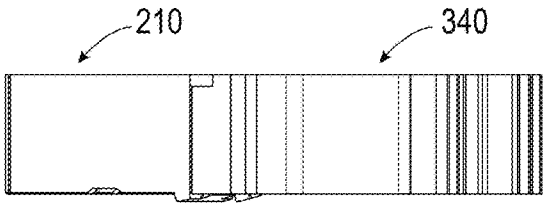
Figure 17A:
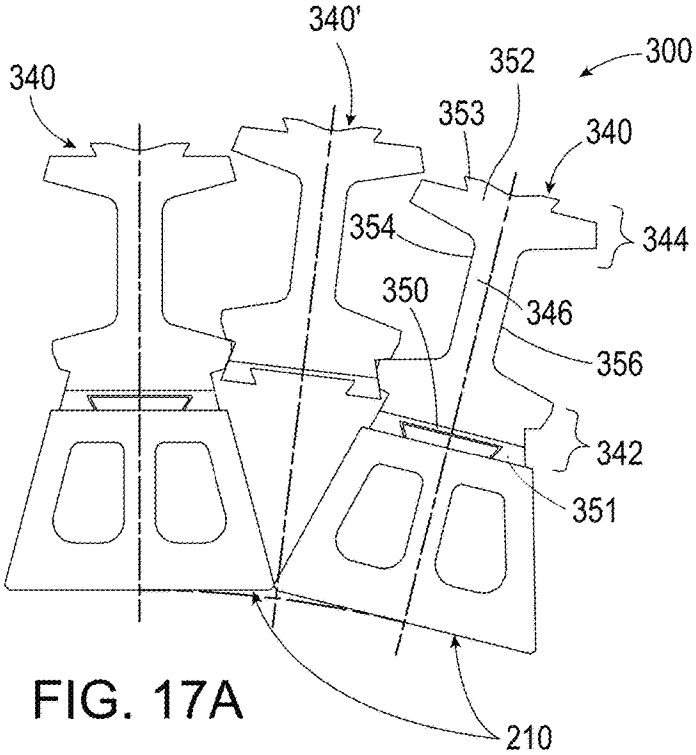
Figure 17C:
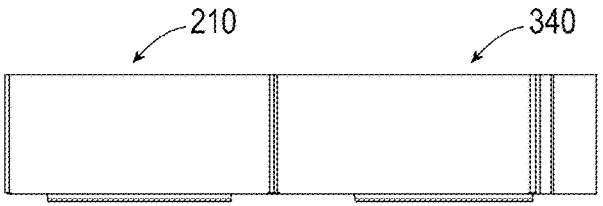

FIGS. 14A-14C depict an example of a pallet layout of wall blocks 210 in accordance with embodiments of the disclosure. FIGS. 14D-14F depict an example of a pallet layout of tail blocks 240 in accordance with embodiments of the disclosure. FIGS. 15A-15J depict various perspective, plan and elevation views of the wall block 210, in accordance with embodiments of the disclosure. FIGS. 16A-16J depict various perspective, plan and elevation views of the tail block 240, in accordance with embodiments of the disclosure.

FIGS. 8A-8D identify detailed elements of the wall blocks 210 and the tail blocks 240 using reference numbers Many of those reference numbers are not repeated in FIGS. 9-16 in the interest of clarity and brevity. One of skill in the art would appreciate that those common elements exist as described with reference to FIGS. 8A-8D.

The wall blocks (or base units) 210 may each have a uniform size and shape, and the tail blocks (tail units) 240 may each have a uniform size and shape that is different than the size and shape of the wall blocks 210. In some examples, the wall blocks 210 and the tail blocks 240 may have a same, as installed, vertical height H. In some examples, a length of the tail blocks 240 may be greater than a length of the wall blocks 210. The wall blocks 210 and the tail blocks 240 may be made of a rugged, weather resistant material, such as pre-cast concrete (e.g., dry cast or wet cast). Other suitable materials are plastic, reinforced fibers, wood, metal and stone.

In some examples, the wall block 210 may include two openings 218 formed between a front portion 212 having the front side 220 and a rear portion 214 having the rear side 222, with opposing neck portions 216 and a middle neck portion 216 extending between the front portion 212 and the rear side (or portion) 222 on opposing sides of the opening 218. The outer surfaces of the opposing neck portions 216 may form sides 224 and 226 of the wall block 210. A top and bottom of the wall block 210 may include a flat surface to facilitate stacking of other wall blocks on top of one another.

Figure 9B:
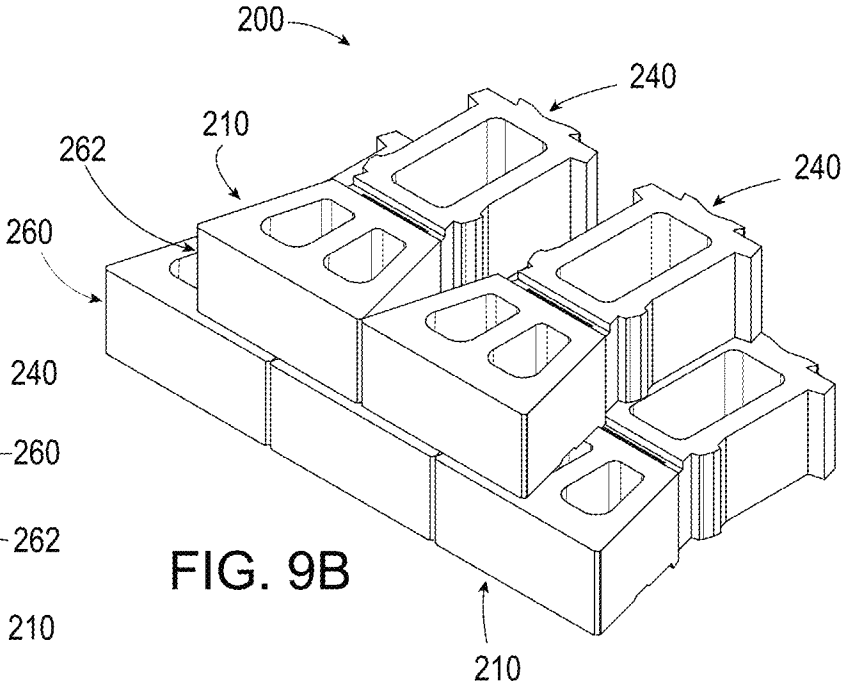
Figure 9D:
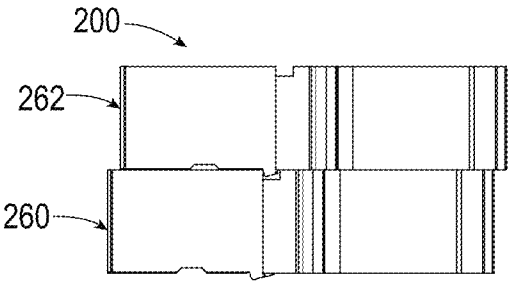
Figure 9A:
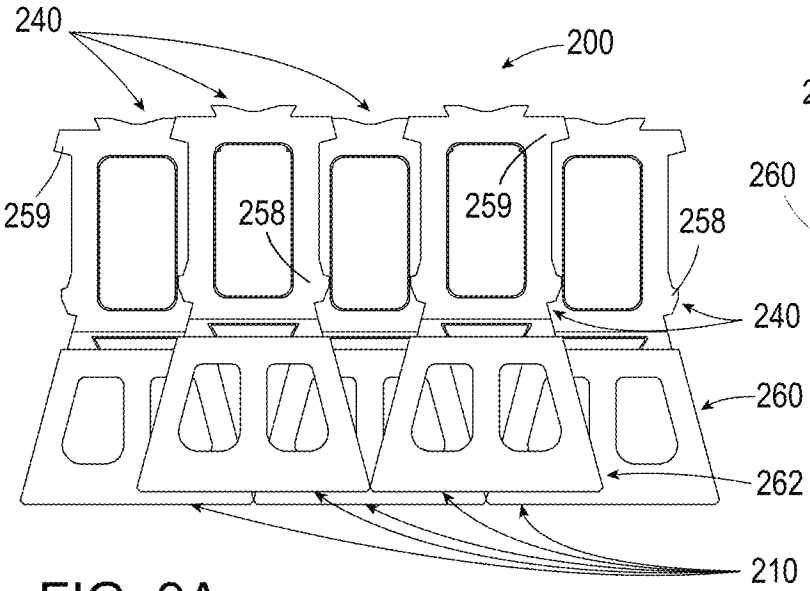
Figure 9C:
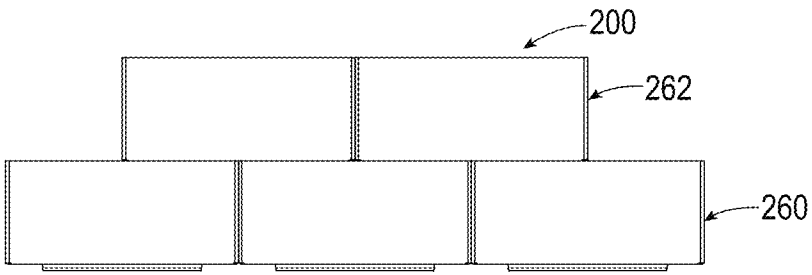
Figure 10A:
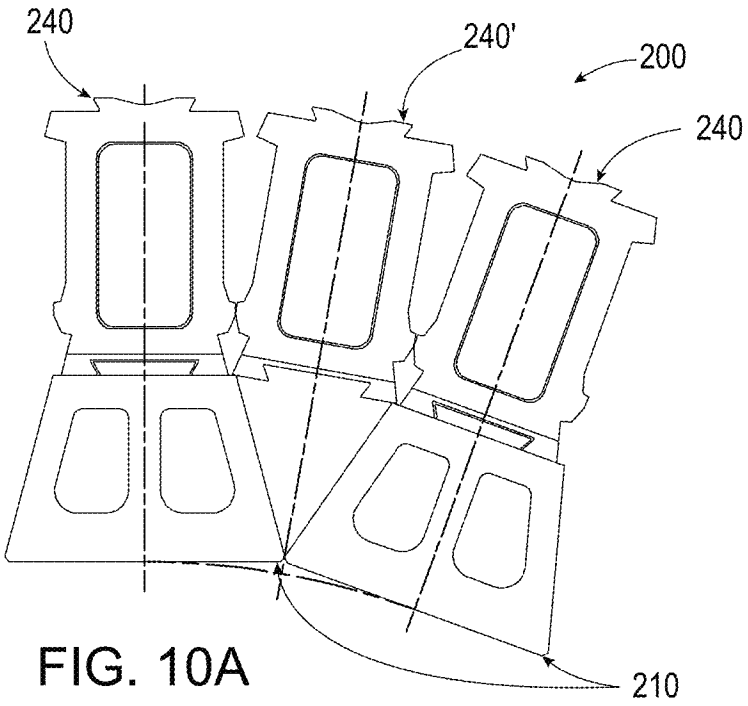
Figure 10B:
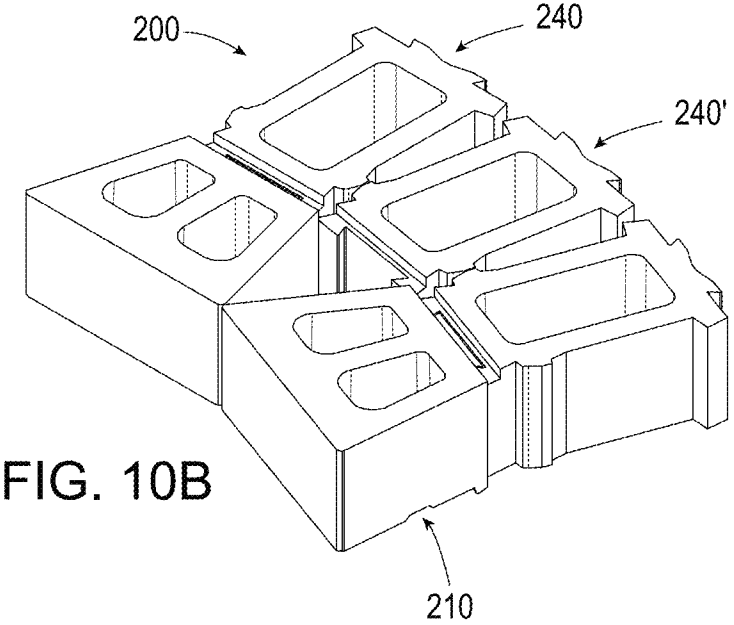
Figure 10C:
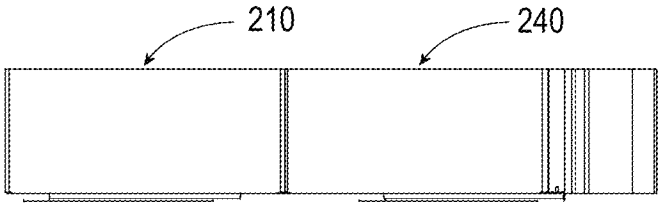
Figure 10D:
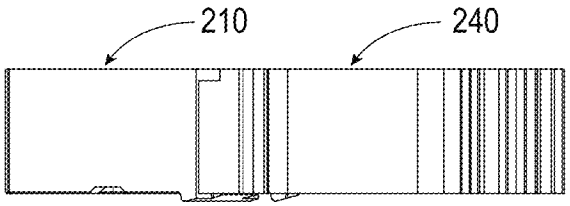
Figure 12B:
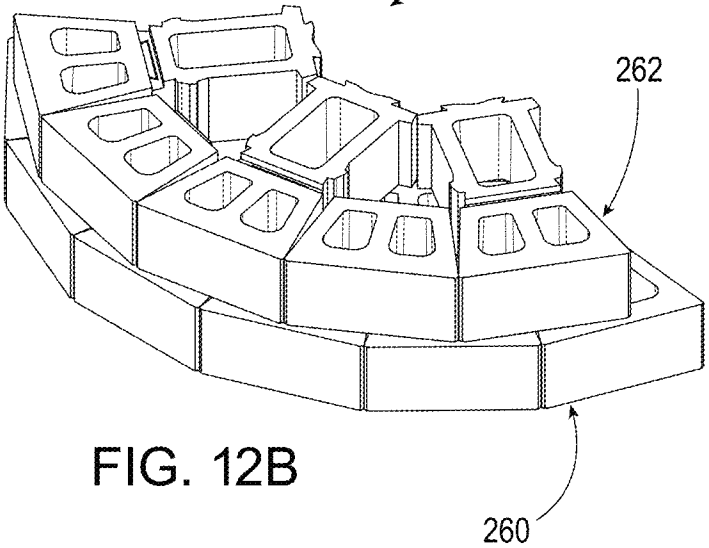
Figure 12A:
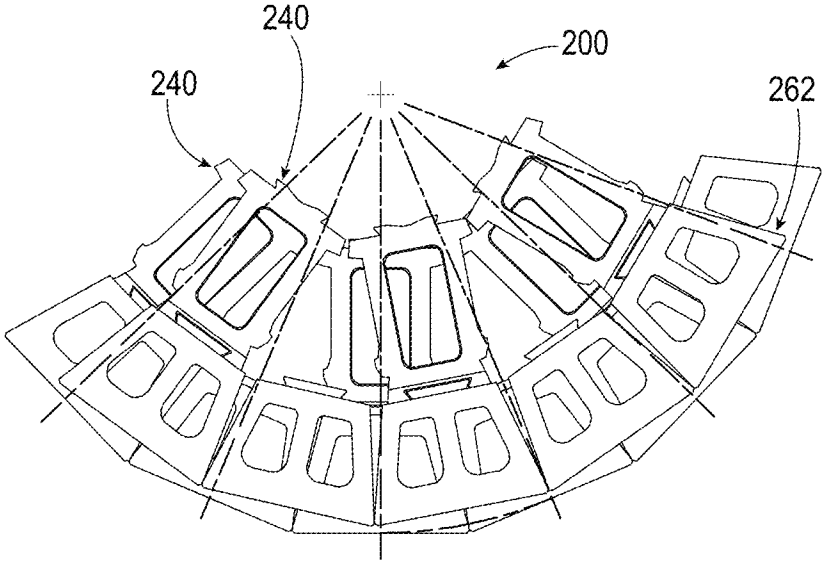
Figure 12C:
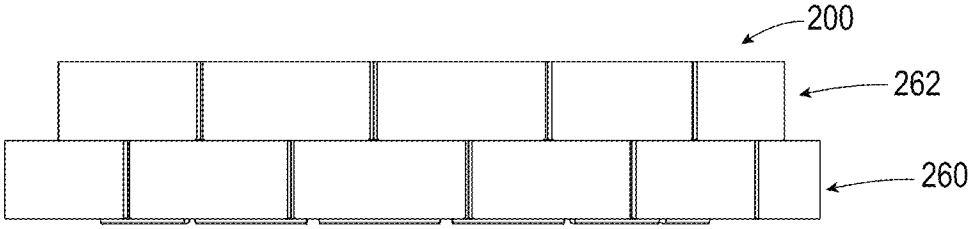
Figure 13B:
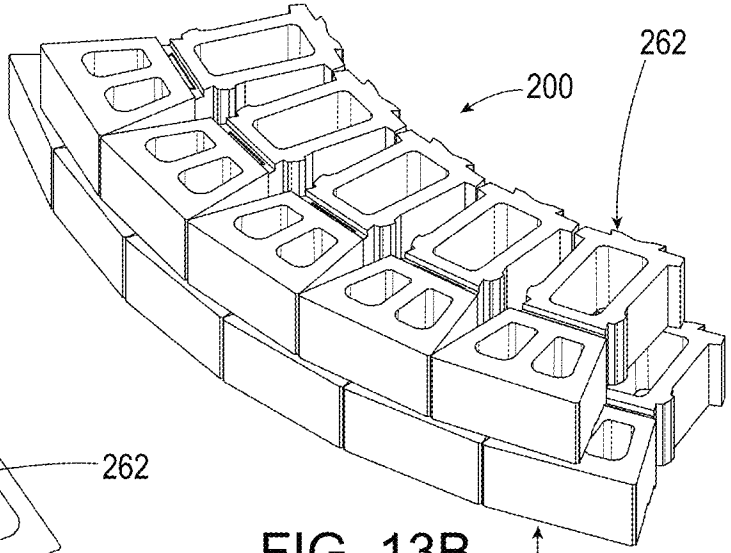
Figure 13A:
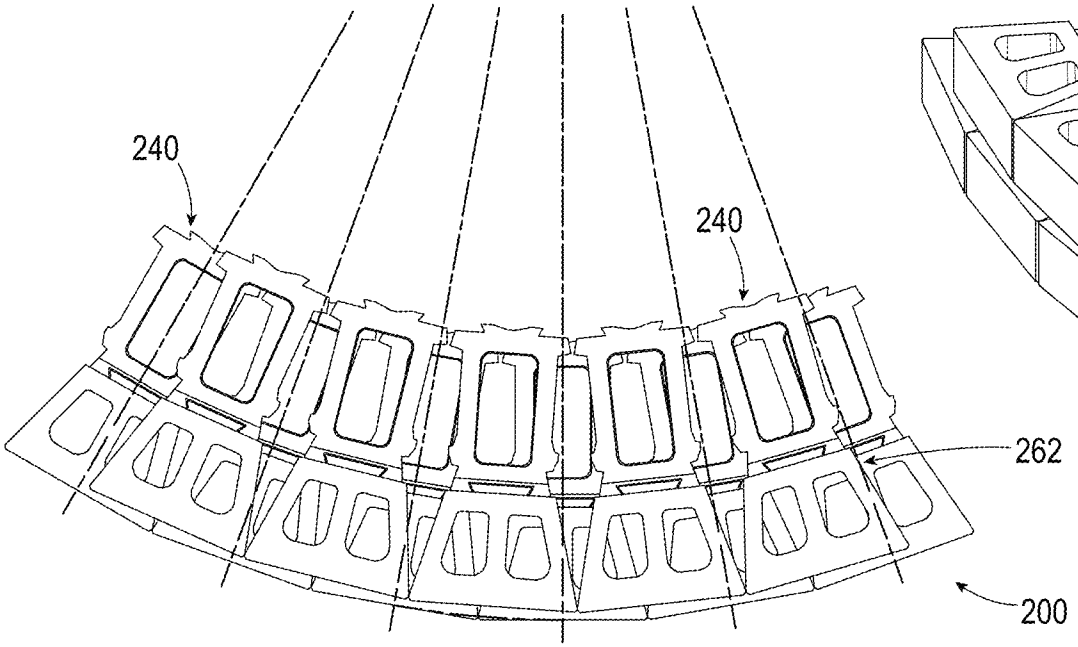
Figure 13C:
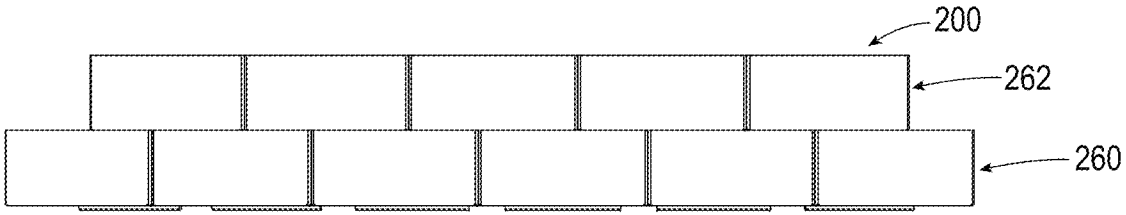

The tail block 240 may include a front portion 242 having a first (front) end 250 configured to connect to the wall block 210 and a rear portion 244 having a second opposing end 252, with the front portion 242 and the rear portion 244 being connected via one or more neck portions 246. In some examples, the front portion 242 and the rear portion 244 may include wing portions that are configured to interlock with and/or contact adjacent tail blocks. For example, the front wings 258 of an upper tail block 240 can be supported on the front wings 258 and body of a lower tail block 240, and the rear wings 259 of the upper tail block 240 can be supported on the rear wings 259 of the lower tail block 240, as shown in FIG. 9A.

In some examples, the tail block 240 may include two opposing neck portions 246 that form an opening 248 between the front portion 242 and the rear portion 244. The outer surfaces of the opposing neck portions 246 may form sides 254 and 256 of the tail block 240. A top and bottom of the tail block 240 may include a flat surface to facilitate stacking of other tail blocks 240 on top of one another.

In some examples, the opposing neck portions 246 of the tail block 240 may have a parallel relationship from the front portion 242 to the rear portion 244 (e.g., the first distance between the opposing neck portions 246 at the front portion 242 is equal to the second distance between the opposing neck portions 246 at the rear portion 244).

In some examples, the front portion 242 of the tail blocks 240 may connect to the wall blocks 210 (or to another tail block 240) using a connection system 223 and 251 formed in the wall block 210 and the tail block 240, respectively. For example, the tail block 240 may connect to the wall block 210 (or to another tail block 240) using a vertical (e.g., extending from an as-installed, top side to a bottom side of the wall block 210) dovetail connection (e.g., using connectors 223 and 251).

In some examples, the wall block 210 (and the second end of the tail block 240) may include the male dovetail connection 223 protruding from the rear side 222 of the wall block 210 and the tail block 240 may include a female dovetail connection 251 formed in the first end 250 of the tail block 240. The dovetail connection (using connectors 223 and 251) between the tail block 240 and the wall block 210 (or connector 253 and connector 251 on another tail block 240) may extend an entire height of the rear side 222 of the wall block 210 (or the second side 252 of the tail block 240). In some examples, male dovetail connection 223 on the wall block 210 may extend more than half of the width of the rear side 222 of the wall block 210.

As previously described, the second end 252 of the rear portion 244 of the tail blocks 240 may be configured with a connector 253 to attach to the connector 251 of another tail block 240 such that multiple tail blocks 240 can be attached together in a chain-like manner. While the connection shown in FIGS. 8-16 includes a dovetail connection, other types of connections may be used, such as a rounded connection or additional slotted connections where a connector is slid into slots formed in each of the wall block 210 and the tail block 240.

As shown in FIGS. 9-13, different courses or layers 260, 262 of a segmented wall 200 may include linear shapes, non-linear shapes, or combinations thereof formed using the wall blocks 210 and the tail blocks 240 in accordance with embodiments of the disclosure. In FIGS. 9A-9D, a portion of a straight/linear segmented wall 200 with two courses 260, 262 is shown. In some examples, the straight/linear shape of the segmented wall 200 may cause a neck portion of a tail block 240 of the course or layer 262 to at least partially overlap in a vertical direction with a neck portion of a tail block 240 of the course or layer 260 to form a column of vertically supported neck portions.

FIGS. 10A-10D and 11A-11D depict a portion of a curved (e.g., concave) segmented wall 200, with part of two courses 260, 262 shown in FIGS. 11A-11D. The courses or layers 260, 262 may include at least one respective tail block 240 attached to (e.g., interlocked with) with a rear side of one or more of the respective set of wall blocks 210.

The curvature of the wall 200 in FIGS. 10A-10D and 11A-11D may be uniform and have a radius and an angle of A degrees from a center of a wall block 210 to a space between the wall blocks 210, and an angle of 2 times A degrees between the centers of the wall blocks 210. With the angle between the centers of the wall blocks 210 being at least A degrees, an additional tail block 240' not connected to any wall blocks 210 may be interleaved between tail blocks 240 attached to the wall blocks 210 to provide lateral support between the tail blocks 240.

The interleaved tail block 240' may provide vertical support for the tail block 240 placed on top in the course or layer 262. In some examples, A degrees is based on a width of the wall blocks 210. In some examples, A degrees is between and including 8 and 20 degrees.

FIGS. 12A-12C and 13A-13C depict portion of curved (e.g., convex) segmented walls 200 with part of two courses 260, 262. The courses or layers 260, 262 may include at least one respective tail block 240 attached to (e.g., interlocked with) with a rear side of one or more of the respective set of wall blocks 210.

The curvature of the walls 200 in FIGS. 12A-12C and 13A-13C may be uniform, each having a respective radius and a respective angle of B (FIGS. 12A-12C) or A (FIGS. 13A-13C) degrees between opposing edges of a wall block 210. With the angle of B degrees, only every other wall block 210 is attached to a tail block 240 and the rear portions line up to provide support of the upper course or layer 262 of wall blocks by the lower course or layer 260 of wall block 210*s*. With the angle of not more than A degrees, a neck portion of a tail block 240 of the course or layer 262 to at least partially overlap in a vertical direction with a neck portion of a tail block 240 of the course or layer 260 to form a column of vertically supported neck portions.

The stacking of the tail blocks 240 may add additional stability to the segmented wall 200 by adding additional interlocking structure between two adjacent courses or layer 260, 262. As the tail blocks 240 are covered with fill material, the interlocking between courses or layers 260, 262 may be further strengthened.

In some examples, the wall system may further include use of reinforced earth techniques such as geogrid reinforcement, geosynthetic reinforcement, or the use of inextensible materials such as steel matrices. After placement of a course or layer of the wall, a geogrid material may be placed over the course or layer before placement of a next course or layer. The weight of the upper course or layer on the geogrid material sandwiched between two layers may hold the geogrid material in place.

In some examples, additional pins, stakes, or other connectors in the wall block 210, the tail block 240, or the fill material may be used to penetrate the apertures of the geogrid material to further hold it in place. The use of the geogrid material may form a lateral interlocking connection between wall blocks and tail blocks of a course or layer, which may further fortify the segmented wall 200.

The segmented walls 200 depicted in FIGS. 8-16 are exemplary. Thus, while FIGS. 8-16 depict the segmented walls 200 with not more than two courses or layers 260, 262; it is appreciated that the segmented walls 200 may include more or fewer than two courses or layers. It is also appreciated that the segmented walls 200 may include more or fewer than a number of wall blocks 210 and tail blocks 240 in each course or layer than depicted. It is also appreciated that a segmented wall 200 may be constructed in a different shape than depicted without departing from the scope of the disclosure. Finally, it is appreciated that some courses or layers of the segmented wall 200 may include no tail blocks 240, a single row of tail blocks 240, or more than two rows of wall blocks without departing from the scope of the disclosure.

FIGS. 17-24 depict third embodiments of a segmented wall system 300 with tail blocks 340, in accordance with the present disclosure. The segmented wall systems 300 of FIGS. 17-24 may be formed using a combination of wall blocks 210 and tail blocks 340.

FIGS. 17A-17D depict examples of various top plan, perspective, and front and side elevation views of part of a course or layer of wall blocks 210 connected to tail blocks 340, with an additional tail block 340' between the two tail blocks 340, in accordance with embodiments of the disclosure. FIGS. 18-22 depict different segmented wall shapes with various arrangements of the wall blocks 210 and tail blocks 340, in accordance with embodiments of the disclosure.

Figure 23B:
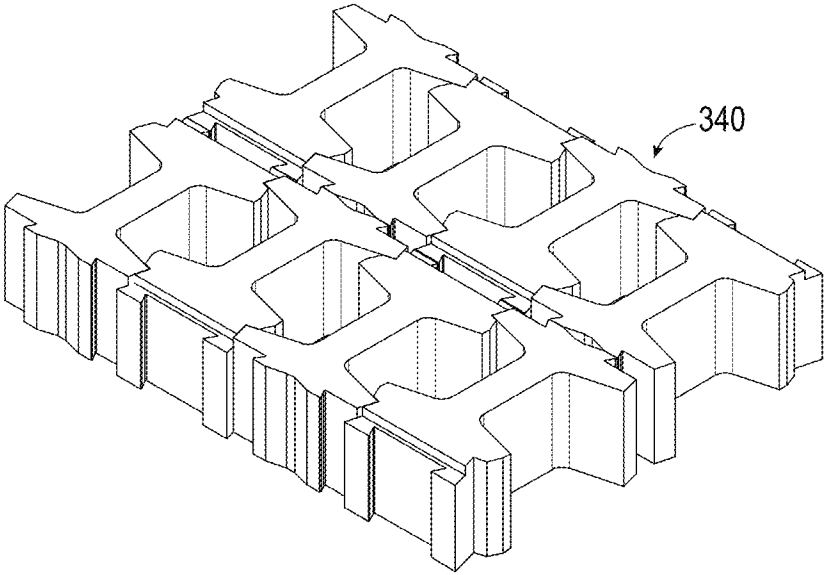
Figure 23C:
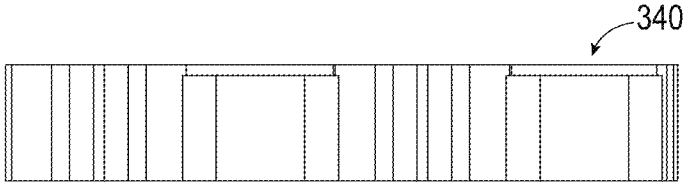
Figure 23A:
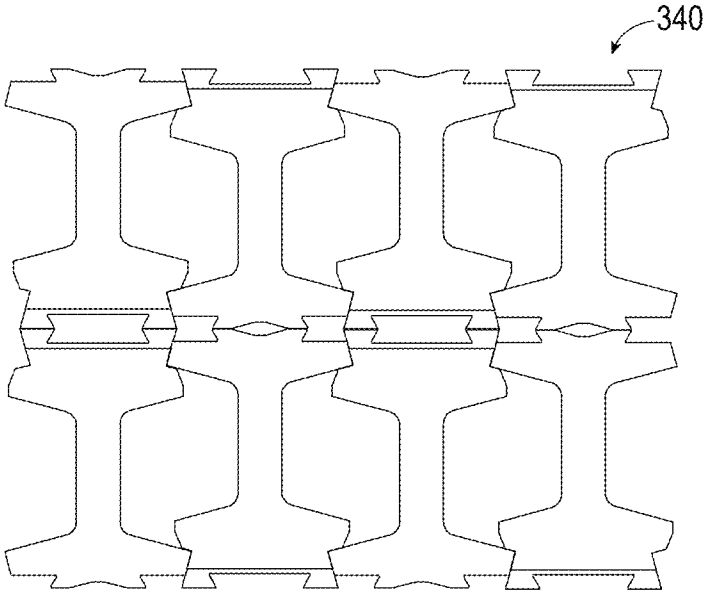
Figure 24A:
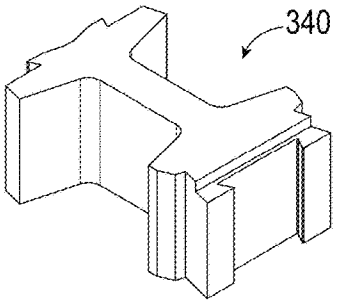
Figure 24B:
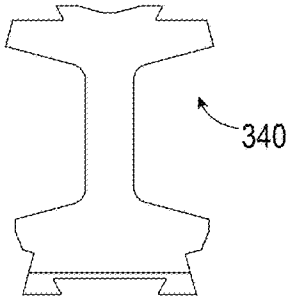
Figure 24C:
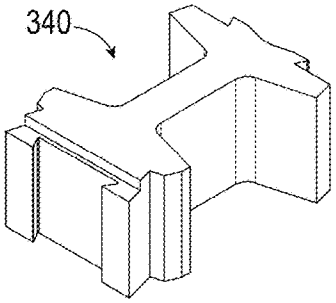
Figure 24D:
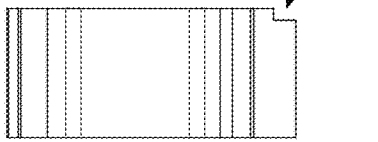
Figure 24E:
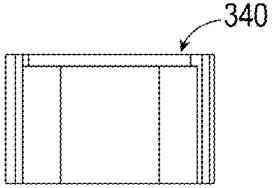
Figure 24F:
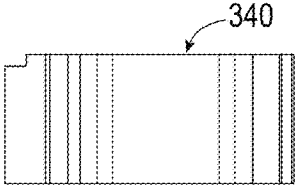
Figure 24G:
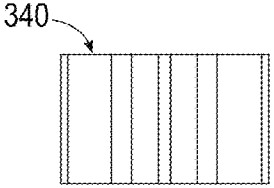
Figure 24H:
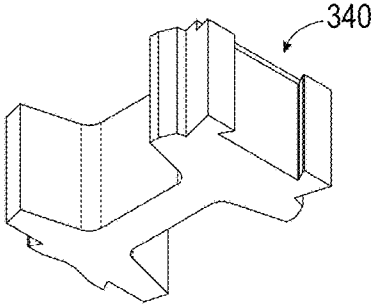
Figure 24I:
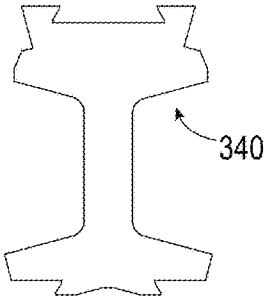
Figure 24J:
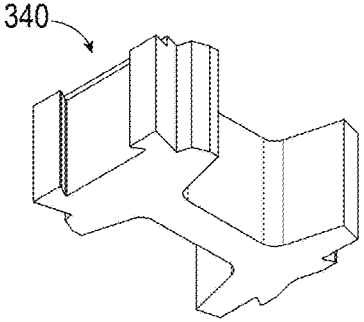
Figure 25B:
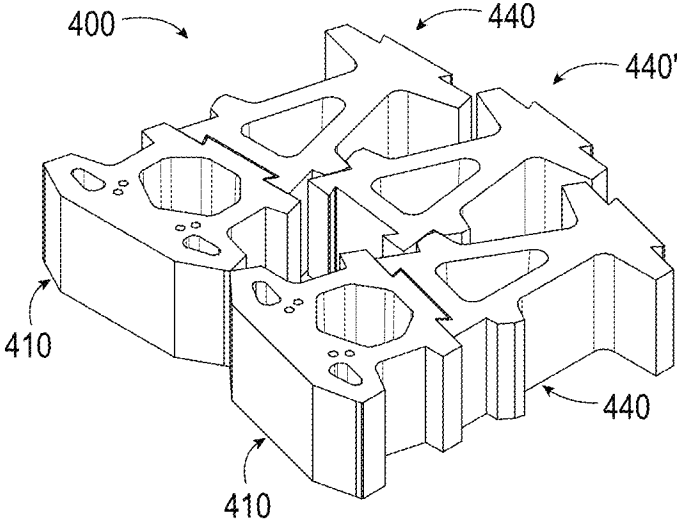
Figure 25D:
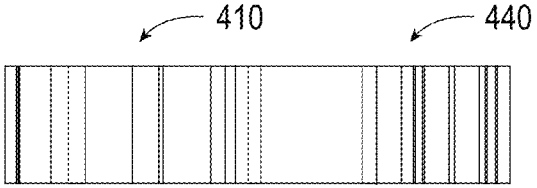
Figure 25A:
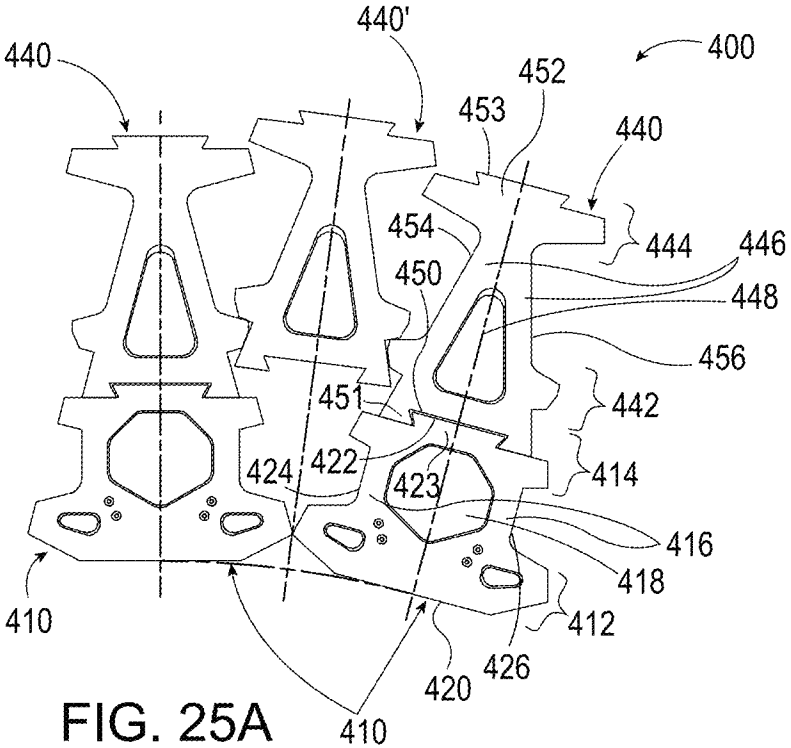
Figure 25C:
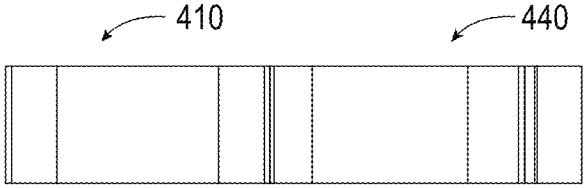

FIGS. 23A-23C depict an example of a pallet layout of tail blocks 340 in accordance with embodiments of the disclosure. FIGS. 24A-24J depict various perspective, plan and elevation views of the tail block 340, in accordance with embodiments of the disclosure.

FIGS. 17-24 may include elements that have been previously described with respect to FIGS. 8-16. Those elements have been identified in FIGS. 17-24 using the same reference numbers used in FIGS. 8-16 and operation of the common elements is as previously described. Consequently, a detailed description of the operation of these particular elements will not be repeated in the interest of brevity.

FIGS. 17A-17D identify detailed elements of the tail blocks 340 using reference numbers. Many of those reference numbers are not repeated in FIGS. 18-24 in the interest of clarity and brevity. One of skill in the art would appreciate that those common elements exist as described with reference to FIGS. 17A-17D.

Figure 18B:
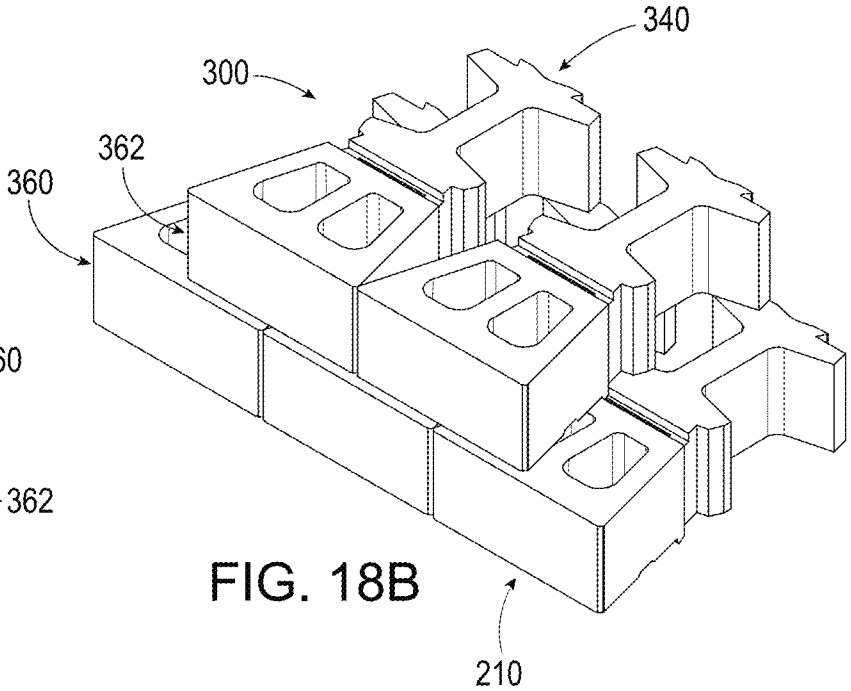
Figure 18A:
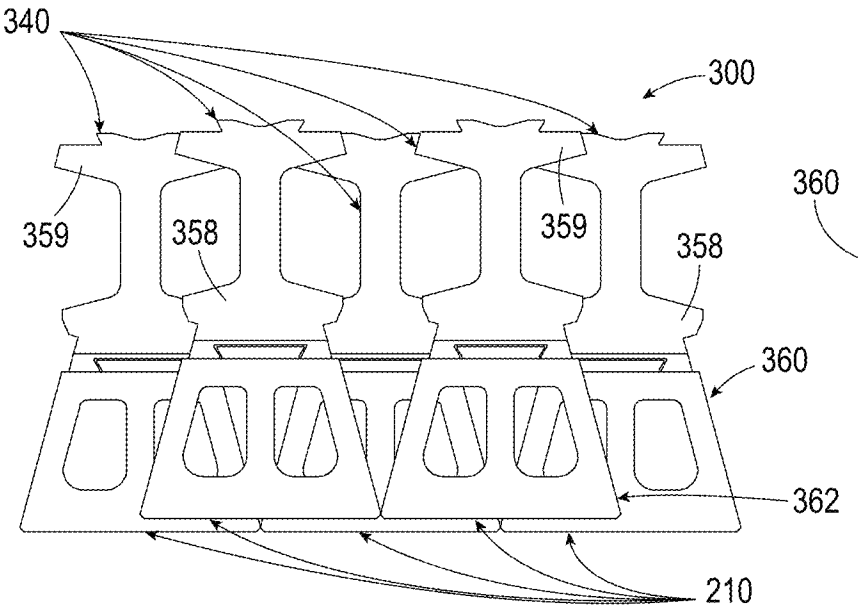
Figure 18D:
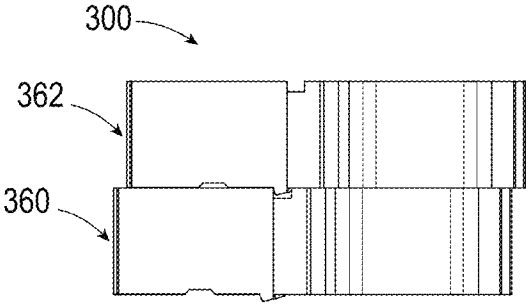
Figure 18C:
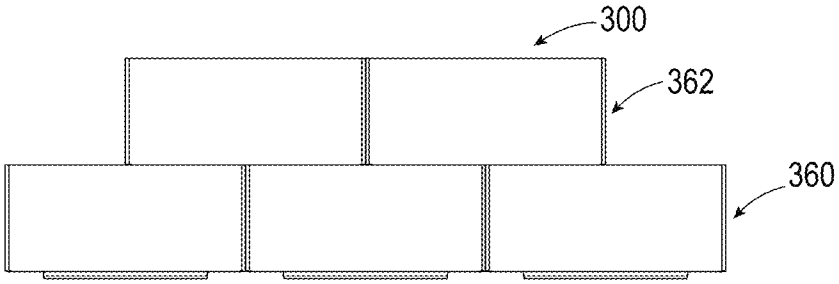
Figure 19B:
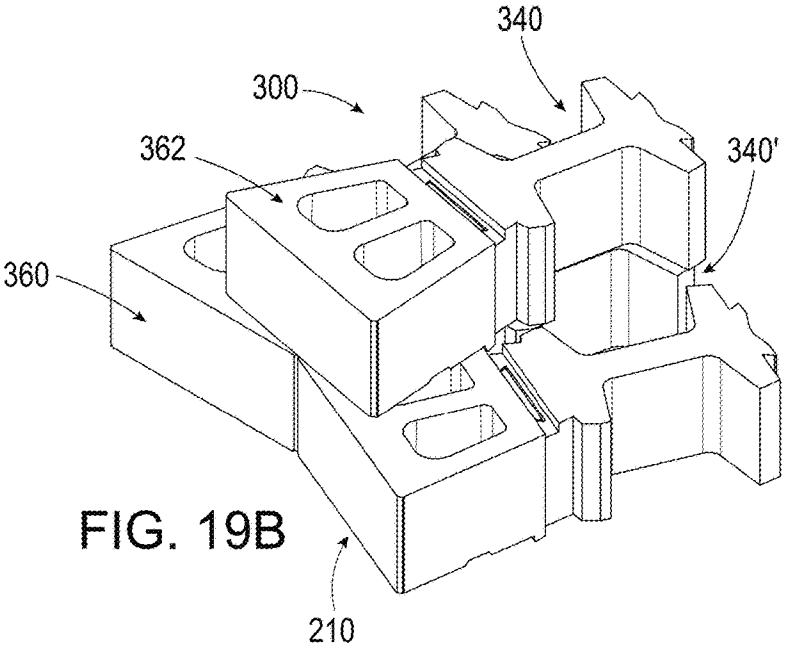
Figure 19D:
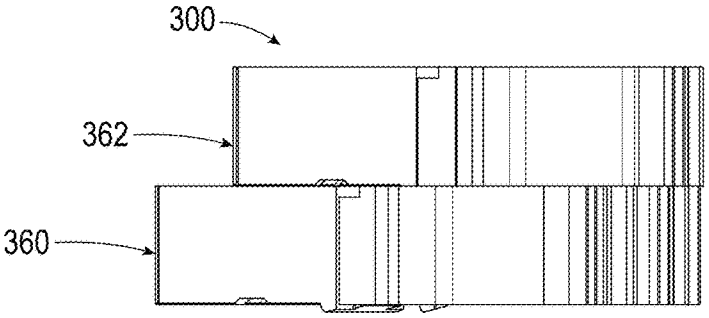
Figure 19A:
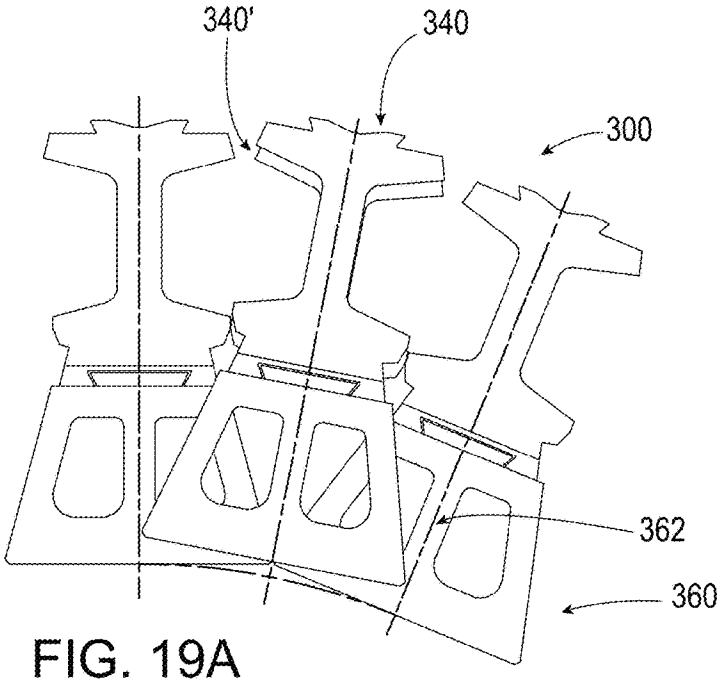
Figure 19C:
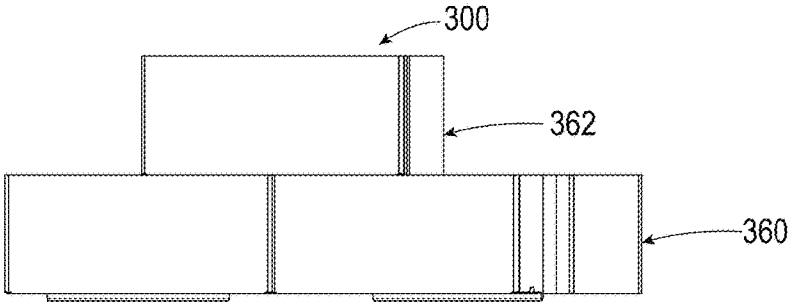
Figure 20B:
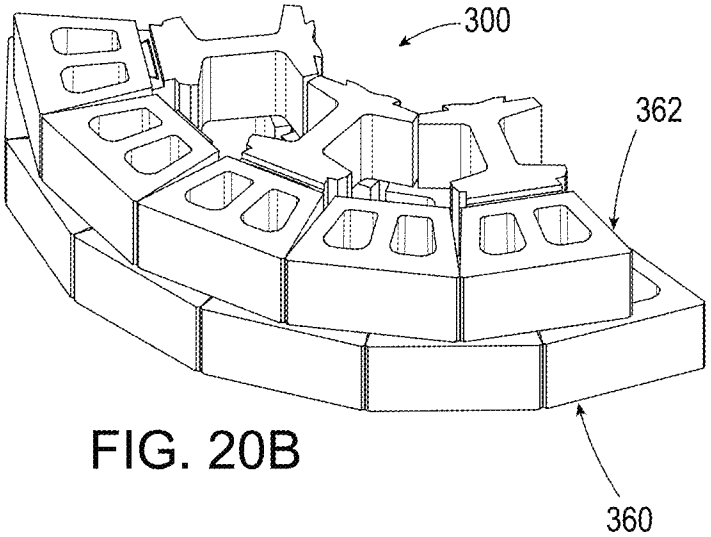
Figure 20A:
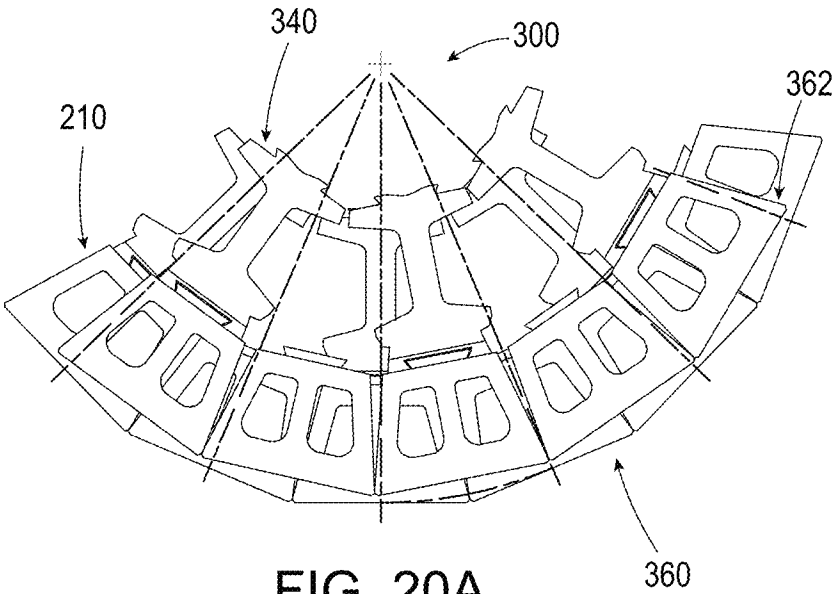
Figure 20C:
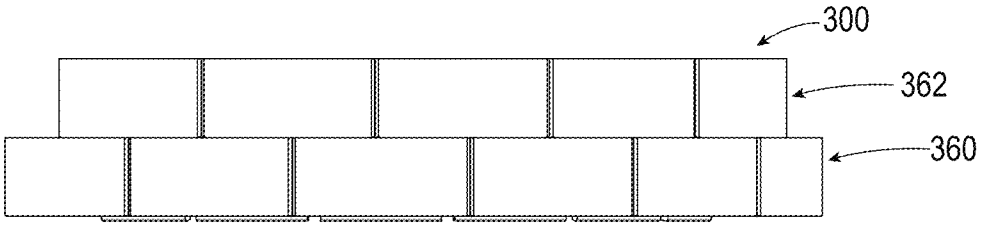
Figure 21B:
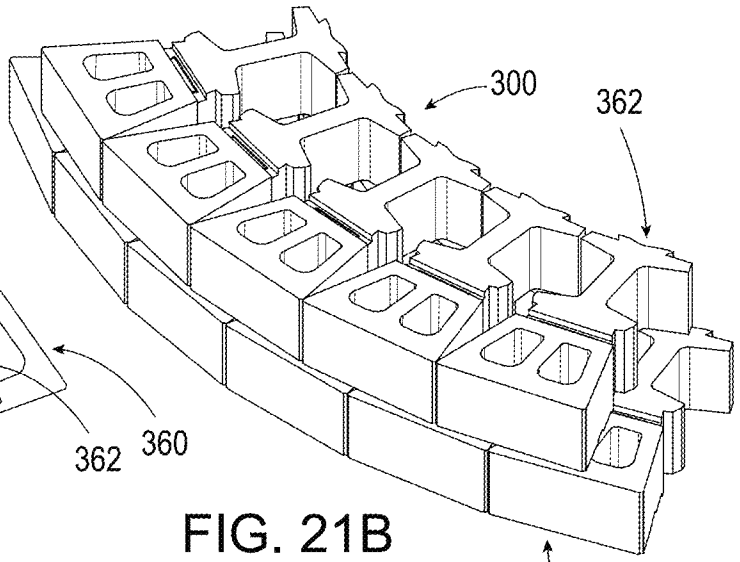
Figure 21A:
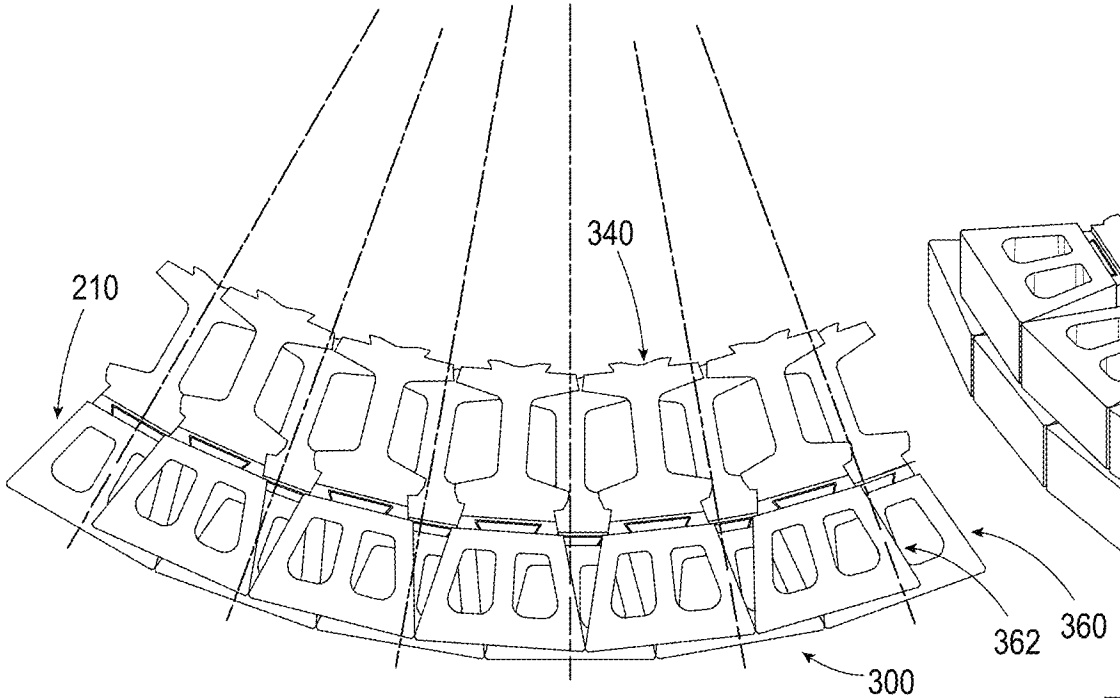
Figure 21C:
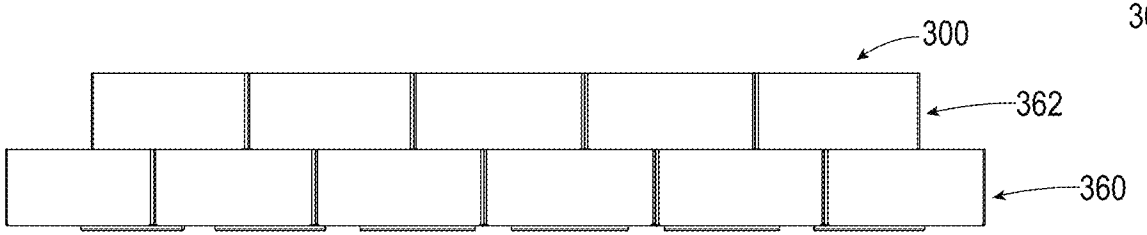

The tail block (or tail unit) 340 may include a front portion 342 having a first end 350 configured to connect to the wall block 210 and a rear portion 344 having a second opposing end 352, with the front portion 342 and the rear portion 344 being connected via one or more neck portions 346. In some examples, the front portion 342 and the rear portion 344 may include wing portions that are configured to interlock with and/or contact adjacent tail blocks. For example, the front wings 358 of an upper tail block 340 can be supported on the front wings 358 and body of a lower tail block 340, and the rear wings 359 of the upper tail block 340 can be supported on the rear wings 359 of the lower tail block 340, as shown in FIG. 18A.

In some examples, the tail block 340 may include a single neck portion 346 between the front portion 342 and the rear portion 344, which may be narrower in a middle portion and may flare out near where the neck portion 346 connects to both the front portion 342 and the rear portion 344. The outer surfaces of the neck portion 346 may form sides 354 and 356 of the tail block 340. A top and bottom of the tail block 340 may include a flat surface to facilitate stacking of other tail blocks 340 on top of one another.

In some examples, the front portion 342 of the tail blocks 340 may connect to the wall blocks 210 (or to another tail block 340) using a connection system 223 and 351 formed in the wall block 210 and the tail block 340, respectively. For example, the tail block 340 may connect to the wall block 210 (or to another tail block 340) using a vertical (e.g., extending from an as-installed, top side to a bottom side of the wall block 210) dovetail connection (e.g., using connectors 223 and 351).

In some examples, the wall block 210 (and the second end of the tail block 340) may include the male dovetail connection 223 protruding from the rear side 222 of the wall block 210 and the tail block 340 may include a female dovetail connection 351 formed in the first end 350 of the tail block 340. The dovetail connection (using connectors 223 and 351) between the tail block 340 and the wall block 210 (or connector 353 and connector 351 on another tail block 340) may extend an entire height of the rear side 222 of the wall block 210 (or the second end 352 of the tail block 340). In some examples, male dovetail connection 223 on the wall block 210 may extend more than half of the width of the rear side 222 of the wall block 210.

As previously described, the second end 352 of the rear portion 344 of the tail blocks 340 may be configured to attach to another tail block 340 such that multiple tail blocks 340 could be attached together in a chain-like manner. While the connection shown in FIGS. 17-24 includes a dovetail connection, other types of connections may be used, such as a rounded connection or additional slotted connections where a connector is slid into slots formed in each of the wall block 210 and the tail block 340.

As shown in FIGS. 18-22, different courses or layers 360, 362 of a segmented wall may include linear shapes, non-linear shapes, or combinations thereof formed using the wall blocks 210 and the tail blocks 340 in accordance with embodiments of the disclosure. In FIGS. 18A-18D, a portion of a straight/linear segmented wall with two courses 360, 362 is shown. In some examples, the straight/linear shape of the segmented wall 100 may cause the front and rear portions of a tail block 340 of the course or layer 362 to at least partially overlap with the front and rear portions, respectively, of adjacent tail blocks 340 of the course or layer 360 to form a column of vertically-supported rear portions.

FIGS. 19A-19D depict a portion of a curved (e.g., concave) segmented wall with part of two courses 360, 362. The courses or layers 360, 362 may include at least one respective tail block 340 attached to (e.g., interlocked with) with a rear side of one or more of the respective set of wall blocks 210.

The curvature of the wall 300 in FIGS. 19A-19D may be uniform and have a radius and an angle of A degrees from a center of a wall block 210 to a space between the wall blocks 210, and an angle of 2 times A degrees between the centers of the wall blocks 210. With the angle between the centers of the wall blocks 210 being at least A degrees, an additional tail block 340' not connected to any wall blocks 210 may be interleaved between tail blocks 340 attached to the wall blocks 210 to provide lateral support between the tail blocks 340.

The interleaved tail block 340' may provide vertical support for the tail block 340 placed on top in the course or layer 362. In some examples, A degrees is based on a width of the wall blocks 210. In some examples, A degrees is between and including 8 and 20 degrees.

FIGS. 20A-20C and 21A-21C depict a portions of curved (e.g., convex) segmented walls, with part of two courses 360, 362. The courses or layers 360, 362 may include at least one respective tail block 340 attached to (e.g., interlocked with) with a rear side of one or more of the respective set of wall blocks 210.

The curvature of the walls 300 in FIGS. 20A-20C and 21A-21C may be uniform, each having a respective radius and a respective angle of B (FIGS. 20A-20C) or A (FIGS. 21A-21C) degrees between opposing edges of a wall block 210. With the angle of B degrees, only every other wall block 210 is attached to a tail block 340 and the rear portions line up to provide support of the upper course or layer 362 of wall blocks by the lower course or layer 360 of wall blocks 210. With the angle of not more than A degrees and the rear portions line up to provide support of the upper course or layer 362 of wall blocks by the lower course or layer of wall blocks 360.

Figure 22B:
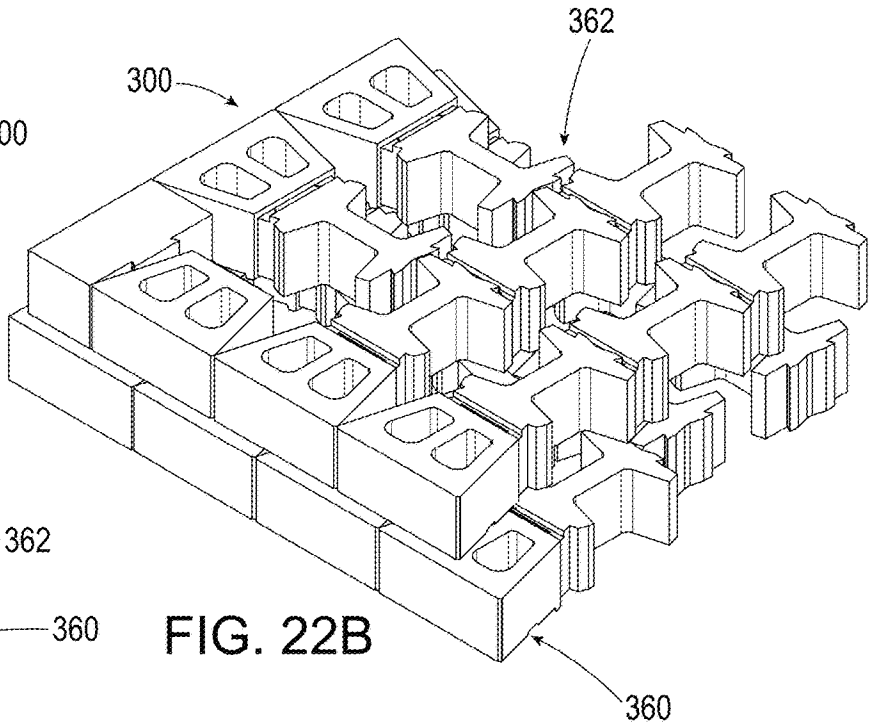
Figure 22A:
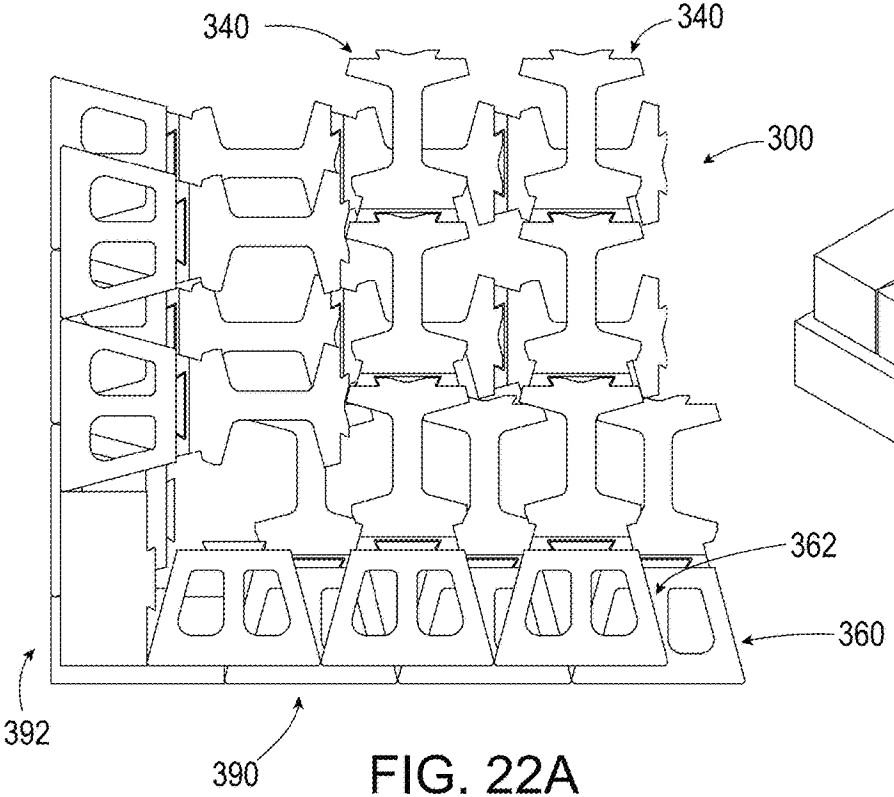
Figure 22C:
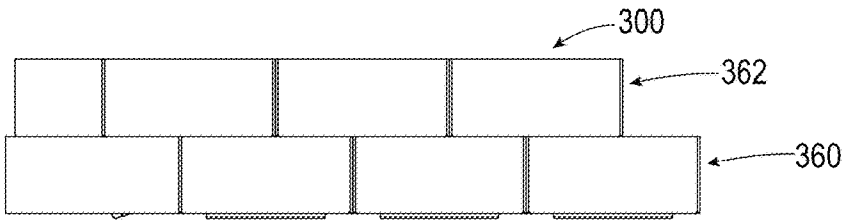

FIGS. 22A-22C depict a portion of a 90-degree corner segmented wall 300 (perpendicular sides 390 and 392), with part of two courses 360, 362. The courses or layers 360, 362 may include at least one respective tail block 340 attached to (e.g., interlocked with) with a rear side of one or more of the respective set of wall blocks 210 in an alternating fashion between the sides 390 and 392 due to a space conflicts that arise in perpendicular wall construction.

For example, starting from the adjoining corner, the first wall block 210 of the side 390 in the first course or layer 360 may be attached to a tail block 340, while the first wall block 210 of the side 392 in the first course or layer 362 may not be attached to a tail block 340. Conversely, starting from the adjoining corner, the first wall block 210 of the side 392 in the second course or layer 362 may be attached to a tail block 340, while the first wall block 210 of the side 390 in the second course or layer 362 may not be attached to a tail block 340.

Similar alternating arrangements between the sides 390 and 392 in the courses or layer 360 and 362 may be implemented for tail blocks 340 further away from the adjoining corner. The stacking of the tail blocks 340 in this way may add additional stability to the segmented wall by adding additional interlocking structure between courses or layers 360, 362 of the different sides 390, 392. As the tail blocks 340 are covered with fill material, the interlocking between courses or layers 360, 362 may be further strengthened.

In some examples, the wall system may further include use of reinforced earth techniques such as geogrid reinforcement, geosynthetic reinforcement, or the use of inextensible materials such as steel matrices. After placement of a course or layer of the wall, a geogrid material may be placed over the course or layer before placement of a next course or layer. The weight of the upper course or layer on the geogrid material sandwiched between two layers may hold the geogrid material in place.

In some examples, additional pins, stakes, or other connectors in the wall block 210, the tail block 340, or the fill material may be used to penetrate the apertures of the geogrid material to further hold it in place. The use of the geogrid material may form a lateral interlocking connection between wall blocks and tail blocks of a course or layer, which may further fortify the segmented wall.

The segmented walls 300 depicted in FIGS. 17-24 are exemplary. Thus, while FIGS. 17-24 depict the segmented walls 300 with not more than two courses or layers 360, 362; it is appreciated that the segmented walls 300 may include more or fewer than two courses or layers. It is also appreciated that the segmented walls 300 may include more or fewer than a number of wall blocks 210 and tail blocks 340 in each course or layer than depicted. It is also appreciated that a segmented wall 300 may be constructed in a different shape than depicted without departing from the scope of the disclosure. Finally, it is appreciated that some courses or layers of the segmented wall 300 may include no tail blocks 340, a single row of tail blocks 340, or more than two rows of wall blocks without departing from the scope of the disclosure.

FIGS. 25-33 depict fourth embodiments of a segmented wall system 400 with tail blocks, in accordance with the present disclosure. The segmented wall system 400 of FIGS. 25-33 may be formed using a combination of wall blocks 410 and tail blocks 440.

FIGS. 25A-25D depict examples of various top plan, perspective, and front and side elevation views of part of a course or layer of wall blocks 410 connected to tail blocks 440, with an additional tail block 440' between the two tail blocks 440, in accordance with embodiments of the disclosure. FIGS. 26A-30 depict different segmented wall shapes with various arrangements of the wall blocks 410 and tail blocks 440, in accordance with embodiments of the disclosure.

Figure 31A:
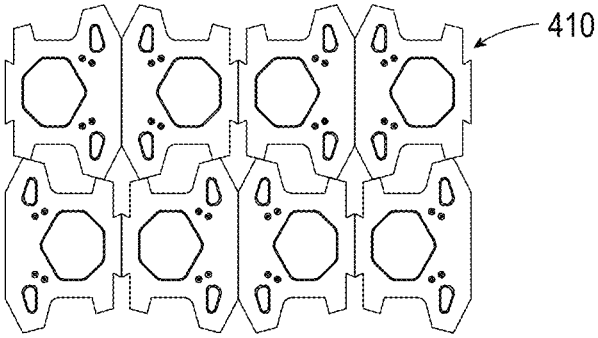
Figure 31C:
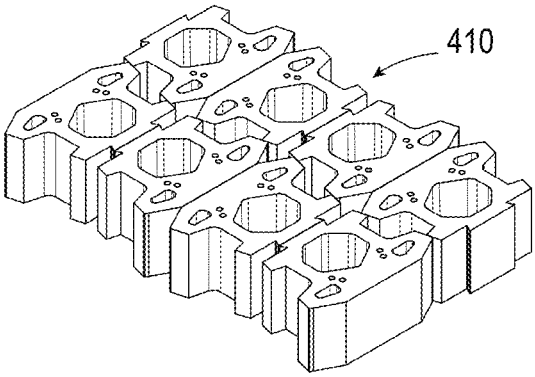
Figure 31B:
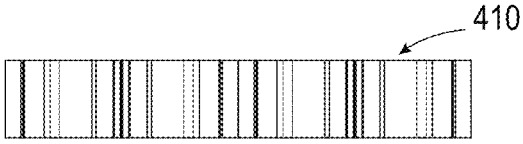
Figure 31D:
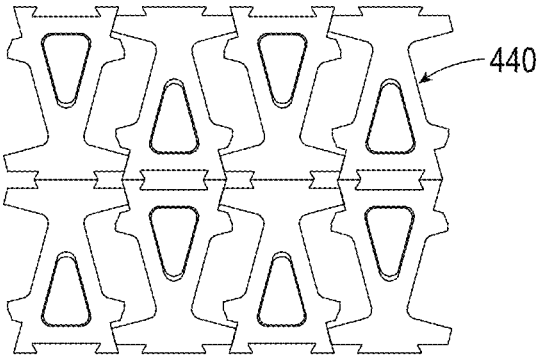
Figure 31F:
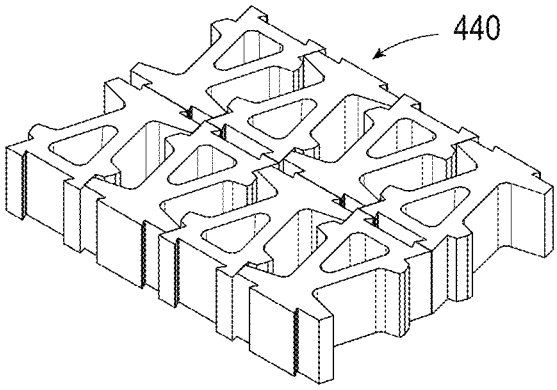
Figure 31E:
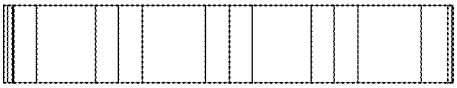
Figure 34B:
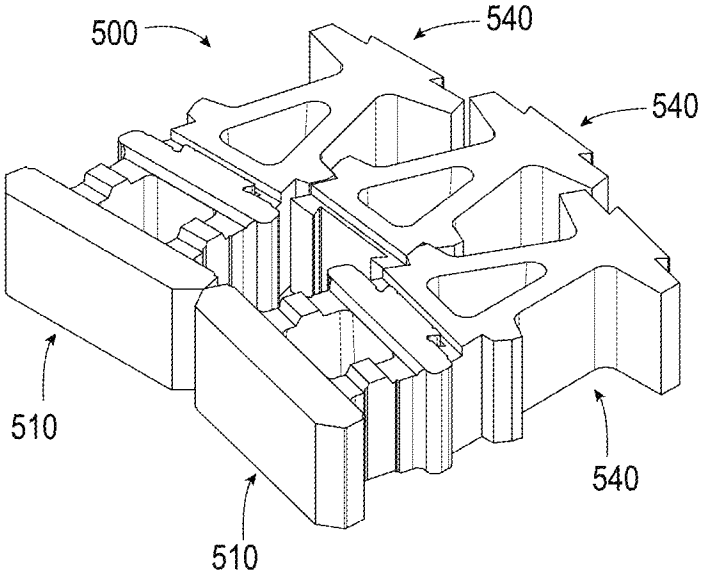
Figure 34D:
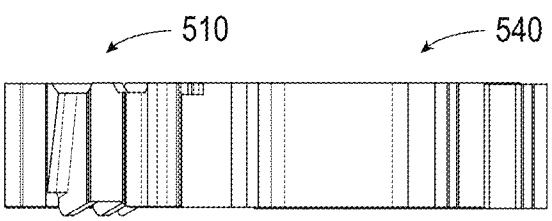
Figure 34A:
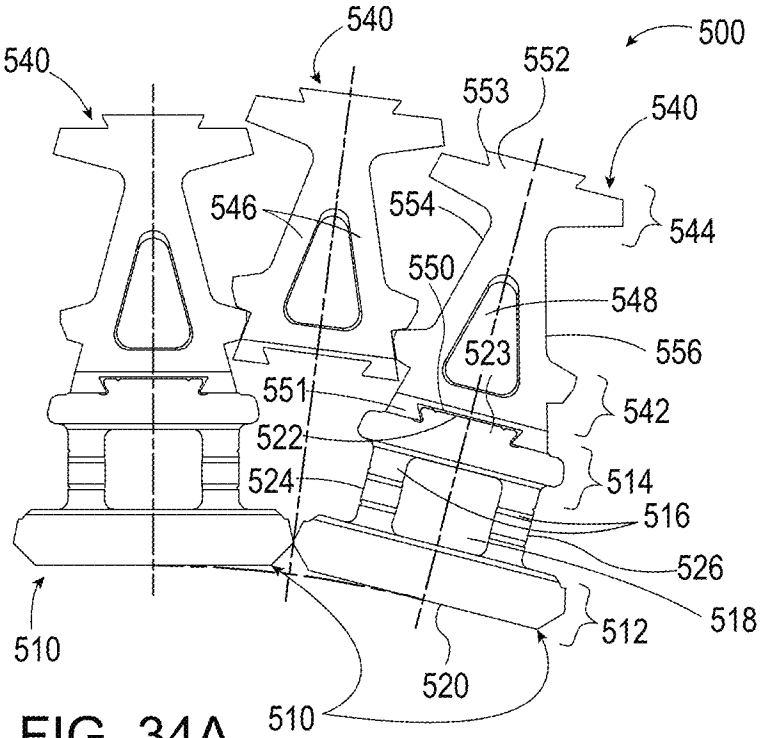
Figure 34C:
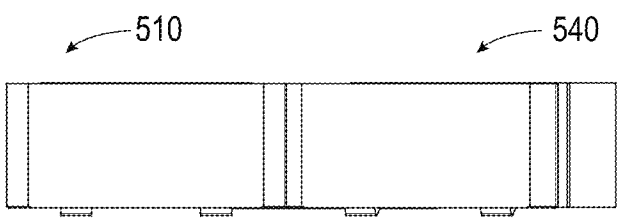
Figure 36A:
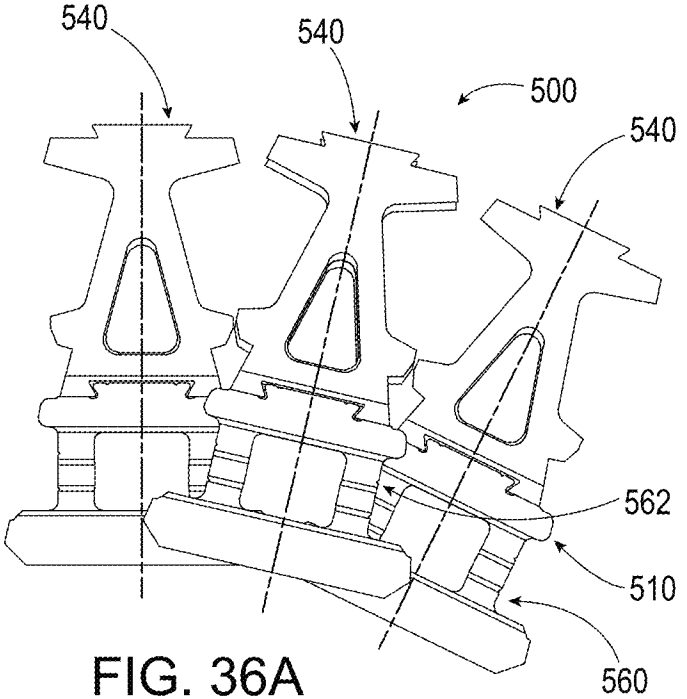
Figure 36B:
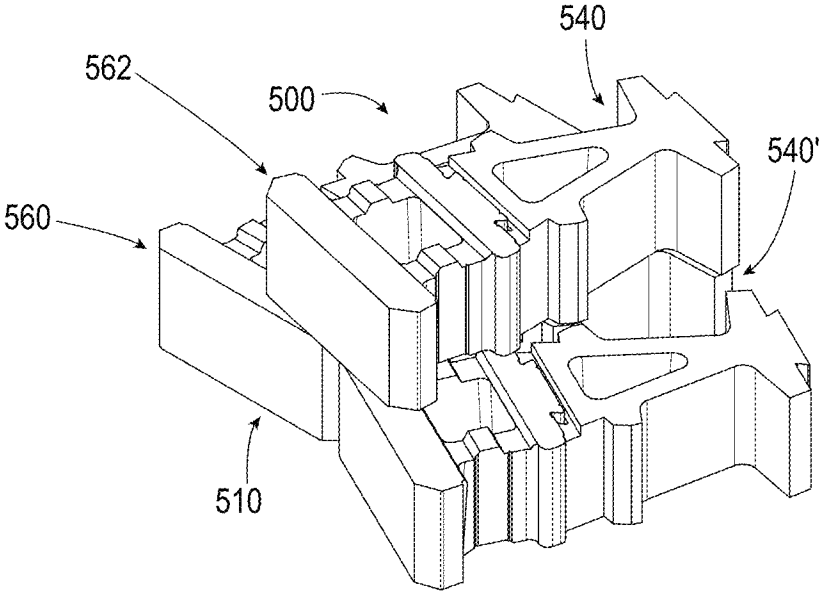
Figure 36C:
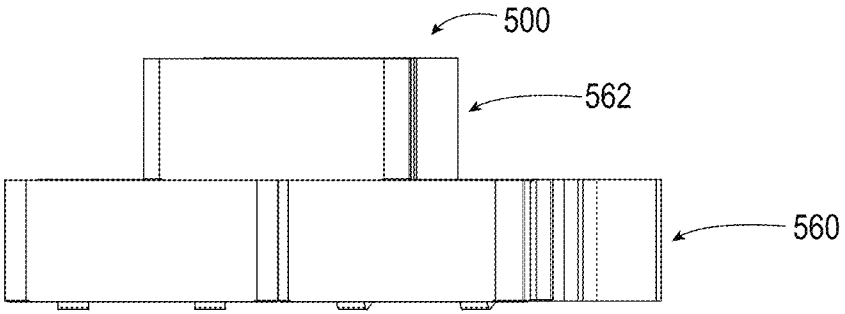
Figure 36D:
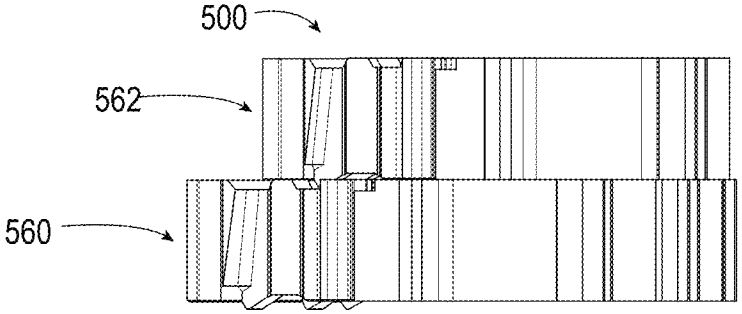
Figure 37B:
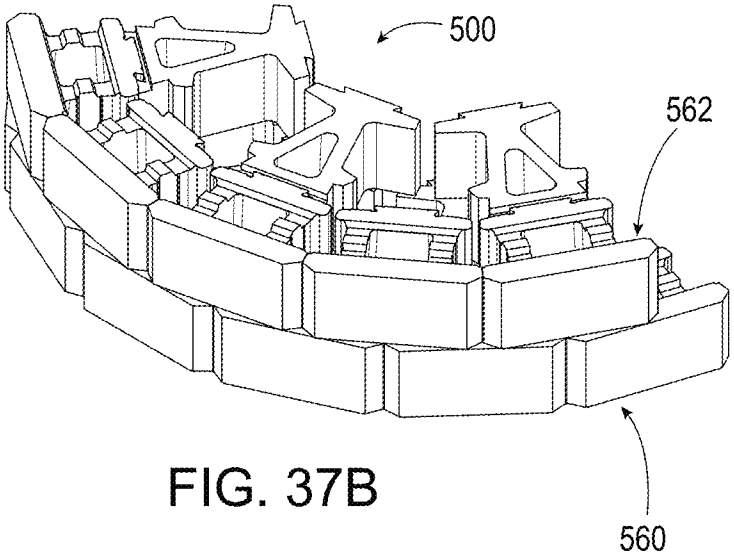
Figure 37A:
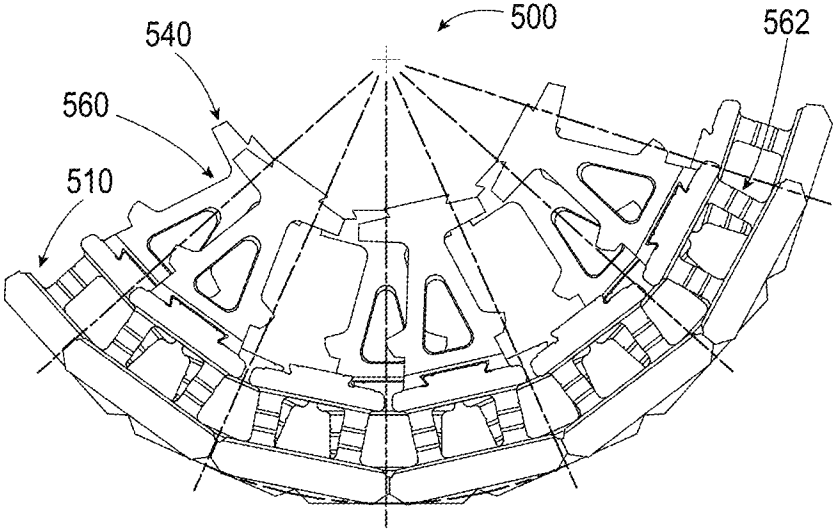
Figure 37C:
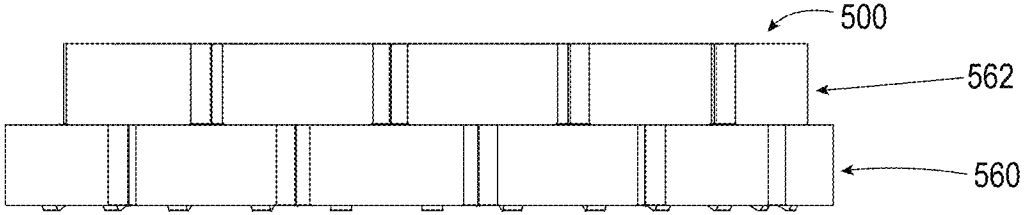
Figure 38B:
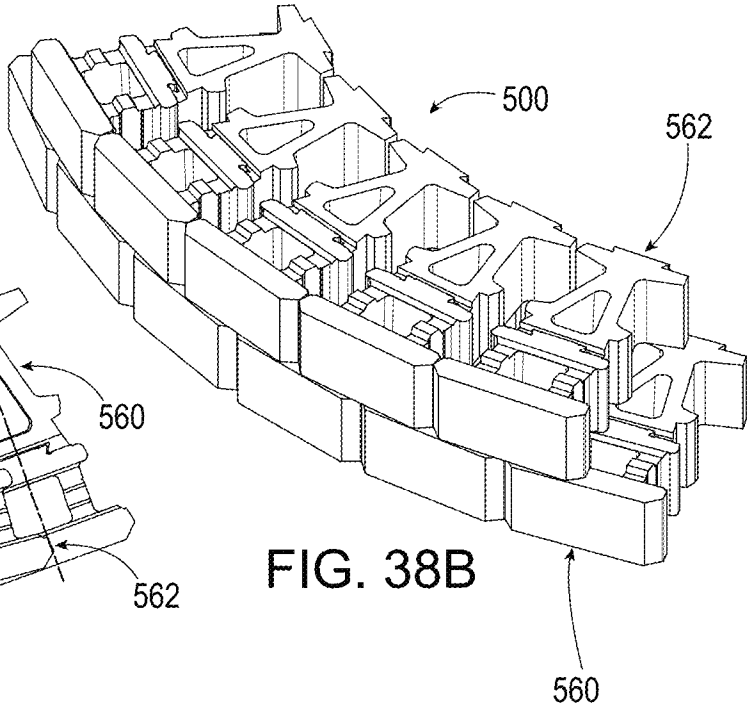
Figure 38A:
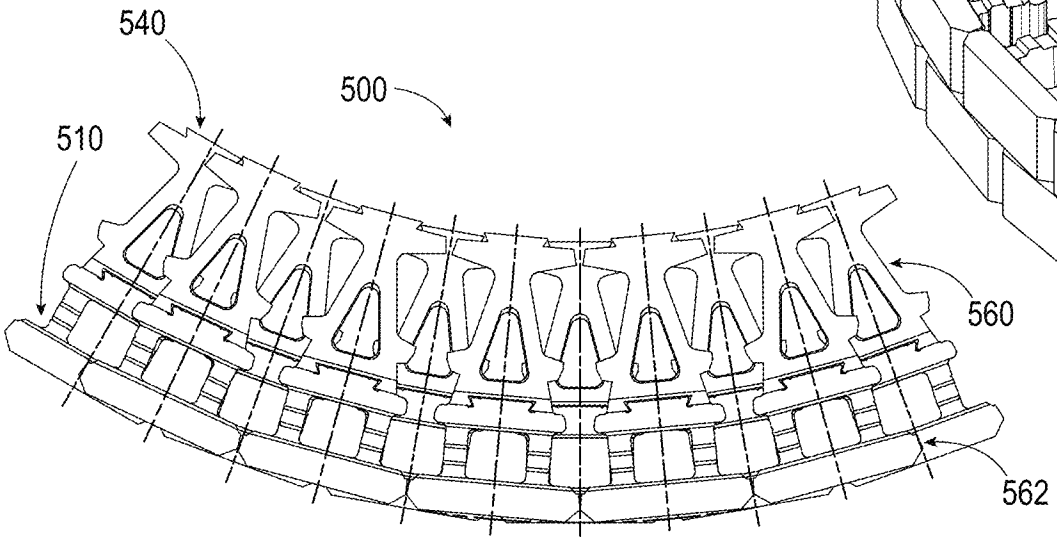
Figure 38C:
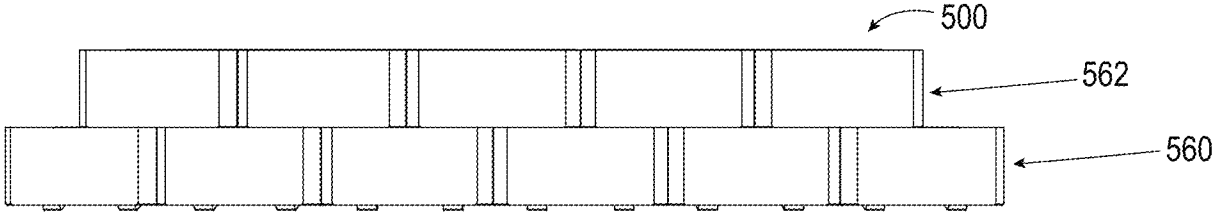

FIGS. 31A-31C depict an example pallet layout of wall blocks 410 in accordance with embodiments of the disclosure. FIGS. 31D-31F depict an example pallet layout of tail blocks 440 in accordance with embodiments of the disclosure. FIGS. 32A-32J depict various perspective, plan and elevation views of the wall block 410, in accordance with embodiments of the disclosure. FIGS. 33A-33J depict various perspective, plan and elevation views of the tail block 440, in accordance with embodiments of the disclosure.

FIGS. 25A-25D identify detailed elements of the wall blocks 410 and the tail blocks 440 using reference numbers. Many of those reference numbers are not repeated in FIGS. 26-33 in the interest of clarity and brevity. One of skill in the art would appreciate that those common elements exist as described with reference to FIGS. 25A-25D.

The wall blocks (or base units) 410 may each have a uniform size and shape, and the tail blocks (tail units) 440 may each have a uniform size and shape that is different than the size and shape of the wall blocks 410. In some examples, the wall blocks 410 and the tail blocks 440 may have a same, as installed, vertical height H. In some examples, a length of the tail blocks 440 may be greater than a length of the wall blocks 410. The wall blocks 410 and the tail blocks 440 may be made of a rugged, weather resistant material, such as pre-cast concrete (e.g., dry cast or wet cast). Other suitable materials are plastic, reinforced fibers, wood, metal and stone.

In some examples, the wall block 410 may include at least one opening 418 formed between a front portion 412 having the front side 420 and a rear portion 414 having the rear side 422, with opposing neck portions 416 extending between the front portion 412 and the rear portion 414 on opposing sides of the opening 418. The outer surfaces of the opposing neck portions 416 may form sides 424 and 426 of the wall block 410. A top and bottom of the wall block 410 may include a flat surface to facilitate stacking of other wall blocks on top of one another.

Figure 26A:
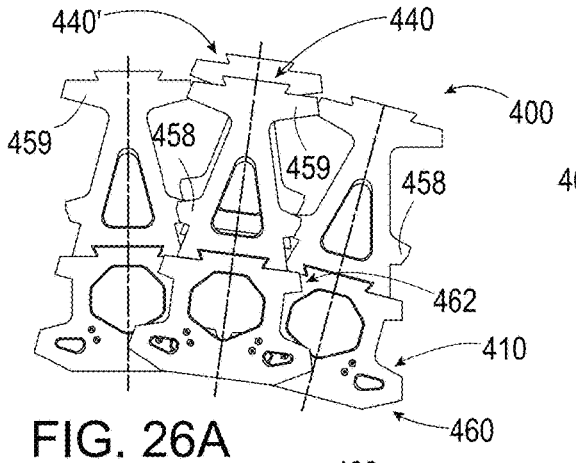
Figure 26B:
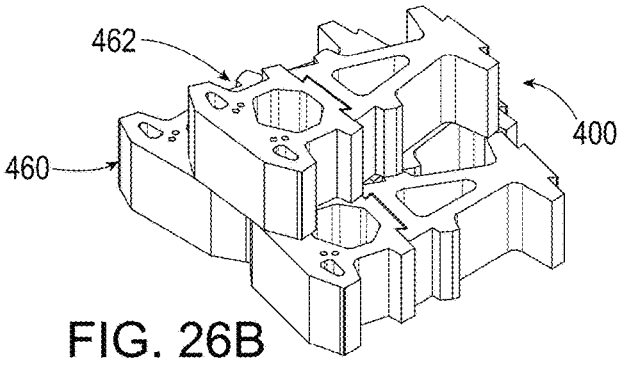
Figure 26C:
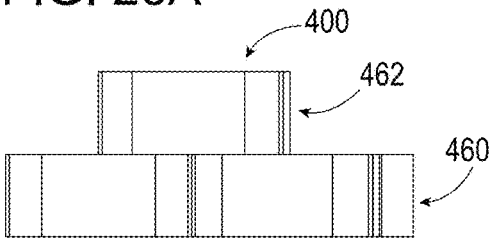
Figure 26D:
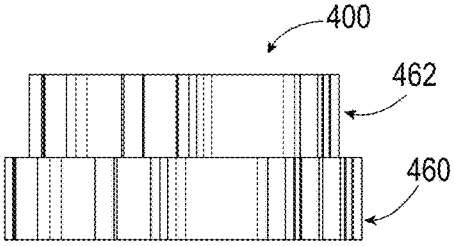
Figure 26E:
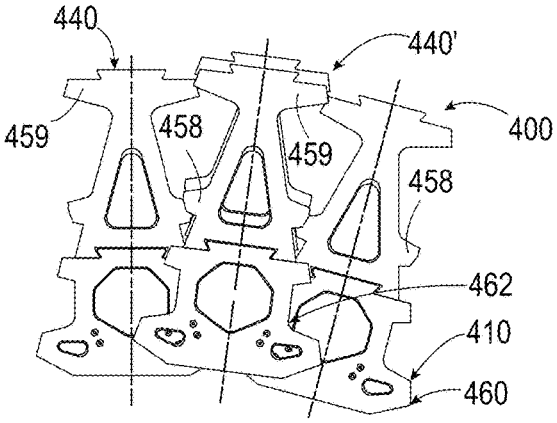
Figure 26F:
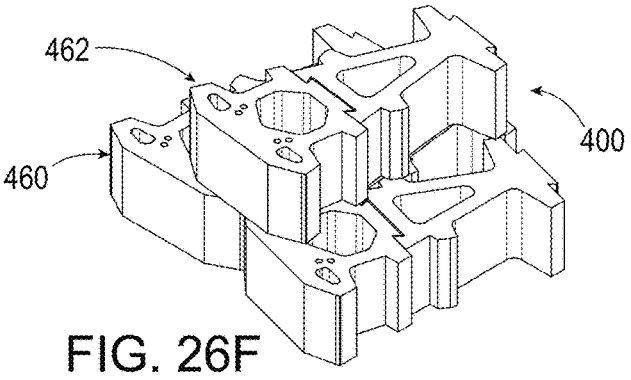
Figure 26G:
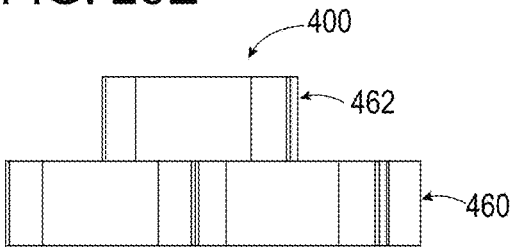
Figure 26H:
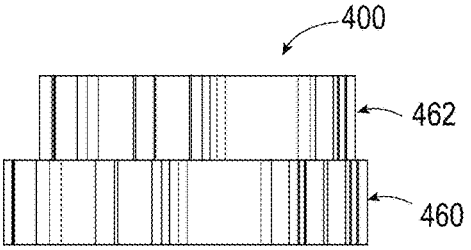
Figure 27A:
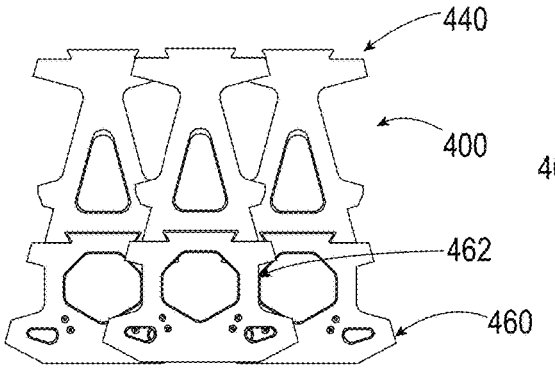
Figure 27B:
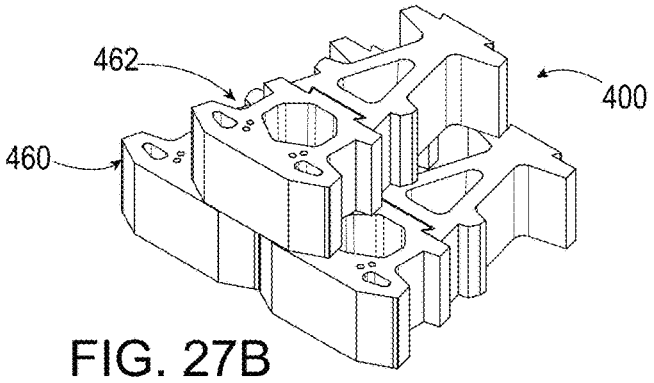
Figure 27C:
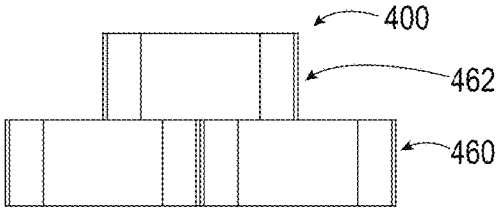
Figure 27D:
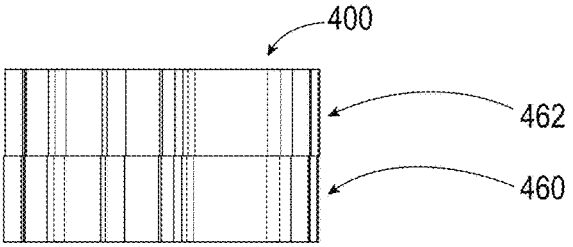
Figure 27E:
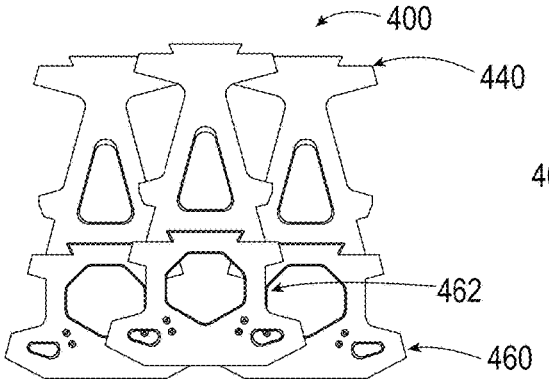
Figure 27F:
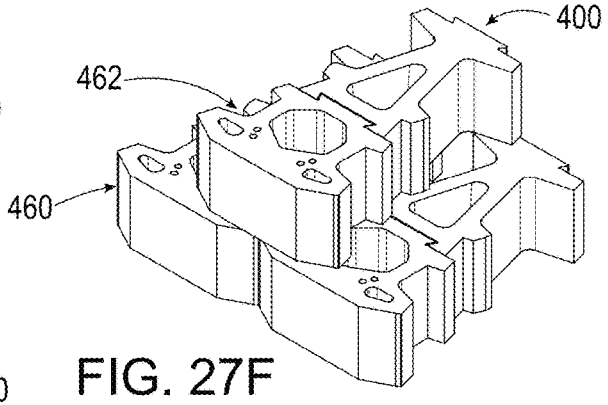
Figure 27G:
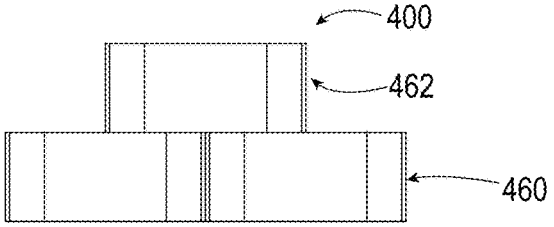
Figure 27H:
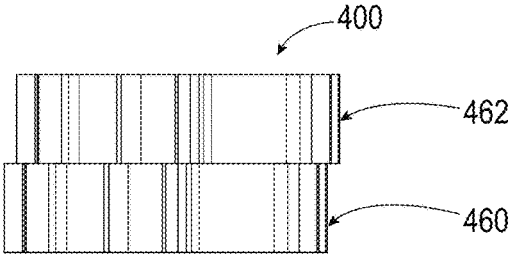
Figure 28B:
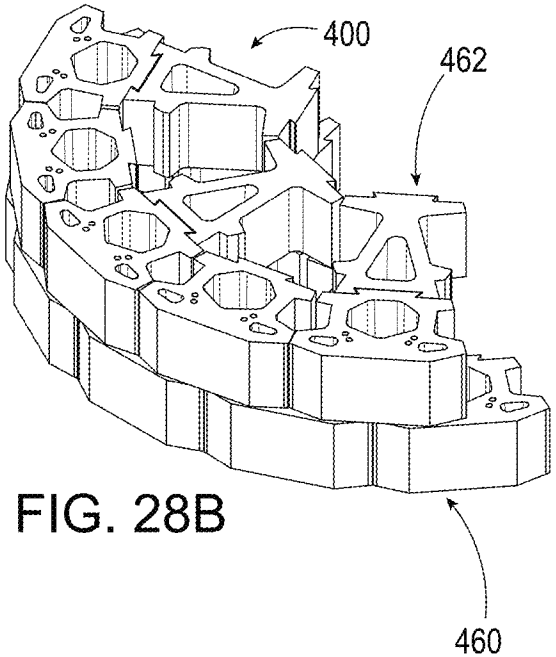
Figure 28A:
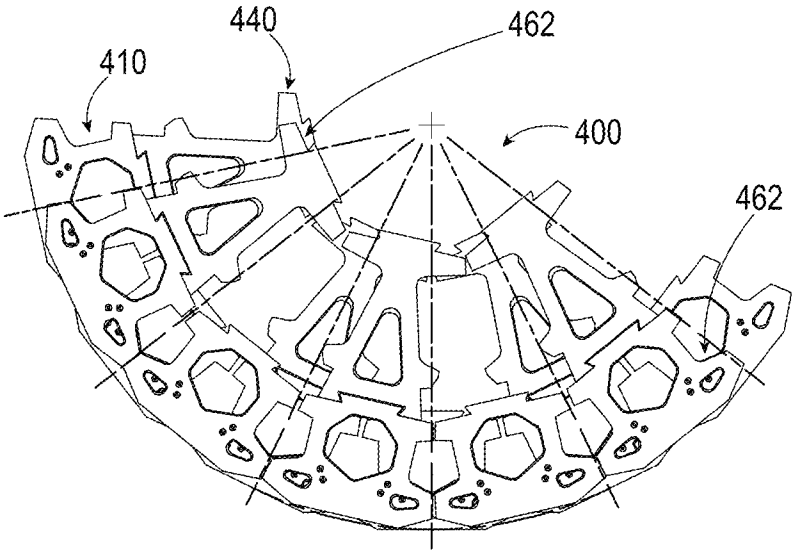
Figure 28C:
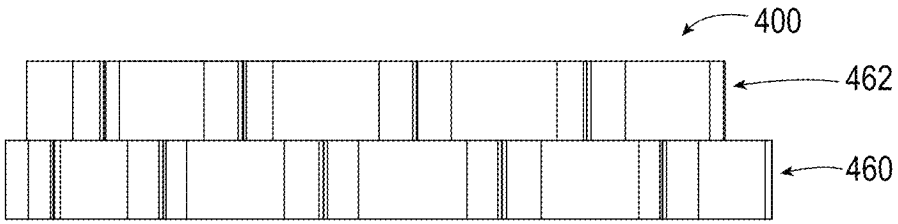
Figure 29B:
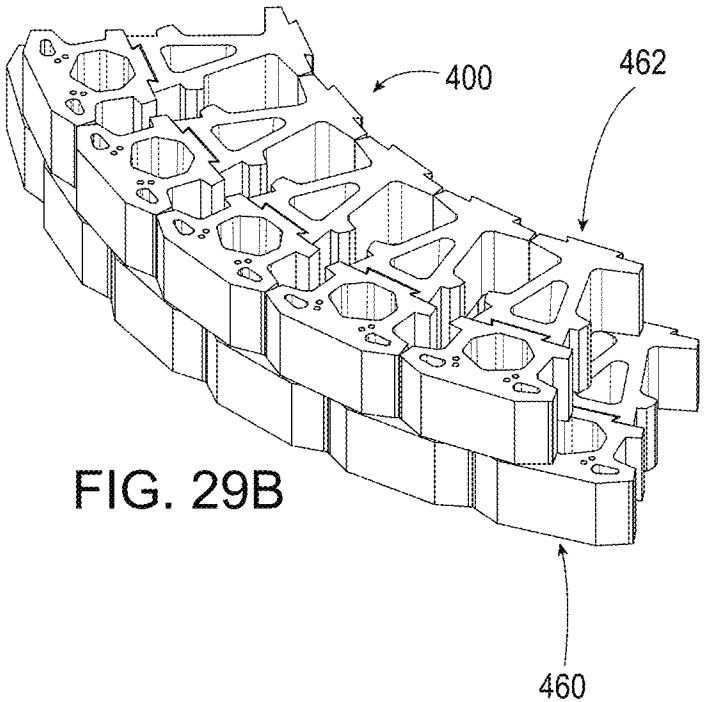
Figure 29A:
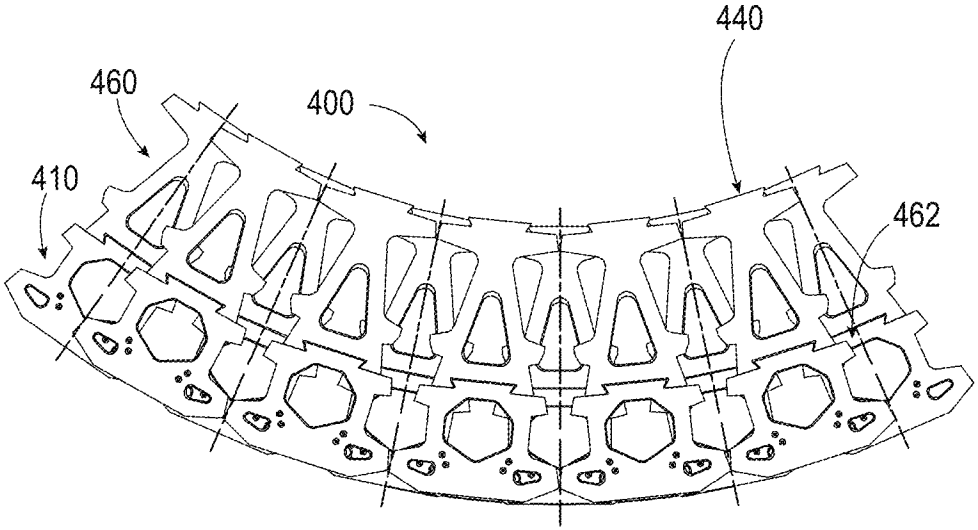
Figure 29C:
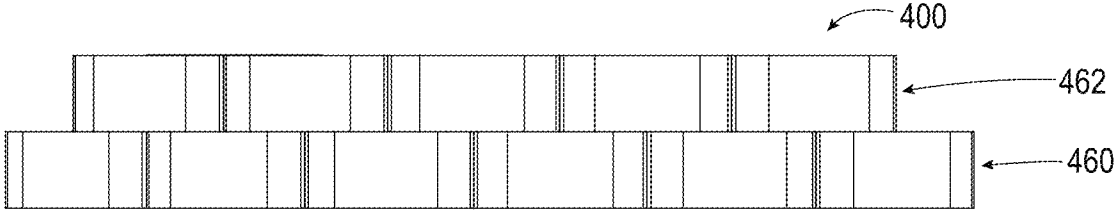

The tail block 440 may include a front portion 442 having a first end 450 configured to connect to the wall block 410 and a rear portion 444 having a second opposing end 452, with the front portion 442 and the rear portion 444 being connected via one or more neck portions 446. In some examples, the front portion 442 and the rear portion 444 may include wing portions that are configured to interlock with and/or contact adjacent tail blocks. For example, the front wings 458 of an upper tail block 440 can be supported on the front wings 458 and body of a lower tail block 440, and the rear wings 459 of the upper tail block 440 can be supported on the rear wings 459 of the lower tail block 440, as shown in FIGS. 26A and 26E.

In some examples, the tail block 440 may include two opposing neck portions 446 that form an opening 448 between the front portion 442 and the rear portion 444. The outer surfaces of the opposing neck portions 446 may form sides 454 and 456 of the tail block 440. A top and bottom of the tail block 440 may include a flat surface to facilitate stacking of other tail blocks 440 on top of one another.

In some examples, the opposing neck portions 446 of the tail block 440 may have a non-parallel relationship from the front portion 442 to the rear portion 444 (e.g., the first distance between the opposing neck portions 446 at the front portion 442 is greater than the second distance between the opposing neck portions 446 at the rear portion 444). In some examples, the opposing neck portions 446 merge together at or near the rear portion 444.

In some examples, the front portion 442 of the tail blocks 440 may connect to the wall blocks 410 (or to another tail block 440) using a connection system 423 and 451 formed in the wall block 410 and the tail block 440, respectively. For example, the tail block 440 may connect to the wall block 410 (or to another tail block 440) using a vertical (e.g., extending from an as-installed, top side to a bottom side of the wall block 410) dovetail connection (e.g., using connectors 423 and 451).

In some examples, the wall block 410 (and the second end of the tail block 440) may include the male dovetail connection 423 protruding from the rear side 422 of the wall block 410 and the tail block 440 may include a female dovetail connection 451 formed in the first end 450 of the tail block 440. The dovetail connection (using connectors 423 and 451) between the tail block 440 and the wall block 410 (or connector 453 and connector 451 on another tail block 440) may extend an entire height of the rear side 422 of the wall block 410 (or the second side 452 of the tail block 440). In some examples, male dovetail connection 423 on the wall block 410 may extend more than half of the width of the rear side 422 of the wall block 410.

As previously described, the second end 452 of the rear portion 444 of the tail blocks 440 may be configured to attach to another tail block 440 such that multiple tail blocks 440 could be attached together in a chain-like manner. While the connection shown in FIGS. 25-34 includes a dovetail connection, other types of connections may be used, such as a rounded connection or additional slotted connections where a connector is slid into slots formed in each of the wall block 410 and the tail block 440.

As shown in FIGS. 26-30, different courses or layers 460, 462 of a segmented wall 400 may include linear shapes, non-linear shapes, or combinations thereof formed using the wall blocks 410 and the tail blocks 440 in accordance with embodiments of the disclosure. FIGS. 26A-26D and 26E-26H depict a portion of a curved (e.g., concave) segmented wall 400, with part of two courses 460, 462 with near vertical setback (26A) and full setback (26B). The courses or layers 460, 462 may include at least one respective tail block 440 attached to (e.g., interlocked with) with a rear side of one or more of the respective set of wall blocks 410.

The curvature of the walls 400 in FIGS. 26A-26D and 26E-26H may be uniform and have a radius and an angle of A degrees from a center of a wall block 410 to a space between the wall blocks 410, and an angle of 2 times A degrees between the centers of the wall blocks 410. With the angle between the centers of the wall blocks 410 being at least A degrees, an additional tail block 440' not connected to any wall blocks 410 may be interleaved between tail blocks 440 attached to the wall blocks 410 to provide lateral support between the tail blocks 440.

The interleaved tail block 440' may provide vertical support for the tail block 440 placed on top in the course or layer 462. In some examples, A degrees is based on a width of the wall blocks 410. In some examples, A degrees is between and including 8 and 20 degrees.

FIGS. 27A-27D and 27E-27H depict a portion of a straight or linear segmented wall 400, with part of two courses 460, 462 with near vertical setback (27A) and full setback (27B). In some examples, the straight/linear shape of the segmented wall 400 may cause a neck portion of a tail block 440 of the course or layer 462 to at least partially overlap in a vertical direction with a neck portion of a tail block 440 of the course or layer 460 to form a column of vertically supported neck portions.

FIGS. 28A-28C and 29A-29B depict a portion of a curved (e.g., convex) segmented wall 400 with part of two courses 460, 462. The courses or layers 460, 462 may include at least one respective tail block 440 attached to (e.g., interlocked with) with a rear side of one or more of the respective set of wall blocks 410.

The curvature of the walls 400 in FIGS. 28A-28C and 29A-29C may be uniform, each having a respective radius and a respective angle of B (FIGS. 28A-28C) or A (FIGS. 29A-29C) degrees between opposing edges of a wall block 410. With the angle of B degrees, only every other wall block 410 is attached to a tail block 440 and the rear portions line up to provide support of the upper course or layer 462 of wall blocks 410 by the lower course or layer 460. With the angle of not more than A degrees, a neck portion of a tail block 440 of the course or layer 462 to at least partially overlap in a vertical direction with a neck portion of a tail block 440 of the course or layer 460 to form a column of vertically supported neck portions.

Figure 30B:
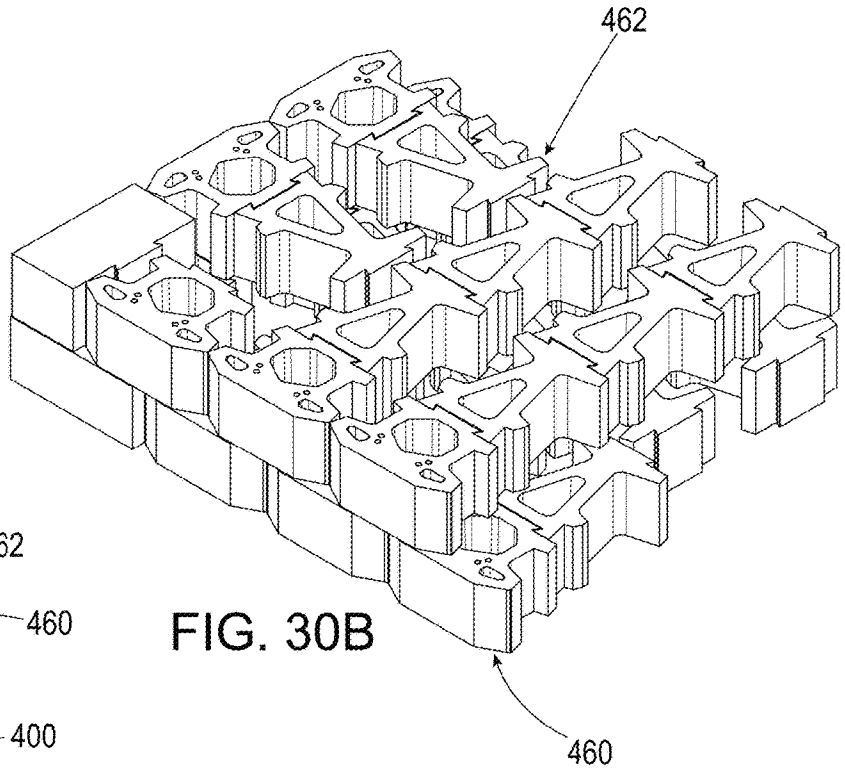
Figure 30A:
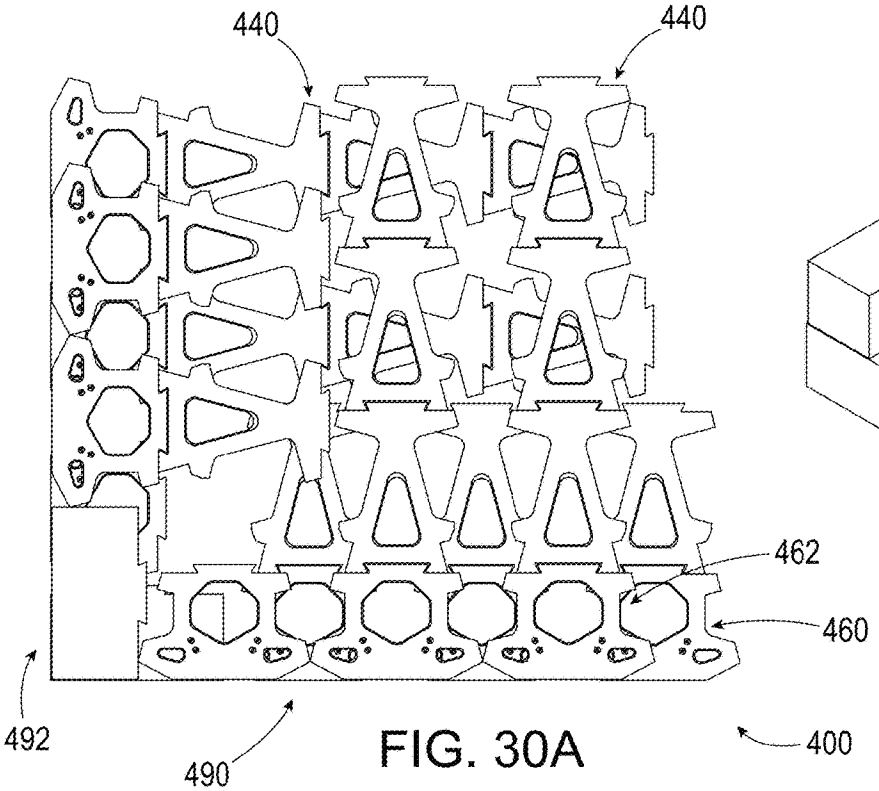
Figure 30C:
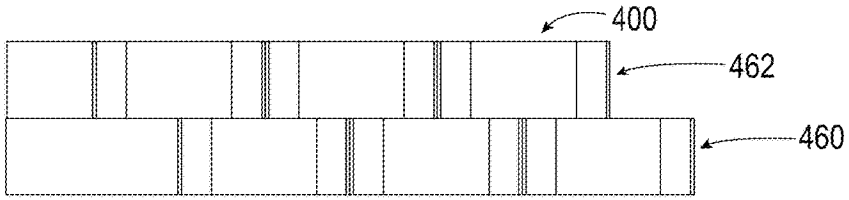

FIGS. 30A-30C depict a portion of a 90-degree corner segmented wall 400 (perpendicular sides 490 and 492), with part of two courses 460, 462. The courses or layers 460, 462 may include at least one respective tail block 440 attached to (e.g., interlocked with) with a rear side of one or more of the respective set of wall blocks 410 in an alternating fashion between the sides 490 and 492 due to a space conflicts that arise in perpendicular wall construction.

For example, starting from the adjoining corner, the first wall block 410 of the side 490 in the first course or layer 460 may be attached to a tail block 440, while the first wall block 410 of the side 492 in the first course or layer 462 may not be attached to a tail block 440. Conversely, starting from the adjoining corner, the first wall block 410 of the side 492 in the second course or layer 462 may be attached to a tail block 440, while the first wall block 410 of the side 490 in the second course or layer 462 may not be attached to a tail block 440.

Similar alternating arrangements between the sides 490 and 492 in the courses or layer 460 and 462 may be implemented for tail blocks 440 further away from the adjoining corner. The stacking of the tail blocks 440 in this way may add additional stability to the segmented wall 400 by adding additional interlocking structure between courses or layers 460, 462 of the different sides 490, 492. As the tail blocks 440 are covered with fill material, the interlocking between courses or layers 460, 462 may be further strengthened.

In some examples, the wall system may further include use of reinforced earth techniques such as geogrid reinforcement, geosynthetic reinforcement, or the use of inextensible materials such as steel matrices. After placement of a course or layer of the wall, a geogrid material may be placed over the course or layer before placement of a next course or layer. The weight of the upper course or layer on the geogrid material sandwiched between two layers may hold the geogrid material in place.

In some examples, additional pins, stakes, or other connectors in the wall block 410, the tail block 440, or the fill material may be used to penetrate the apertures of the geogrid material to further hold it in place. The use of the geogrid material may form a lateral interlocking connection between wall blocks and tail blocks of a course or layer, which may further fortify the segmented wall 400.

The segmented walls 400 depicted in FIGS. 25-33 are exemplary. Thus, while FIGS. 25-33 depict the segmented walls 400 with not more than two courses or layers 460, 462; it is appreciated that the segmented walls 400 may include more or fewer than two courses or layers. It is also appreciated that the segmented walls 400 may include more or fewer than a number of wall blocks 410 and tail blocks 440 in each course or layer than depicted. It is also appreciated that a segmented wall 400 may be constructed in a different shape than depicted without departing from the scope of the disclosure. Finally, it is appreciated that some courses or layers of the segmented wall 400 may include no tail blocks 440, a single row of tail blocks 440, or more than two rows of wall blocks without departing from the scope of the disclosure.

FIGS. 34-42 depict fifth embodiments of a segmented wall system 500 with tail blocks 540, in accordance with the present disclosure. The segmented wall systems 500 of FIGS. 34-42 may be formed using a combination of wall blocks 510 and tail blocks 540.

FIGS. 34A-34D depict examples of various top plan, perspective, and front and side elevation views of part of a course or layer of wall blocks 510 connected to tail blocks 540, with an additional tail block 540' between the two tail blocks 540, in accordance with embodiments of the disclosure. FIGS. 35-39 depict different segmented wall shapes with various arrangements of the wall blocks 510 and tail blocks 540, in accordance with embodiments of the disclosure.

Figure 40A:
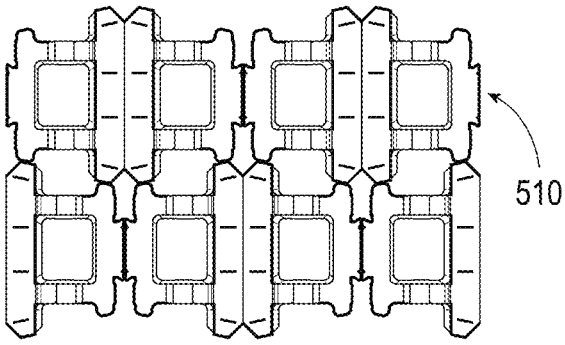
Figure 40C:
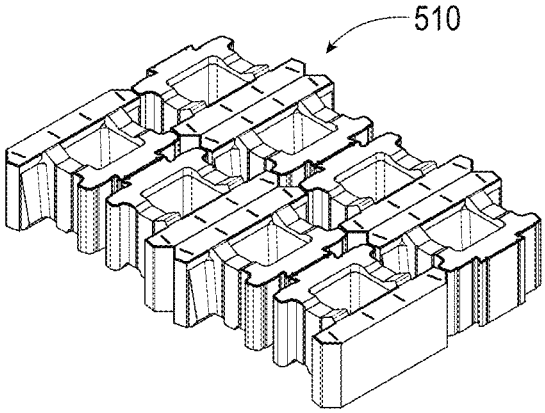
Figure 40B:
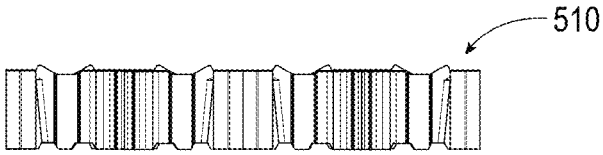
Figure 40D:
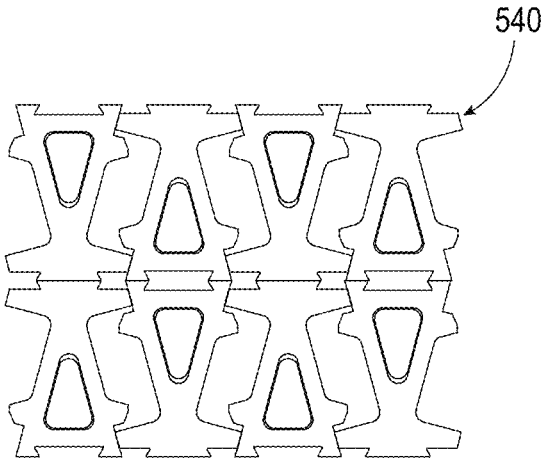
Figure 40F:
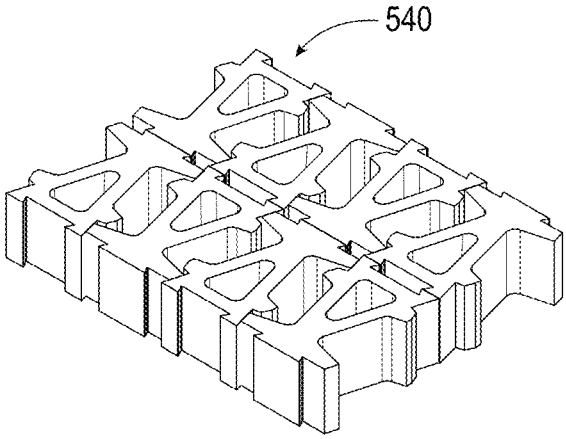
Figure 40E:
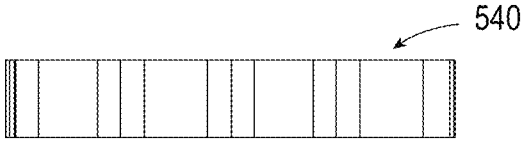
Figure 41B:
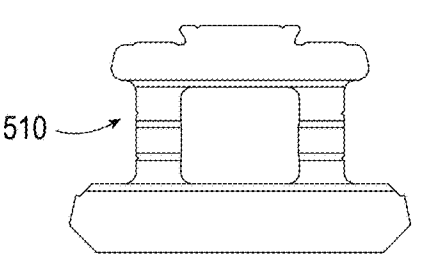
Figure 41C:
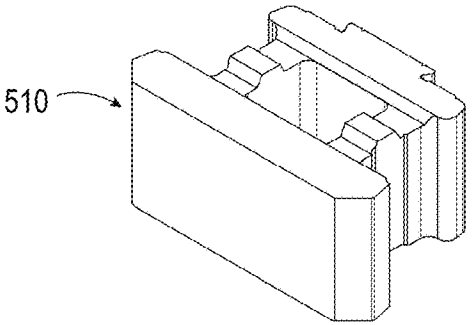
Figure 41A:
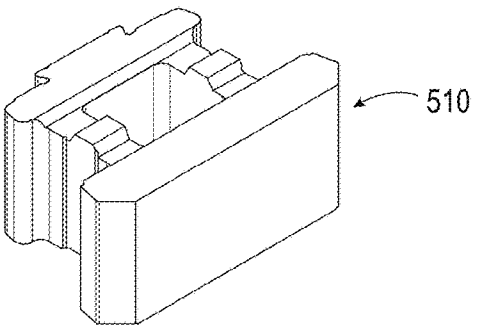
Figure 41E:
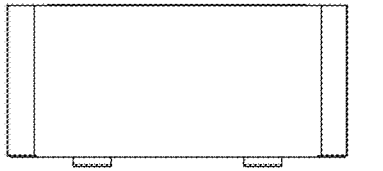
Figure 41F:
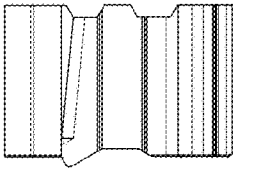
Figure 41G:
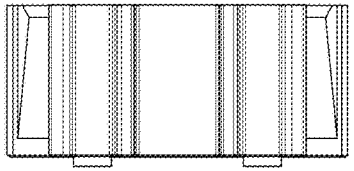
Figure 41D:
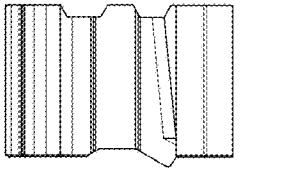
Figure 41I:
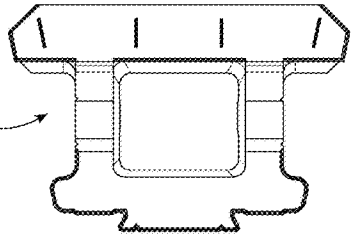
Figure 41J:
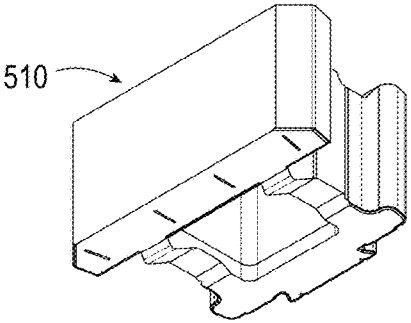
Figure 41H:
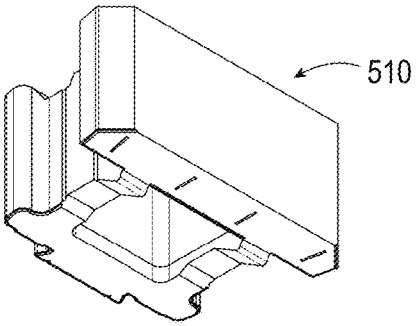
Figure 42C:
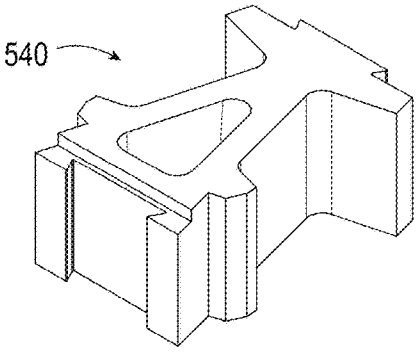
Figure 42G:
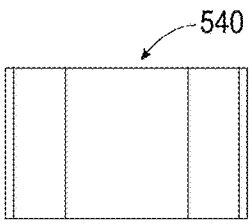
Figure 42J:
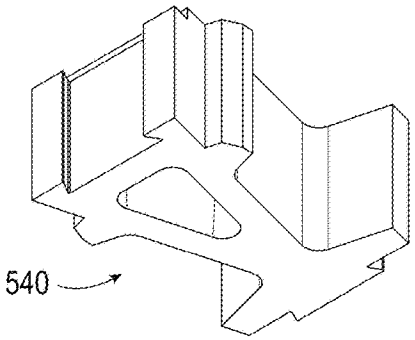
Figure 42B:
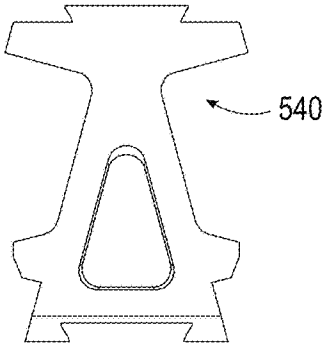
Figure 42F:
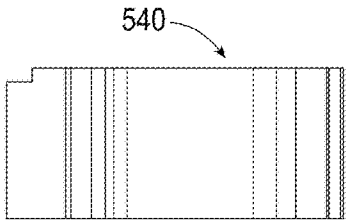
Figure 42E:
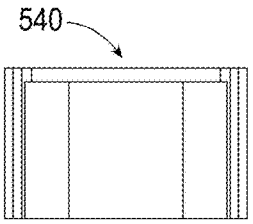
Figure 42I:
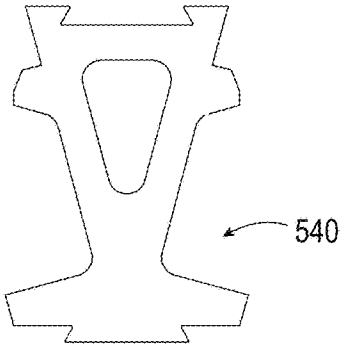
Figure 42A:
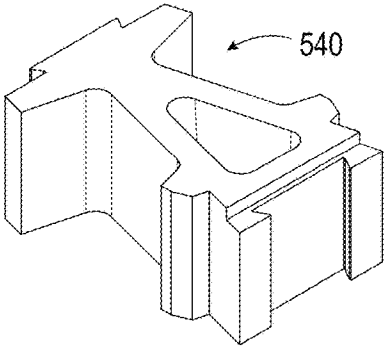
Figure 42D:
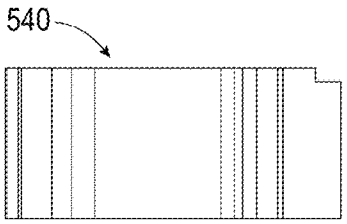
Figure 42H:
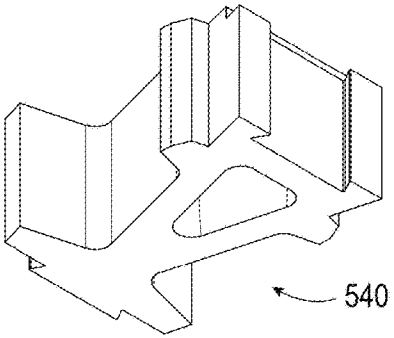
Figure 43B:
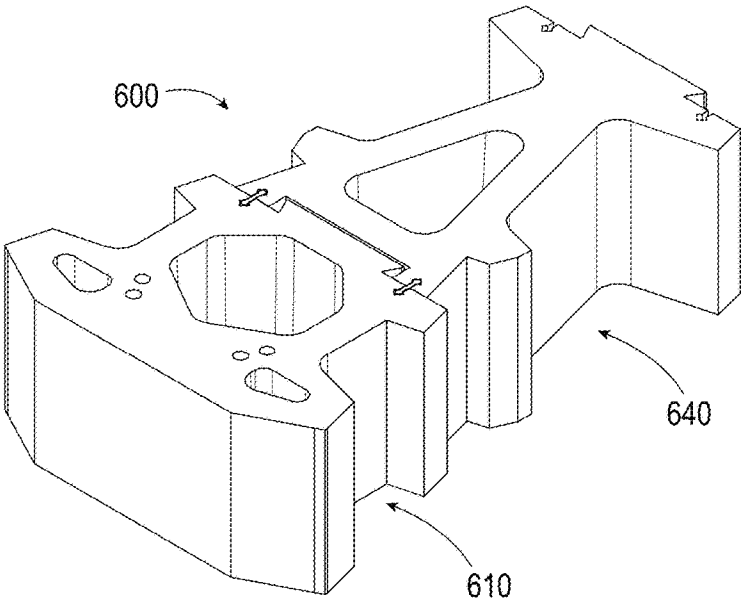
Figure 43D:
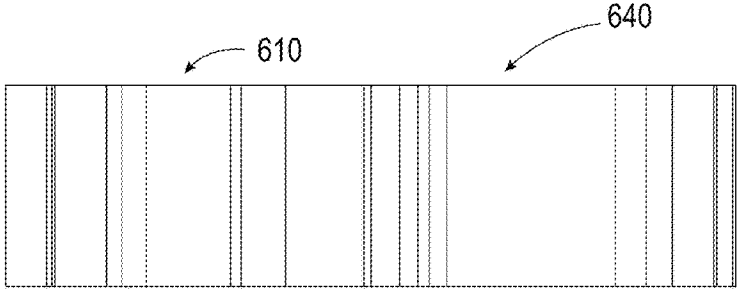
Figure 43A:
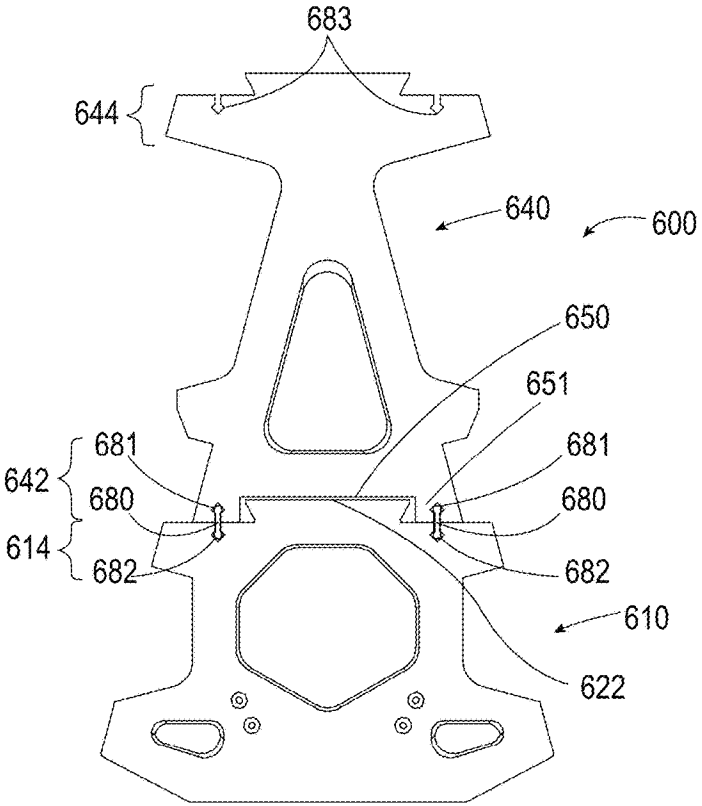
Figure 43C:
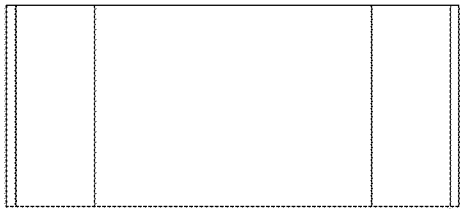
Figure 44C:
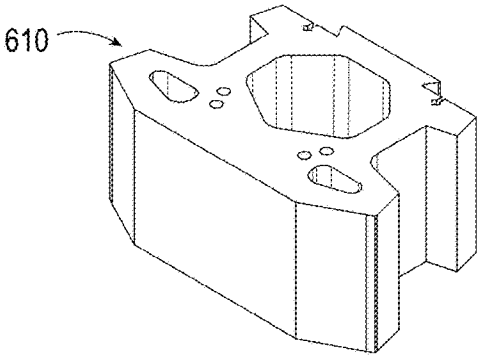
Figure 44B:
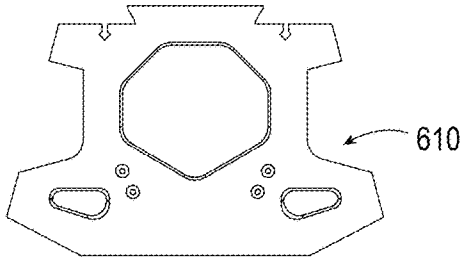
Figure 44A:
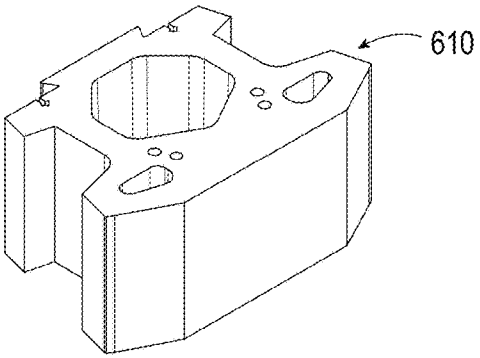
Figure 44G:
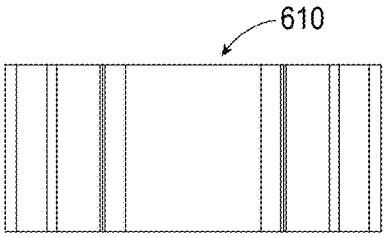
Figure 44F:
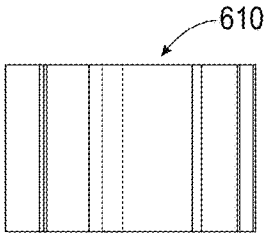
Figure 44E:
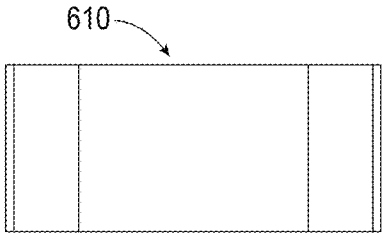
Figure 44D:
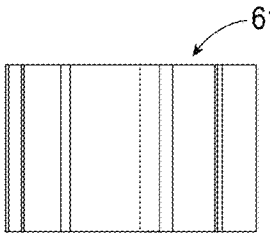
Figure 44J:
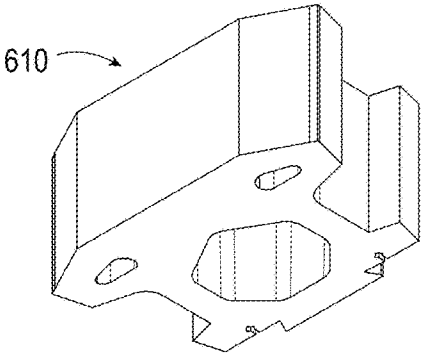
Figure 44I:
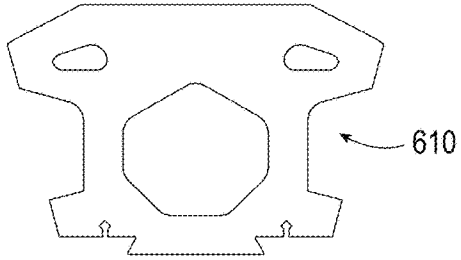
Figure 44H:
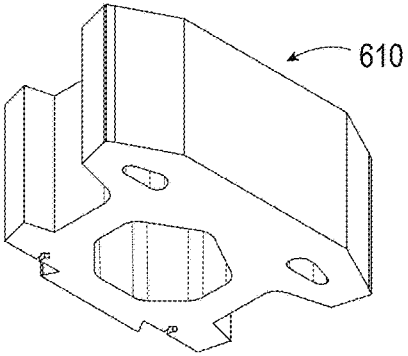
Figure 46A:
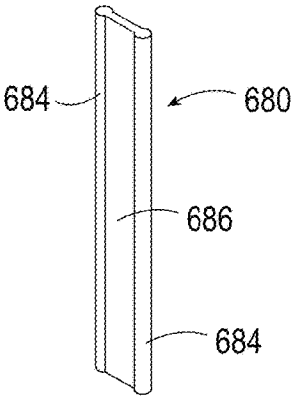
Figure 46B:
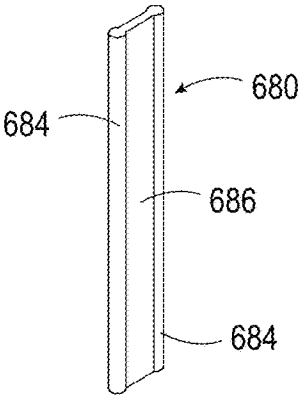
Figure 46C:
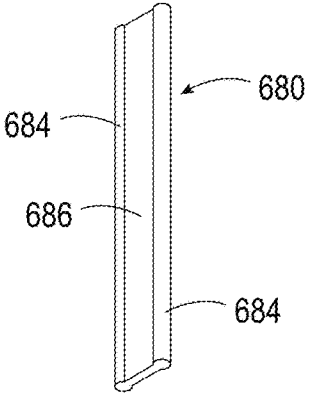
Figure 46D:
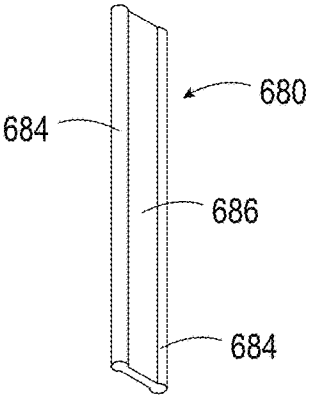
Figure 46E:
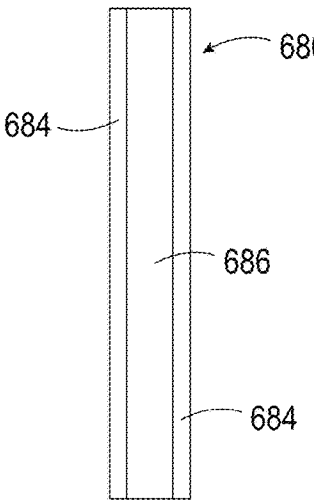
Figure 46F:
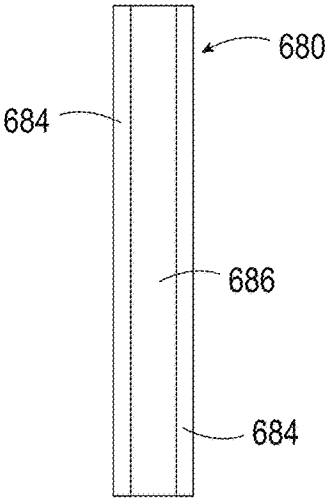
Figure 46G:
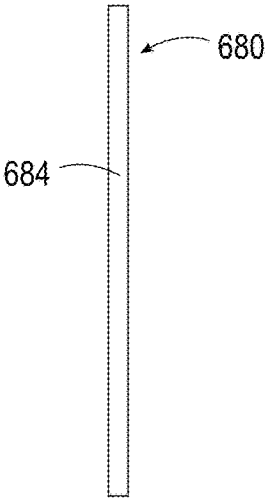
Figure 46H:
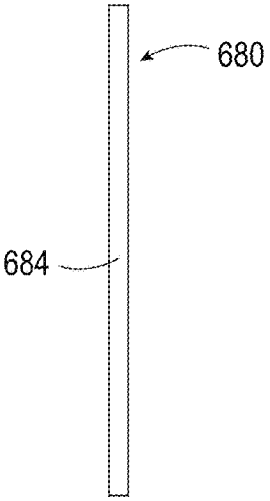
Figure 46I:
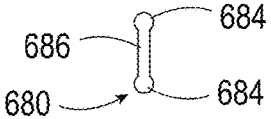
Figure 46J:
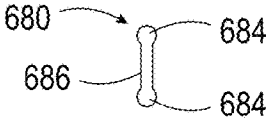
Figure 47B:
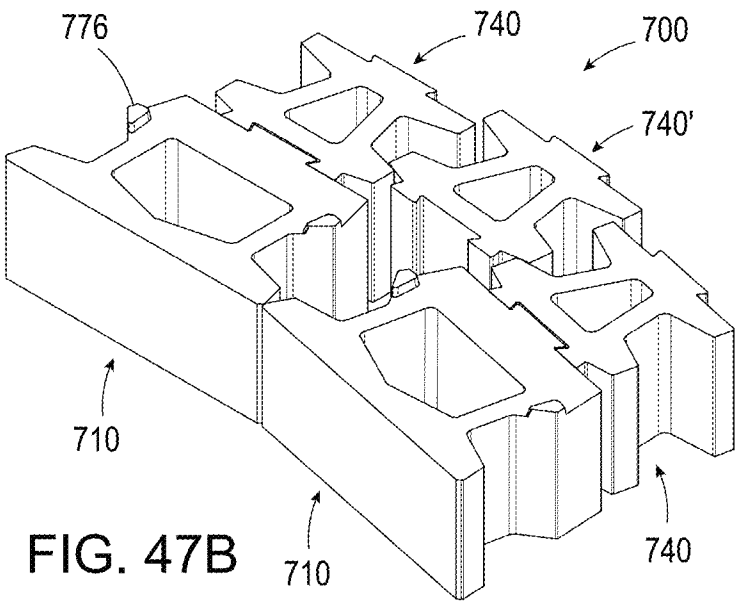
Figure 47D:
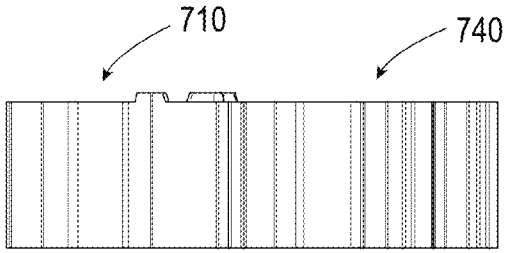
Figure 47A:
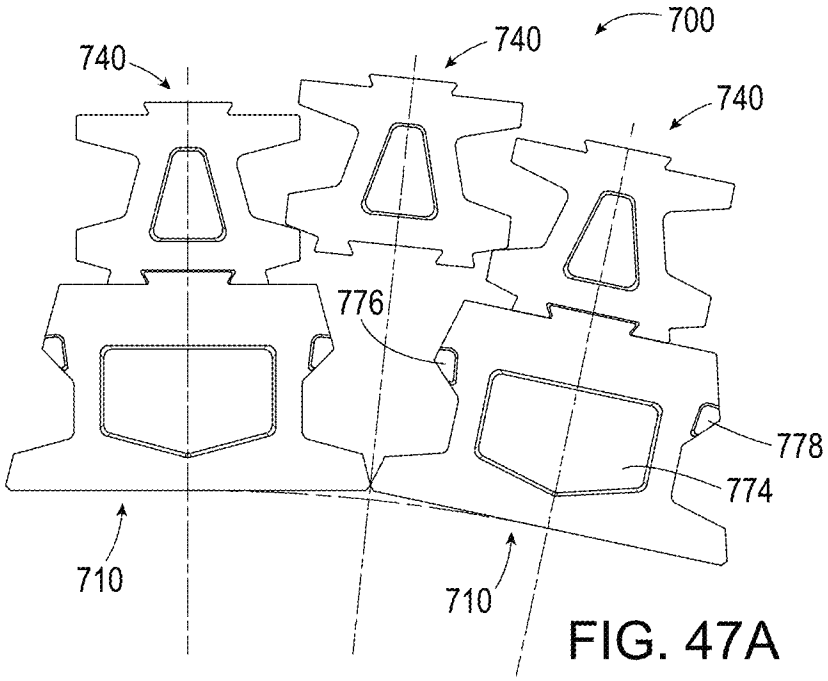
Figure 47C:
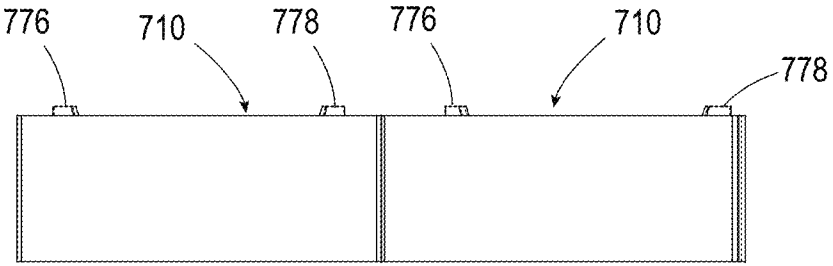
Figure 48B:
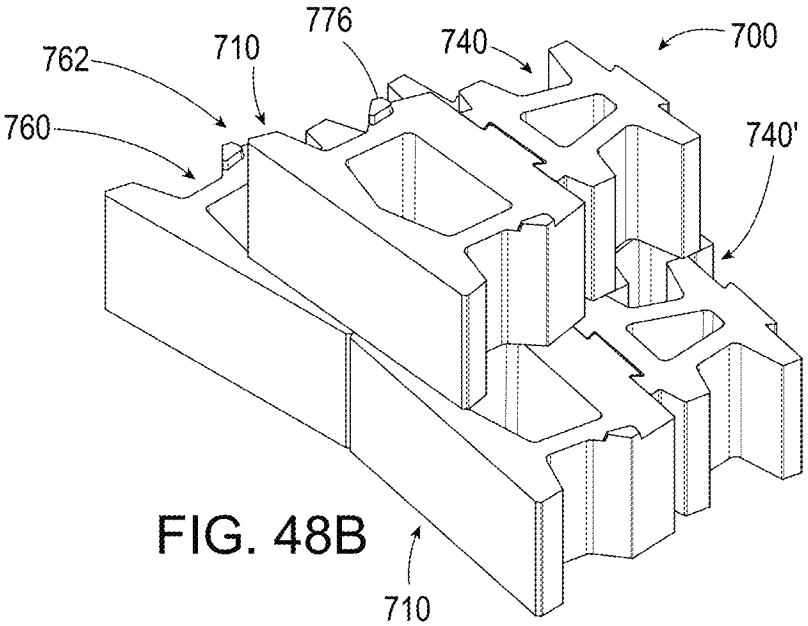
Figure 48D:
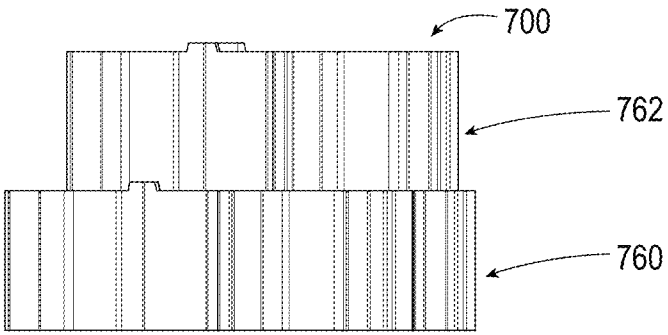
Figure 48A:
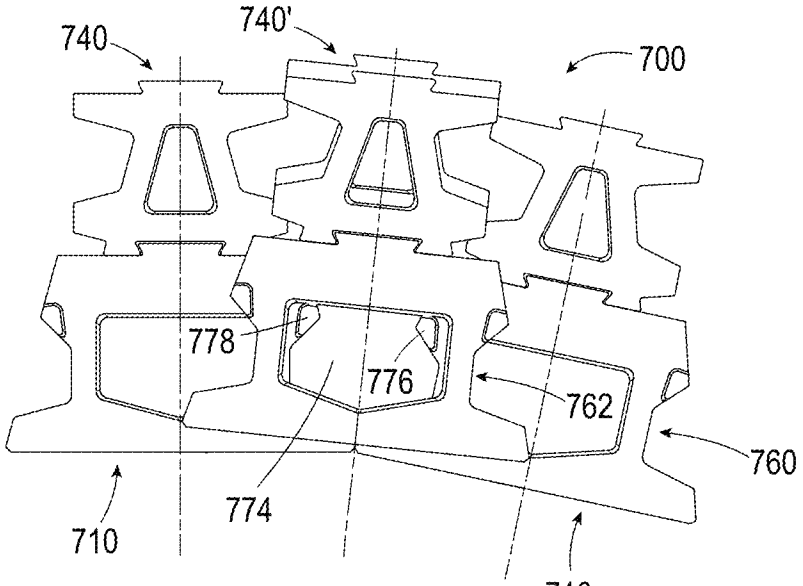
Figure 48C:
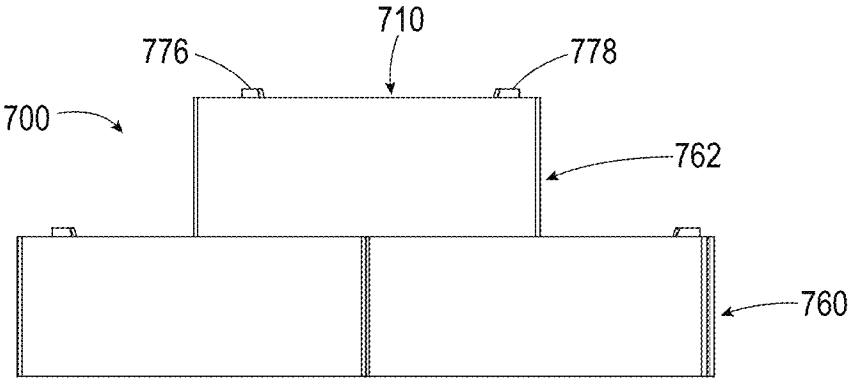
Figure 49B:
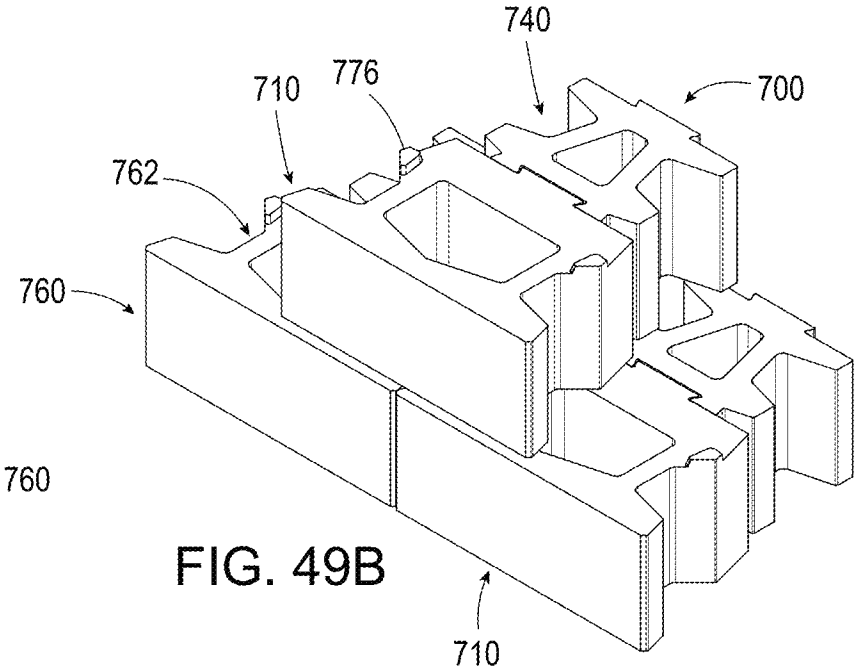
Figure 49D:
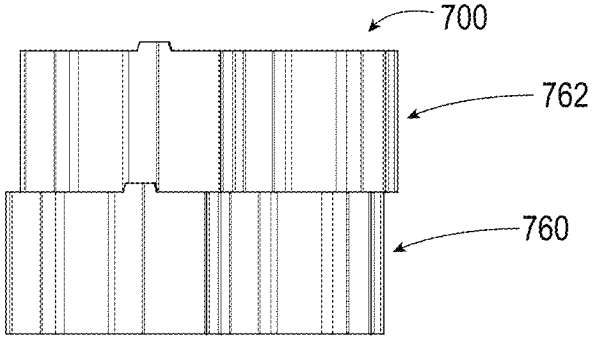
Figure 49A:
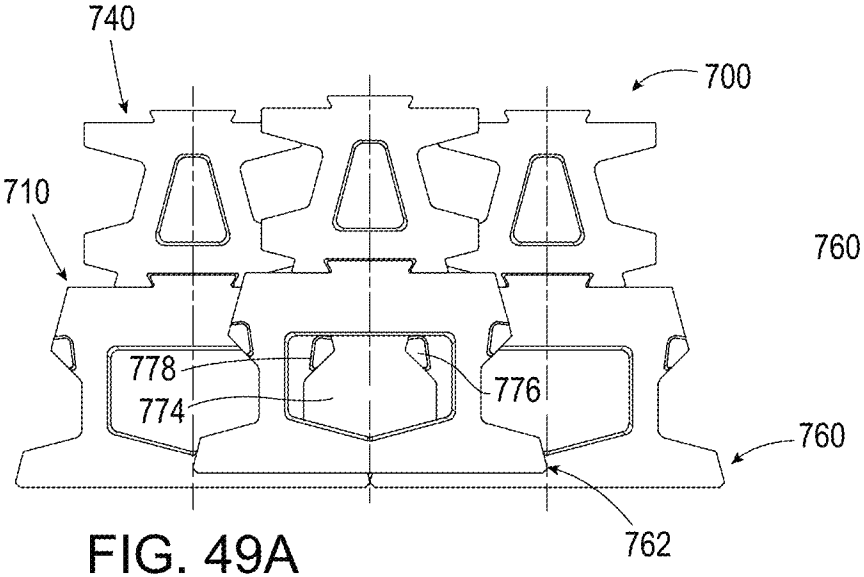
Figure 49C:
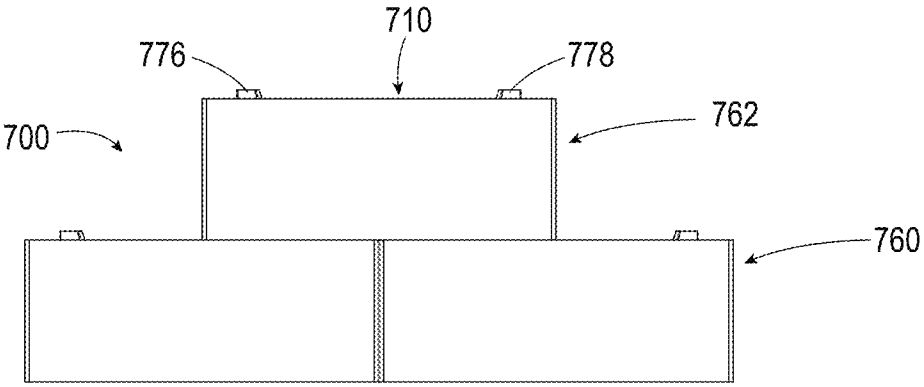
Figure 50B:
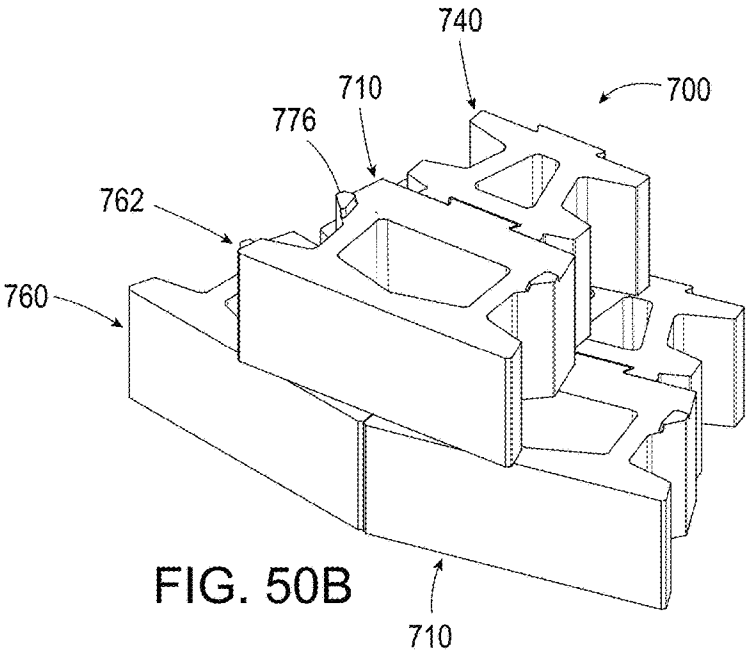
Figure 50D:
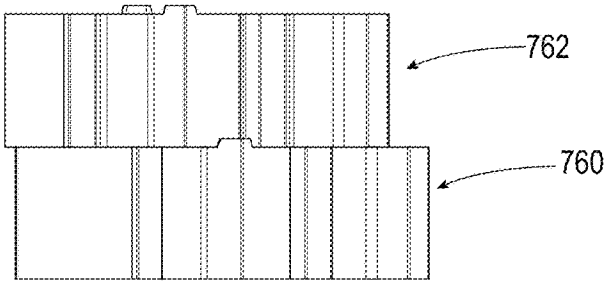
Figure 50A:
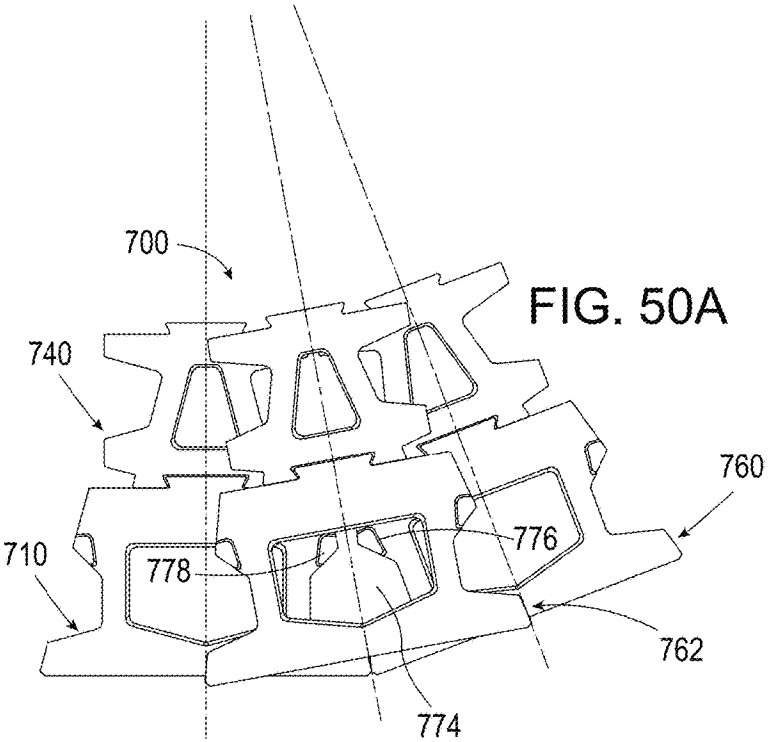
Figure 50C:
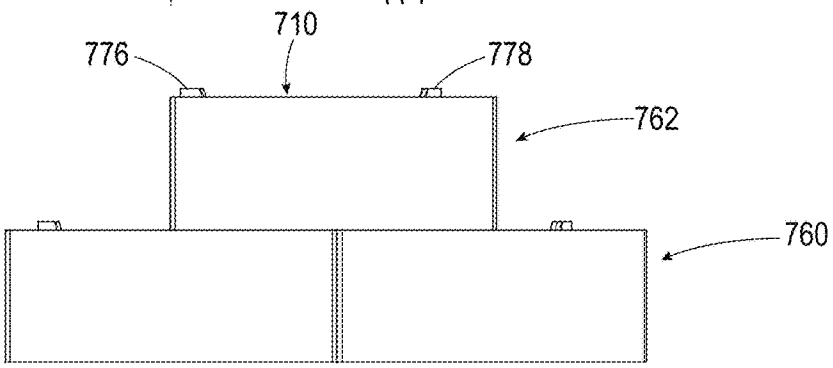

FIGS. 40A-40C depict an example pallet layout of wall blocks 510 in accordance with embodiments of the disclosure. FIGS. 40D-40F depict an example pallet layout of tail blocks 540 in accordance with embodiments of the disclosure. FIGS. 41A-41J depicts various perspective, plan and elevation views of the wall block 510, in accordance with embodiments of the disclosure. FIGS. 42A-42J depict various perspective, plan and elevation views of the tail block 540, in accordance with embodiments of the disclosure.

FIGS. 34A-34D identify detailed elements of the wall blocks 510 and the tail blocks 540 using reference numbers. Many of those reference numbers are not repeated in FIGS. 35-42 in the interest of clarity and brevity. One of skill in the art would appreciate that those common elements exist as described with reference to FIGS. 34A-34D.

The wall blocks (or base units) 510 may each have a uniform size and shape, and the tail blocks (tail units) 540 may each have a uniform size and shape that is different than the size and shape of the wall blocks 510. In some examples, the wall blocks 510 and the tail blocks 540 may have a same, as installed, vertical height H. In some examples, a length of the tail blocks 540 may be greater than a length of the wall blocks 510. The wall blocks 510 and the tail blocks 540 may be made of a rugged, weather resistant material, such as pre-cast concrete (e.g., dry cast or wet cast). Other suitable materials are plastic, reinforced fibers, wood, metal and stone.

In some examples, the wall block 510 may include at least one opening 518 formed between a front portion 512 having the front side 520 and a rear portion 514 having the rear side 522, with opposing neck portions 516 extending between the front portion 512 and the rear portion 522 on opposing sides of the opening 518. The outer surfaces of the opposing neck portions 516 may form sides 524 and 526 of the wall block 510. A top and bottom of the wall block 510 may include a flat surface to facilitate stacking of other wall blocks on top of one another.

The tail block 540 may include a front portion 542 having a first end 550 configured to connect to the wall block 510 and a rear portion 544 having a second opposing end 552, with the front portion 542 and the rear portion 544 being connected via one or more neck portions 546. In some examples, the front portion 542 and the rear portion 544 may include wing portions that are configured to interlock with and/or contact adjacent tail blocks. For example, the front wings 558 of an upper tail block 540 can be supported on the front wings 558 and body of a lower tail block 540, and the rear wings 559 of the upper tail block 540 can be supported on the rear wings 559 of the lower tail block 540, as shown in FIG. 35A.

In some examples, the tail block 540 may include two opposing neck portions 546 that form an opening 548 between the front portion 542 and the rear portion 544. The outer surfaces of the opposing neck portions 546 may form sides 554 and 556 of the tail block 540. A top and bottom of the tail block 540 may include a flat surface to facilitate stacking of other tail blocks 540 on top of one another.

In some examples, the opposing neck portions 546 of the tail block 540 may have a non-parallel relationship from the front portion 542 to the rear portion 544 (e.g., the first distance between the opposing neck portions 546 at the front portion 542 is greater than the second distance between the opposing neck portions 546 at the rear portion 544). In some examples, the opposing neck portions 546 merge together at or near the rear portion 544.

In some examples, the front portion 542 of the tail blocks 540 may connect to the wall blocks 510 (or to another tail block 540) using a connection system 523 and 551 formed in the wall block 510 and the tail block 540, respectively. For example, the tail block 540 may connect to the wall block 510 (or to another tail block 540) using a vertical (e.g., extending from an as-installed, top side to a bottom side of the wall block 510) dovetail connection (e.g., using connectors 523 and 551).

In some examples, the wall block 510 (and the second end of the tail block 540) may include the male dovetail connection 523 protruding from the rear side 522 of the wall block 510 and the tail block 540 may include a female dovetail connection 551 formed in the first end 550 of the tail block 540. The dovetail connection (using connectors 523 and 551) between the tail block 540 and the wall block 510 (or connector 553 and connector 551 on another tail block 540) may extend an entire height of the rear side 522 of the wall block 510 (or the second side 552 of the tail block 540). In some examples, male dovetail connection 523 on the wall block 510 may extend more than half of the width of the rear side 522 of the wall block 510.

As previously described, the second end 552 of the rear portion 544 of the tail blocks 540 may be configured to attach to another tail block 540 such that multiple tail blocks 540 could be attached together in a chain-like manner. While the connection shown in FIGS. 35-42 includes a dovetail connection, other types of connections may be used, such as a rounded connection or additional slotted connections where a connector is slid into slots formed in each of the wall block 510 and the tail block 540.

As shown in FIGS. 35-39, different courses or layers 560, 562 of a segmented wall 500 may include linear shapes, non-linear shapes, or combinations thereof formed using the wall blocks 510 and the tail blocks 540 in accordance with embodiments of the disclosure. FIGS. 35A-35D depict a portion of a straight or linear segmented wall 500, with part of two courses 560, 562. In some examples, the straight/linear shape of the segmented wall 500 may cause a neck portion of a tail block 540 of the course or layer 562 to at least partially overlap in a vertical direction with a neck portion of a tail block 540 of the course or layer 560 to form a column of vertically supported neck portions.

FIGS. 36A-36D depict a portion of a curved (e.g., concave) segmented wall 500, with part of two courses 560, 562. The courses or layers 560, 562 may include at least one respective tail block 540 attached to (e.g., interlocked with) with a rear side of one or more of the respective set of wall blocks 510.

The curvature of the wall 500 in FIGS. 36A-36D may be uniform and have a radius and an angle of A degrees from a center of a wall block 510 to a space between the wall blocks 510, and an angle of 2 times A degrees between the centers of the wall blocks 510. With the angle between the centers of the wall blocks 510 being at least A degrees, an additional tail block 540' not connected to any wall blocks 510 may be interleaved between tail blocks 540 attached to the wall blocks 510 to provide lateral support between the tail blocks 540.

The interleaved tail block 540' may provide vertical support for the tail block 540 placed on top in the course or layer 562. In some examples, A degrees is based on a width of the wall blocks 510. In some examples, A degrees is between and including 8 and 20 degrees.

FIGS. 37A-37C and 38A-38C depict portions of curved (e.g., convex) segmented walls 500 with part of two courses 560, 562. The courses or layers 560, 562 may include at least one respective tail block 540 attached to (e.g., interlocked with) with a rear side of one or more of the respective set of wall blocks 510.

The curvature of the wall 500 in FIGS. 37A-37C and 38A-38C may be uniform, each having a respective radius and a respective angle of B (FIGS. 37A-C) or A (FIGS. 38A-38C) degrees between opposing edges of a wall block 510. With the angle of B degrees, only every other wall block 510 is attached to a tail block 540 and the rear portions line up to provide support of the upper course or layer 562 of wall blocks 510 by the lower course or layer 560. With the angle of not more than A degrees, a neck portion of a tail block 540 of the course or layer 562 to at least partially overlap in a vertical direction with a neck portion of a tail block 540 of the course or layer 560 to form a column of vertically supported neck portions.

Figure 39B:
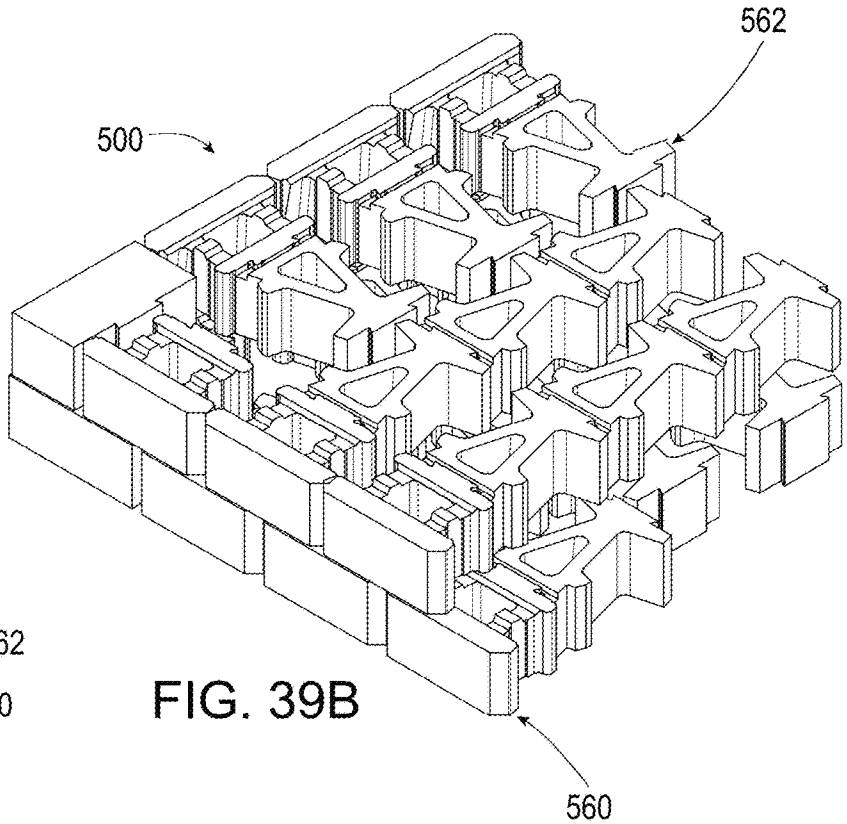
Figure 39C:
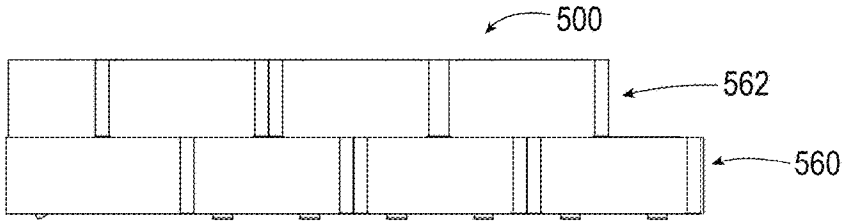
Figure 39A:
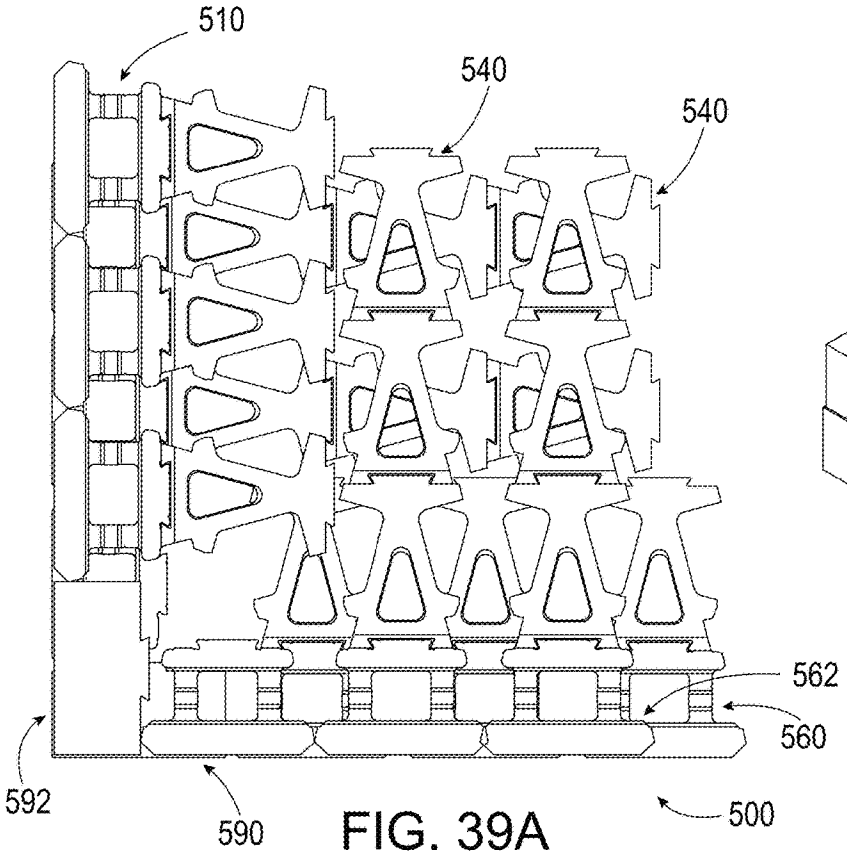

FIGS. 39A-39C depict a portion of a 90-degree corner segmented wall 500 (perpendicular sides 590 and 592), with part of two courses 560, 562. The courses or layers 560, 562 may include at least one respective tail block 540 attached to (e.g., interlocked with) with a rear side of one or more of the respective set of wall blocks 510 in an alternating fashion between the sides 590 and 592 due to a space conflicts that arise in perpendicular wall construction.

For example, starting from the adjoining corner, the first wall block 510 of the side 590 in the first course or layer 560 may be attached to a tail block 540, while the first wall block 510 of the side 592 in the first course or layer 562 may not be attached to a tail block 540. Conversely, starting from the adjoining corner, the first wall block 510 of the side 592 in the second course or layer 562 may be attached to a tail block 540, while the first wall block 510 of the side 590 in the second course or layer 562 may not be attached to a tail block 540.

Similar alternating arrangements between the sides 590 and 592 in the courses or layer 560 and 562 may be implemented for tail blocks 540 further away from the adjoining corner. The stacking of the tail blocks 540 in this way may add additional stability to the segmented wall 500 by adding additional interlocking structure between courses or layers 560, 562 of the different sides 590, 592. As the tail blocks 540 are covered with fill material, the interlocking between courses or layers 560, 562 may be further strengthened.

In some examples, the wall system may further include use of reinforced earth techniques such as geogrid reinforcement, geosynthetic reinforcement, or the use of inextensible materials such as steel matrices. After placement of a course or layer of the wall, a geogrid material may be placed over the course or layer before placement of a next course or layer. The weight of the upper course or layer on the geogrid material sandwiched between two layers may hold the geogrid material in place.

In some examples, additional pins, stakes, or other connectors in the wall block 510, the tail block 540, or the fill material may be used to penetrate the apertures of the geogrid material to further hold it in place. The use of the geogrid material may form a lateral interlocking connection between wall blocks and tail blocks of a course or layer, which may further fortify the segmented wall 500.

The segmented walls 500 depicted in FIGS. 35-42 are exemplary. Thus, while FIGS. 35-42 depict the segmented walls 500 with not more than two courses or layers 560, 562; it is appreciated that the segmented walls 500 may include more or fewer than two courses or layers. It is also appreciated that the segmented walls 500 may include more or fewer than a number of wall blocks 510 and tail blocks 540 in each course or layer than depicted. It is also appreciated that a segmented wall 500 may be constructed in a different shape than depicted without departing from the scope of the disclosure. Finally, it is appreciated that some courses or layers of the segmented wall 500 may include no tail blocks 540, a single row of tail blocks 540, or more than two rows of wall blocks without departing from the scope of the disclosure.

FIGS. 43-46 depict sixth embodiments of a segmented wall system 600 with tail blocks 640 and connectors 680, in accordance with the present disclosure. The segmented wall systems 600 of FIGS. 43-46 may be formed using a combination of wall blocks 610 and tail blocks 640.

FIGS. 43A-43D depict various top plan, perspective, and front and side elevation views of a wall block 610 connected to a tail block 640, in accordance with embodiments of the disclosure. FIGS. 44A-44J depict various perspective, plan and elevation views of the wall block 610, in accordance with embodiments of the disclosure. FIGS. 45A-45J depict various perspective, plan and elevation views of the tail block 640, in accordance with embodiments of the disclosure.

FIGS. 43-46 may include elements that have been previously described with respect to FIGS. 25-33. Some of those elements have not been specifically identified in FIGS. 43-46 in the interest of clarity and brevity, and operation of the common elements is as previously described. Consequently, a detailed description of the operation of these particular elements will not be repeated in the interest of brevity.

FIGS. 43A-43D identify detailed elements of the wall blocks 610 and the tail blocks 640 using reference numbers. Many of those reference numbers are not repeated in FIGS. 44-46 in the interest of clarity and brevity. One of skill in the art would appreciate that those common elements exist as described with reference to FIGS. 43A-43D.

The wall blocks (or base units) 610 and the tail blocks (tail units) 640 may be similar to the wall blocks 410 and tail blocks 440 of FIGS. 25-33, with differences in a connection system at the rear portion 614 of the wall block 610 and at the front portion 642 of the tail block 640.

In some examples, the front portion 642 of the tail blocks 640 may connect to the wall blocks 610 (or to another tail block 640) using a connection system that includes a slot (or channel) 682 formed in the rear portion 614 of the wall block 610, a slot (or channel) 681 formed in the rear portion 642 of the tail block 640, and a connector 680. For example, the tail block 440 may connect to the wall block 410 (or to another tail block 440) using a vertical (e.g., extending from an as-installed, top side to a bottom side of the wall block 410) connector 680 that slides down into the slot 681 of the tail block 640 and the slot 682 of the wall block 610. The slot or channel 682 may extend through the rear side 622 of the rear portion 614 of the wall block 610 and the slot or channel 681 may extend through the first end 650 of the front portion 642 of the tail block 640.

In some examples, the female dovetail connector 451 of the tail block 440 of FIGS. 25-33 may be replaced with a rectangular shape 651. In other examples, the same female dovetail connection may be implemented. In some examples, the rear portion 644 of the tail block 640 may include slots 683 to form a part of a connection system to connect to another tail block (similar to connection of the wall block 610 to the tail block 640 using the slots 681, 682 and the connector 680).

FIGS. 46A-46J depict various perspective, plan and elevation views of a connector 680, in accordance with embodiments of the disclosure. The connector 680 may include two opposing shafts 684 connected by a bridge portion 686 that is narrower than the opposing shafts 684.

The slots 681 and 682 may extend from a bottom side to a top side of the tail block 640 and wall block 610, respectively. The slots 681 and 682 are configured to align with one another when the front portion 642 of the tail block 640 is abutted against the rear portion 614 of the wall block 610, and are sized to receive the opposing shafts 684 of the connector 680, which may secure the tail block 640 to the wall block 610. The shape of the slots 681 and 682 may be square, triangular, circular, ovate, etc.

The shape of the opposing shafts 684 on the connector 680 may match a shape of the slots 681 and 682, in some examples. In other examples, the shape of the opposing shafts 684 on the connector 680 may be different than the slots 681 and 682.

The connection system using the connector 680 and the slots 681 and 682 depicted in FIGS. 43-46 is exemplary. It is appreciated that the connection system could be modified to include more or fewer than two connection points without departing from the scope of the disclosure. It is also appreciated that the embodiments depicted in FIGS. 1-24 and FIGS. 34-42 could also be modified to implement a connection system similar to the example shown in FIGS. 43-46 without departing from the scope of the disclosure.

FIGS. 47-60 depict seventh embodiments of a segmented wall system 700 with tail blocks with inter-course or inter-layer lug connections, in accordance with the present disclosure. The segmented wall systems 700 of FIGS. 47-60 may be formed using a combination of wall blocks 710 and tail blocks 740. The wall blocks 710 and the tail blocks 740 of FIGS. 47-60 include many similar features as the wall blocks 110 and tail blocks 140 of FIGS. 1-7. Many of those reference numbers are not repeated in FIGS. 47-60 in the interest of clarity and brevity. One of skill in the art would appreciate that those common elements exist as described with reference to FIGS. 47-60.

FIGS. 47A-47D depict examples of various top plan, perspective, and front and side elevation views of part of a course or layer of wall blocks 710 connected to tail blocks 740, with an additional tail block 740' between the two tail blocks 740, in accordance with embodiments of the disclosure. FIGS. 48-52 depict different segmented wall shapes with various arrangements of the wall blocks 710 and tail blocks 740 (and corner blocks 790/792), in accordance with embodiments of the disclosure.

FIGS. 53A-53J depict various perspective, plan and elevation views of the wall block 710, in accordance with embodiments of the disclosure. FIGS. 54A-54J depict various perspective, plan and elevation views of the tail block 740, in accordance with embodiments of the disclosure. FIGS. 55A-55J depict various perspective, plan and elevation views of a first version of a corner block 790, in accordance with embodiments of the disclosure. FIGS. 56A-56J depict various perspective, plan and elevation views of a second version of a corner block 792, in accordance with embodiments of the disclosure.

FIGS. 57-59 depict different segmented wall shapes with various arrangements of the wall blocks 710 and tail blocks 740 and capped with a cap block 794, in accordance with embodiments of the disclosure. FIGS. 60A-60J depict various perspective, plan and elevation views of the cap block 794, in accordance with embodiments of the disclosure.

The wall blocks (or base units) 710 may each have a uniform size and shape, and the tail blocks (tail units) 740 may each have a uniform size and shape that is different than the size and shape of the wall blocks 710. In some examples, the wall blocks 710 and the tail blocks 740 may have a same, as installed, vertical height. In some examples, a length of the tail blocks 740 may the same or a greater than a length of the wall blocks 710. In some examples, a length of the tail blocks 740 may be less than a length of the wall blocks 710. The wall blocks 710 and the tail blocks 740 may be made of a rugged, weather resistant material, such as pre-cast concrete (e.g., dry cast or wet cast). Other suitable materials are plastic, reinforced fibers, wood, metal and stone.

In some examples, the wall block 710 may include at least one opening 774 formed between a front portion having the front side and a rear portion having the rear side, with opposing neck portions extending between the front portion and the rear portion on opposing sides of the opening. The outer surfaces of the opposing neck portions may form opposing sides of the wall block 710. A top and bottom of the wall block 710 may include a flat surface to facilitate stacking of other wall blocks on top of one another. However, in order to connect courses or layers of wall blocks together, each wall block may include a pair of engagement protrusions (e.g., lugs) 776 and 778 protruding from the top of the wall block 710.

The pair of lugs 776 and 778 protruding from the top of the wall block 710 may be horizontally aligned with the rear of the aperture and may be positioned on an outside edge of the wall block near where the rear portion meets the neck portions. The pair of lugs 776 and 778 may be configured to interface with the rear face of the aperture of a wall block 710 stacked on top of the wall block 710. Furthermore, the pair of lugs 776 and 778 may be offset from the rear face of the aperture 774, so as to result in a staggered incline as successive courses or layers of wall blocks 710 are formed.

In some examples, the front portion of the tail blocks 740 may connect to the wall blocks 710 (or to another tail block 740) using a connection system formed in the wall block 710 and the tail block 740, respectively. For example, the tail block 740 may connect to the wall block 710 (or to another tail block 740) using a vertical (e.g., extending from an as-installed, top side to a bottom side of the wall block 710) dovetail connection.

As shown in FIGS. 48-52, different courses or layers 760, 762 and 764 of a segmented wall 700 may include linear shapes, non-linear shapes, or combinations thereof formed using the wall blocks 710 and the tail blocks 740 in accordance with embodiments of the disclosure. FIGS. 48A-48D depict a portion of a curved (e.g., concave) segmented wall 700, with part of two courses 760, 762, 764 with a setback. The courses or layers 760, 762, 764 may include at least one respective tail block 740 attached to (e.g., interlocked with) with a rear side of one or more of the respective set of wall blocks 710.

The curvature of the wall 700 in FIGS. 48A-48D may be uniform and have a radius and an angle from a center of a wall block 710 to a space between the wall blocks 710. With the angle depicted between the centers of the wall blocks 710, an additional tail block 740' not connected to any wall blocks 710 may be interleaved between tail blocks 740 attached to the wall blocks 710 to provide lateral support between the tail blocks 740. The interleaved tail block 740' may provide vertical support for the tail block 740 placed on top in the course or layer 762.

Also as shown in FIGS. 48A-48D, the aperture 774 of the wall block 710 in the upper course or layer 762 may engage with the lug 778 of the left wall block 710 of the lower course or layer 760 and may engage with the lug 776 of the right wall block 710 of the lower course or layer 760. That is, the wall block 710 of the upper course or layer 760 may be positioned such that the rear face of the aperture 774 engages with the lugs 778 and 776 of the wall blocks of the lower course of layer 760, which prevents the wall block 710 in the upper course or layer 762 from moving forward.

FIGS. 49A-49D depict a portion of a straight or linear segmented wall 700, with part of two courses 760, 762 with a setback. In some examples, the straight/linear shape of the segmented wall 700 may cause a neck portion of a tail block 740 of the course or layer 762 to at least partially overlap in a vertical direction with a neck portion of a tail block 740 of the course or layer 760 to form a column of vertically supported neck portions.

Similar to FIGS. 48A-49D, as shown in FIGS. 49A-49D, the aperture 774 of the wall block 710 in the upper course or layer 762 may engage with the lug 778 of the left wall block 710 of the lower course or layer 760 and may engage with the lug 776 of the right wall block 710 of the lower course or layer 760. That is, the wall block 710 of the upper course or layer 760 may be positioned such that the rear face of the aperture 774 engages with the lugs 778 and 776 of the wall blocks of the lower course of layer 760, which prevents the wall block 710 in the upper course or layer 762 from moving forward.

FIGS. 50A-50D depicts a portion of a curved (e.g., convex) segmented wall 700 with part of two courses 760, 762. The courses or layers 760, 762 may include at least one respective tail block 740 attached to (e.g., interlocked with) with a rear side of one or more of the respective set of wall blocks 710. The curvature of the wall 700 in FIGS. 50A-50D may be uniform, having a respective radius and a respective angle between opposing edges of a wall block 710.

Figure 51B:
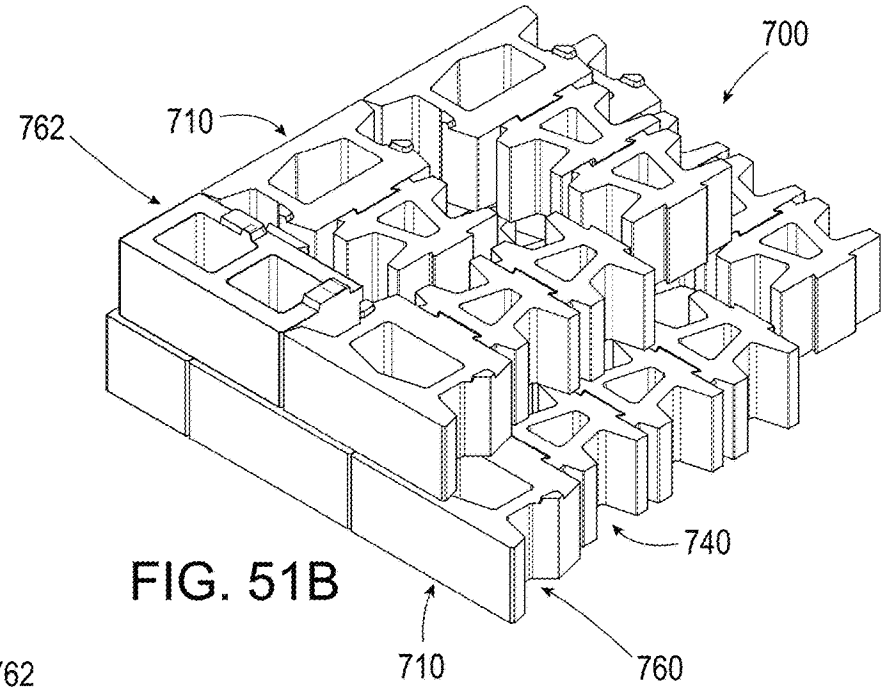
Figure 51A:
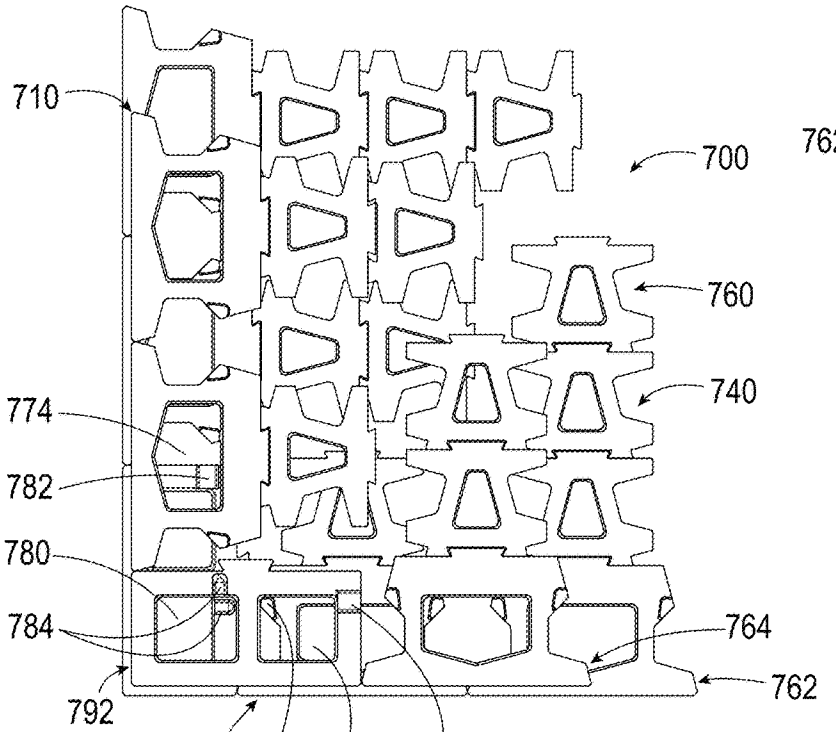
Figure 51C:
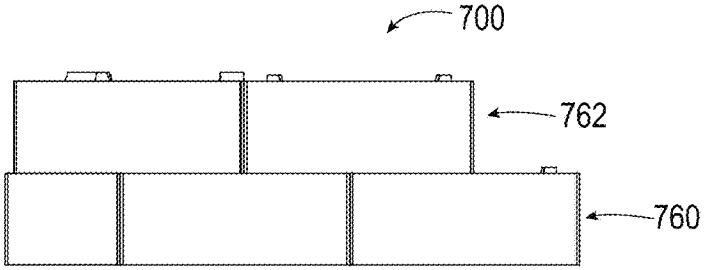

FIGS. 51A-51C depict a portion of a 90-degree outer corner segmented wall 700, with part of two courses 760, 762. The courses or layers 760, 762 may include at least one respective tail block 740 attached to (e.g., interlocked with) with a rear side of one or more of the respective set of wall blocks 710 in an alternating fashion between adjoining sides of the segmented wall 700, with corner block 790 included in the adjoining corner of the wall in the upper course or layer 762 in a first orientation and corner block 792 included in the adjoining corner of the wall in the top course or layer 764 in a second orientation. For example, the corner block 792 may be positioned such that the long side is aligned with a first one of the adjoining walls and the corner block 790 may be positioned such that the long side is aligned with a second one of the adjoining walls.

The corner blocks 790 and 792 may include a pair of apertures 780 and 781 separated by a middle neck portion. In addition, the corner blocks 790 and 792 may include engagement protrusions (lugs) 782 and 784 protruding from the tops of the corner blocks 790 and 792. When place side-by-side, the pair of lugs 782 and 784 protruding from the top of the corner block 790 may mirror the pair of lugs 782 and 784 protruding from the top of the corner block 790. The lugs 782 protruding from the tops of the corner blocks 790 and 792 may be horizontally aligned with the rear of a respective one of the apertures 780 or 781 and may be positioned on an outside edge of the wall block near where the rear portion meets an outer neck portion. The lug 784 protruding from the tops of the corner blocks 790 and 792 may be positioned on a rear portion of the corner blocks 790 and 792 near a location where the other respective aperture 780 or 781 meets the middle neck portion.

In some examples, the pair of lugs 782 and 784 may have different sizes and shapes. The lug 784 may be configured to interface with the rear face of the aperture 774 of a wall block 710 stacked on top of the corner block 792 (e.g., as shown with respect to corner block 792). The lug 782 may be configured to interface with the rear face of the aperture 780 of the corner block 790 stacked on top of the corner block 792 (e.g., as shown with respect to corner block 792). The implementation of the corner blocks 490 and 492 in corner wall applications may improve stability of the wall by tying both adjoining walls together at the corners. As the corner blocks 790 and 792 are covered with fill material, the interlocking between courses or layers 760, 762 may be further strengthened.

Figure 52B:
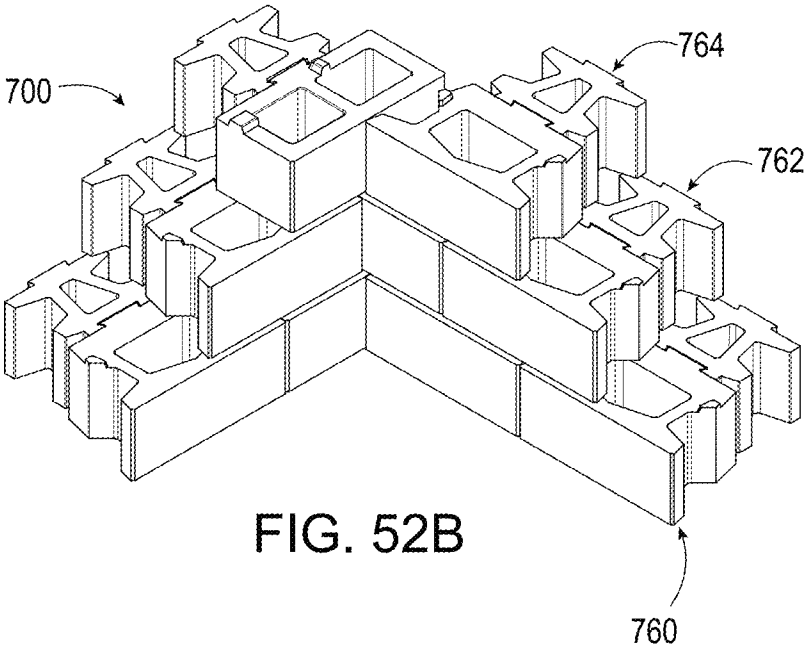
Figure 52A:
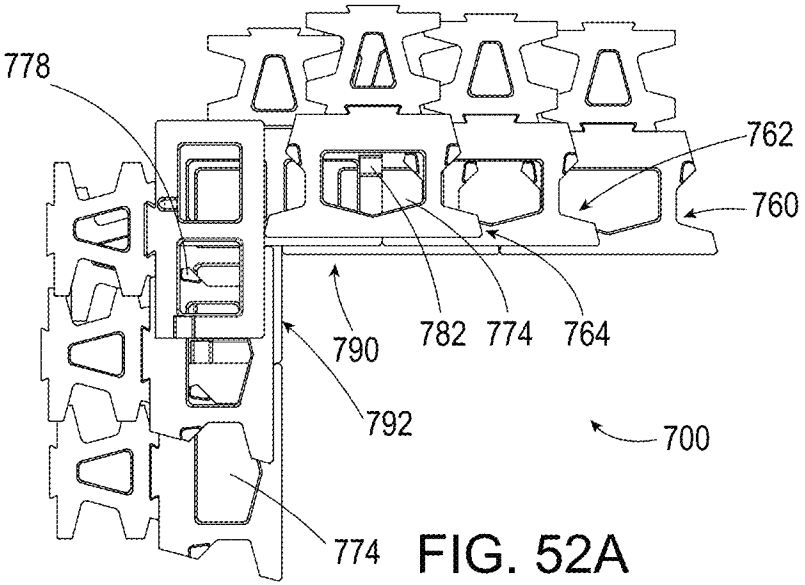
Figure 52C:
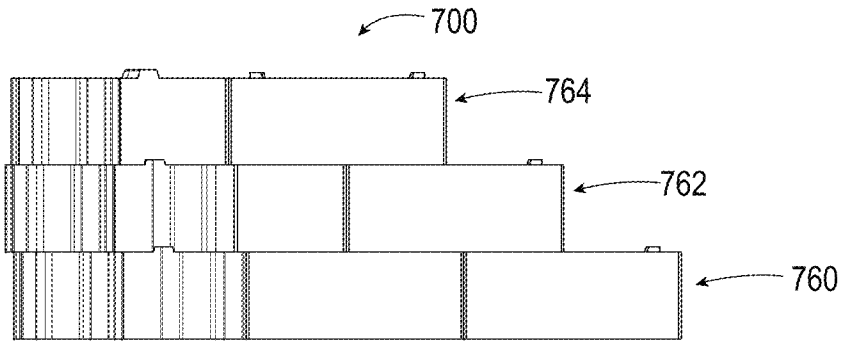
Figure 53C:
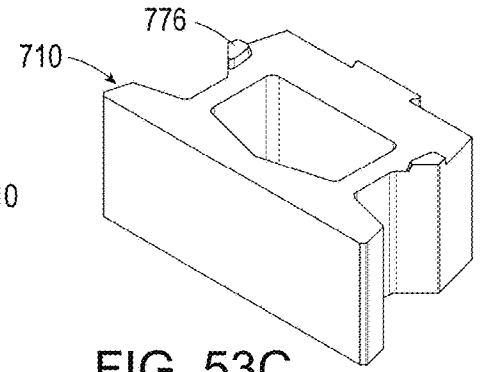
Figure 53B:
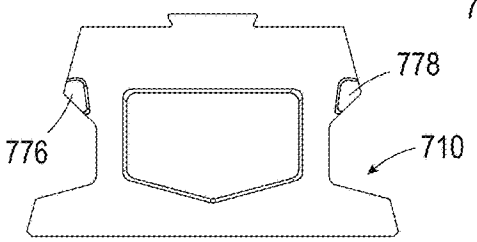
Figure 53A:
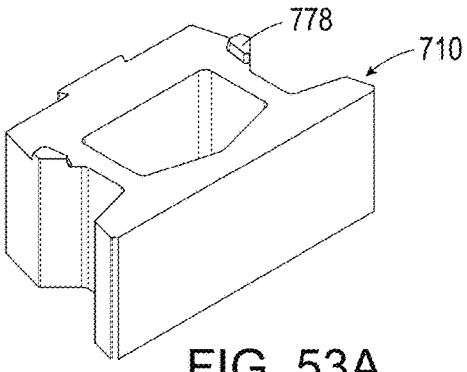
Figure 53G:
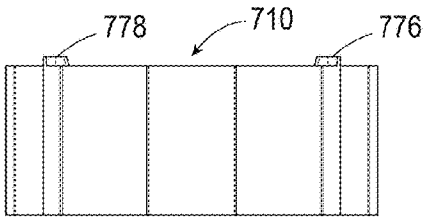
Figure 53F:
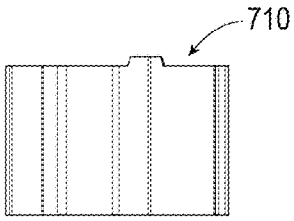
Figure 53E:
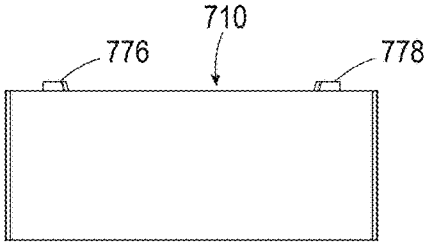
Figure 53D:
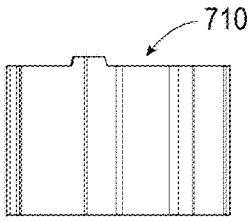
Figure 53J:
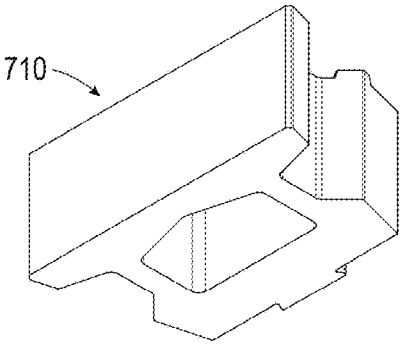
Figure 53I:
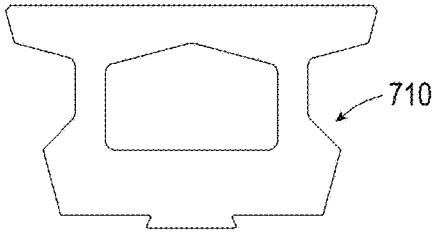
Figure 53H:
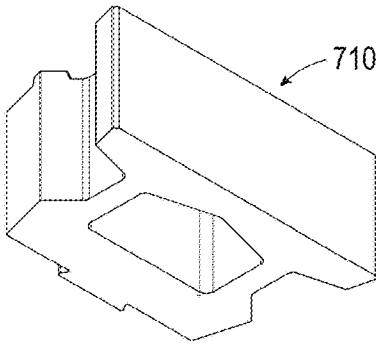
Figure 54C:
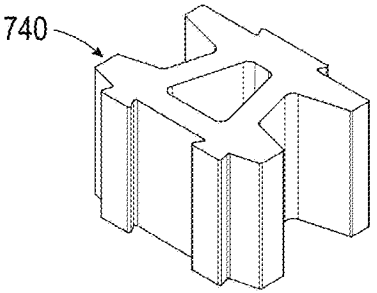
Figure 54G:
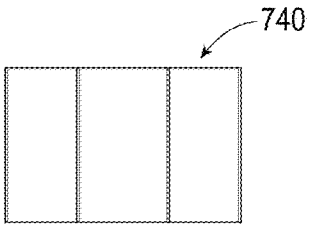
Figure 54J:
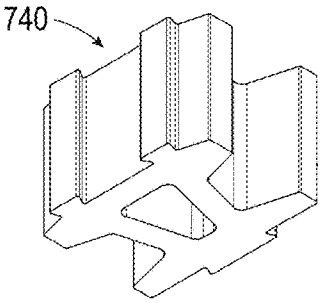
Figure 54B:
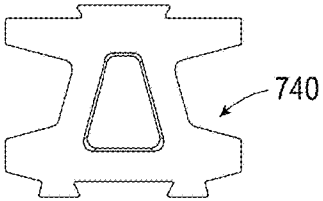
Figure 54F:
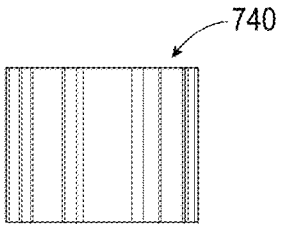
Figure 54I:
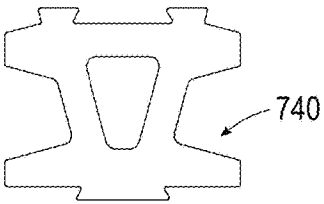
Figure 54E:
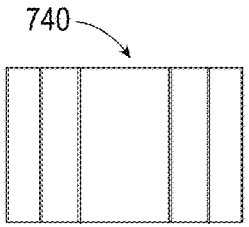
Figure 54A:
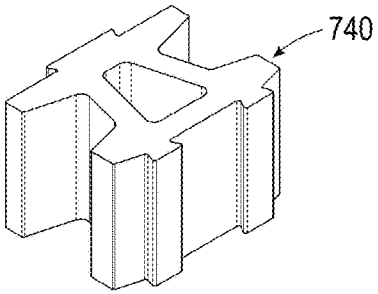
Figure 54D:
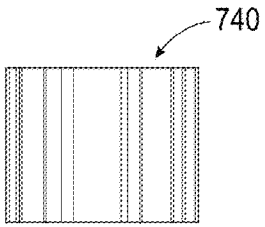
Figure 54H:
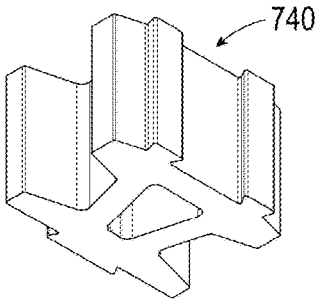
Figure 56C:
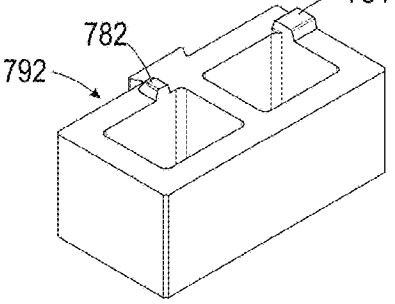
Figure 56B:
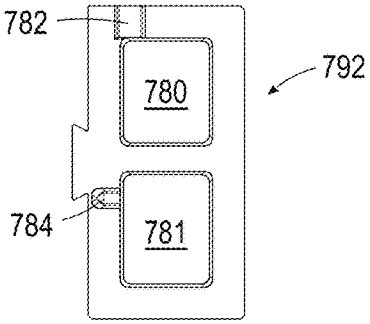
Figure 56A:
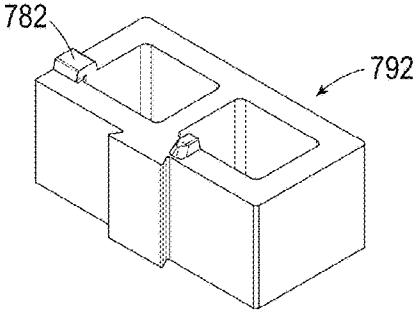
Figure 56G:
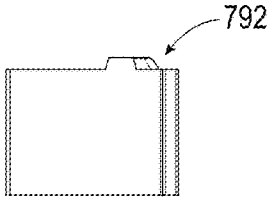
Figure 56F:
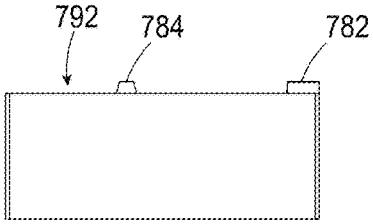
Figure 56E:
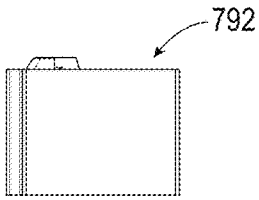
Figure 56D:
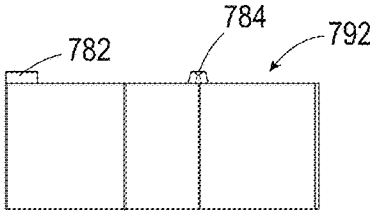
Figure 56J:
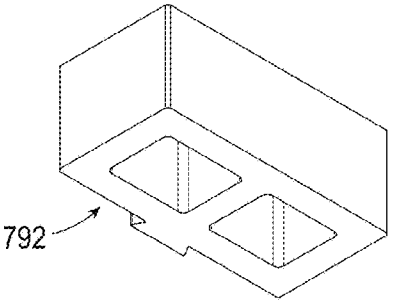
Figure 56I:
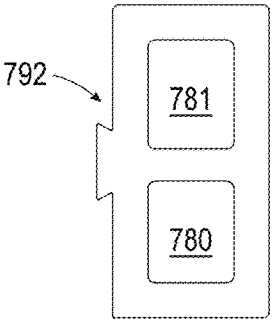
Figure 5H:
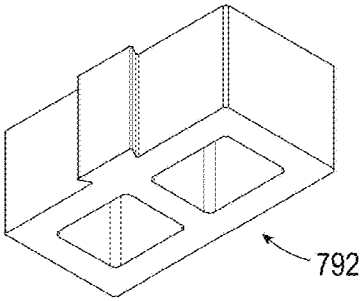

FIGS. 52A-52C depict a portion of a 90-degree inner corner segmented wall 700, with part of three courses 760, 762, 764. The courses or layers 760, 762, 764 may include at least one respective tail block 740 attached to (e.g., interlocked with) with a rear side of one or more of the respective set of wall blocks 710 in an alternating fashion between adjoining sides of the segmented wall 700, with corner block 790 included in the adjoining corner of the wall in the upper course or layer 762 in a first orientation and corner block 792 included in the adjoining corner of the wall in the top course or layer 764 in a second orientation. For example, the corner block 792 may be positioned such that the long side is aligned with a first one of the adjoining walls and the corner block 790 may be positioned such that the long side is aligned with a second one of the adjoining walls. The lugs 782 and 784 of the corner blocks 790 and 792 engage with upper course corner blocks 790 and 792 similar to the engagement described with reference to FIGS. 51A-51C.

Figure 57B:
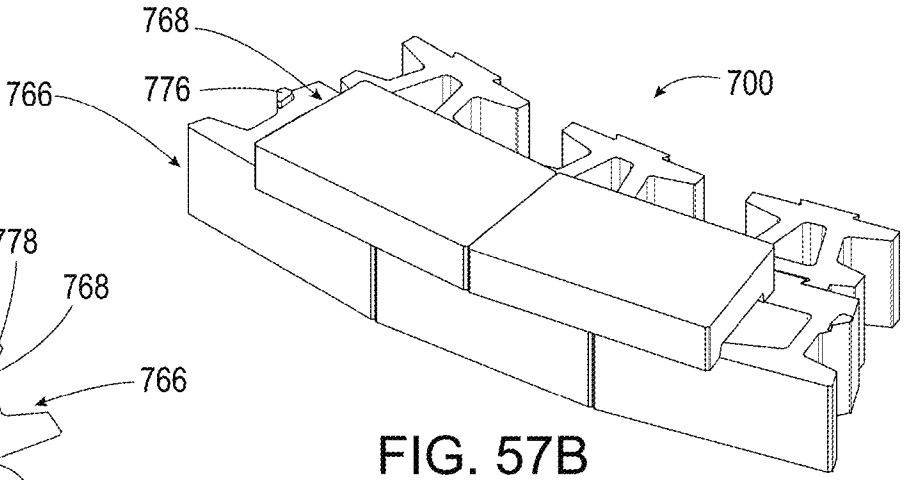
Figure 57A:
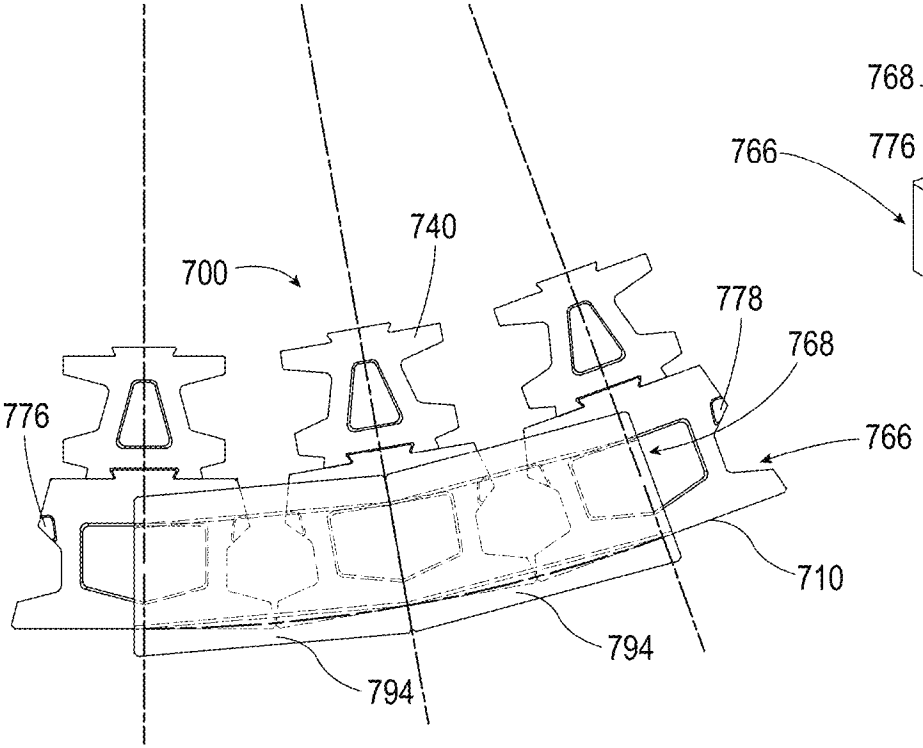
Figure 57C:
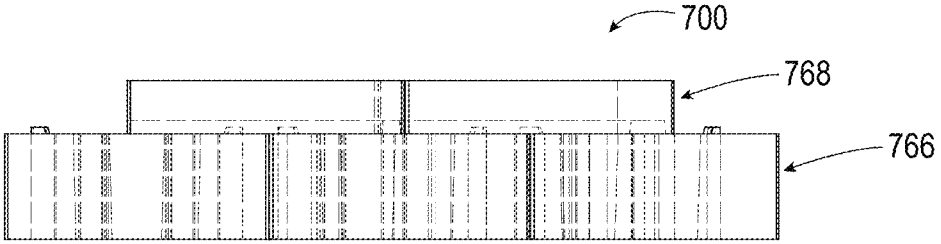

As shown in FIGS. 57-59, a top courses or layer 766 of a segmented wall 700 may be capped with a cap block course 768 of cap blocks 794. The walls 700 depicted in FIGS. 57-59 include linear shapes, non-linear shapes, or combinations thereof formed using the wall blocks 710 and the tail blocks 740 and cap blocks 794 in accordance with embodiments of the disclosure. FIGS. 57A-57C depict a portion of a curved (e.g., convex) segmented wall 700, with the top course or layer 766 is capped with a cap block layer 768.

The curvature of the wall 700 in FIGS. 57A-57C may be uniform and have a radius and an angle from a center of a wall block 710 to a space between the wall blocks 710. The cap blocks 794 may have a uniform size and shape.

In some examples, the cap blocks 794 have a smaller, as installed, vertical height than the wall blocks 710. In some examples, a length of the cap blocks 794 may the same as a length of the wall blocks 710. The cap blocks 794 may have a first longer side that is parallel with a second longer side, and two opposing shorter sides that have a non-parallel relationship from the first long side to the second longer side. The length of the first longer side is greater than a length of the second longer side, and the opposing shorter sides may have equal lengths.

A bottom side of the cap blocks 794 may include a cavity formed between the opposing shorter sides such that the height of the cap block 794 at the first and second longer sides is greater than a height at a middle of one of the opposing shorter sides. The rearward face of the cavity of the cap block 794 may be configured to engage with one or more of the pairs of lugs 776 and 778 on top of the wall blocks 710 to retain the cap block 794 in place.

Figure 58B:
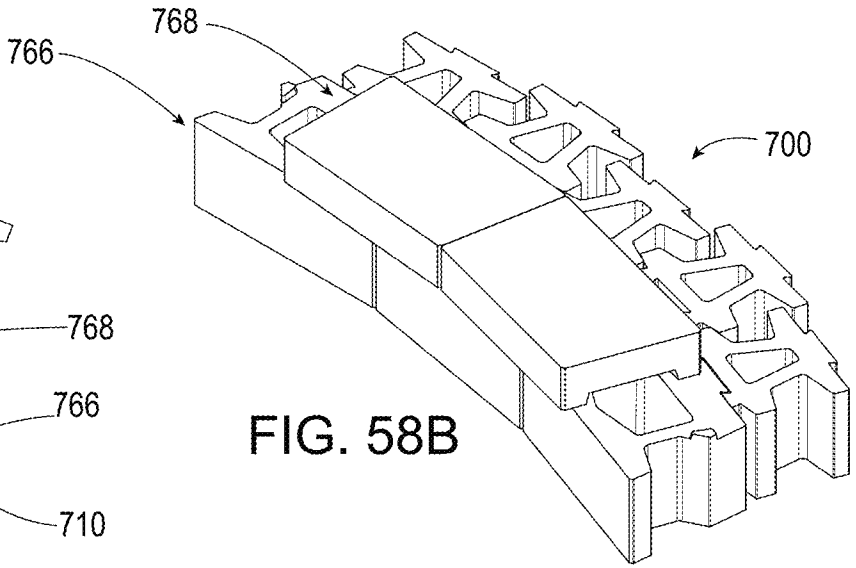
Figure 58A:
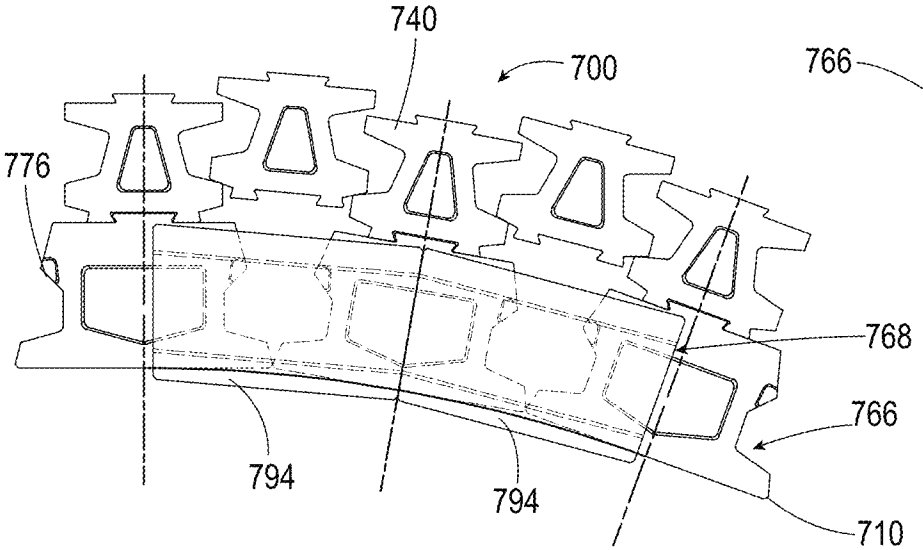
Figure 58C:
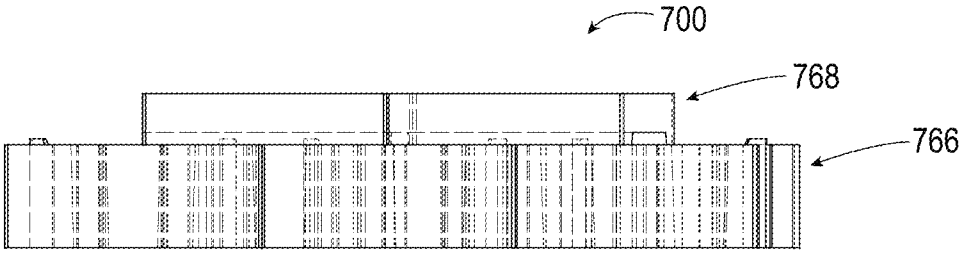
Figure 59B:
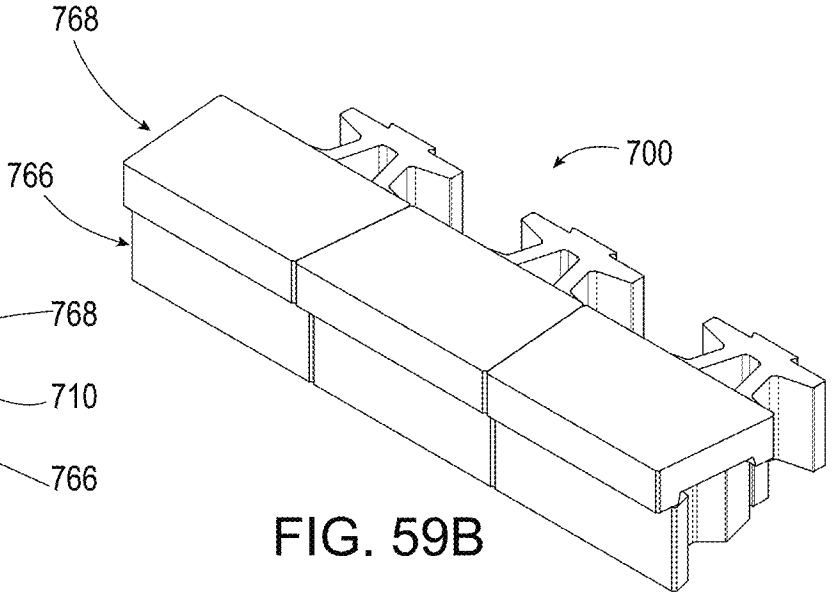
Figure 59A:
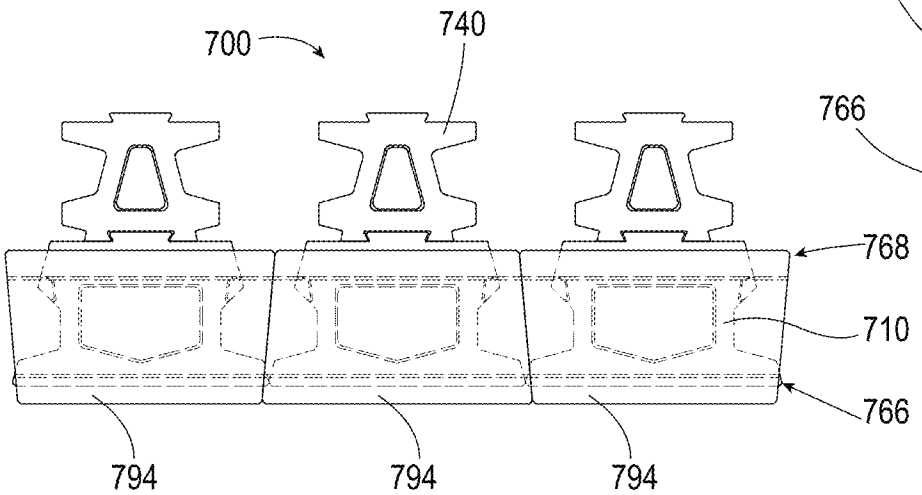
Figure 59D:
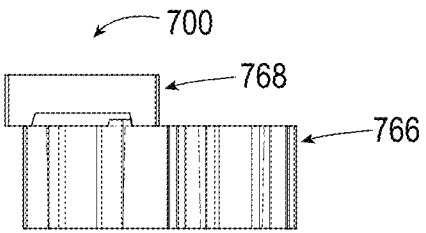
Figure 59C:
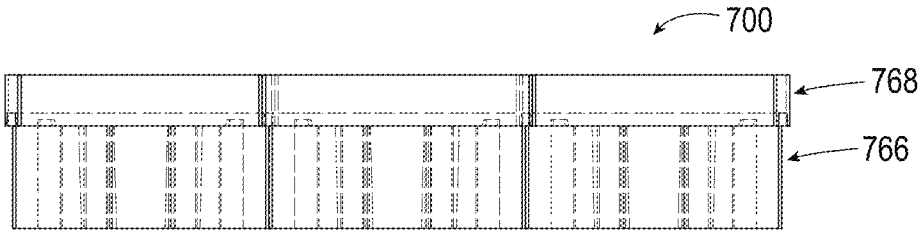
Figure 60A:
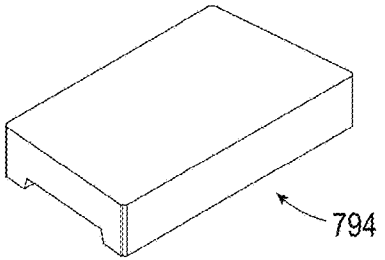
Figure 60B:
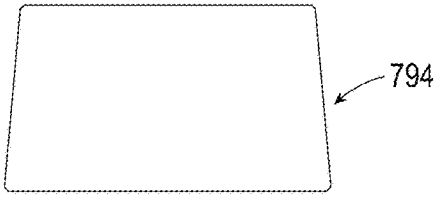
Figure 60C:
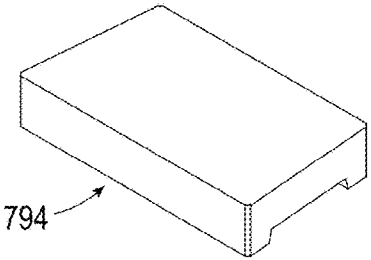
Figure 60D:
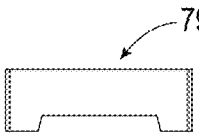
Figure 60E:
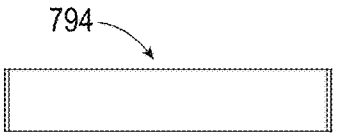
Figure 60F:
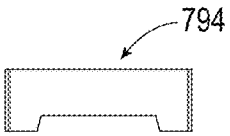
Figure 60G:
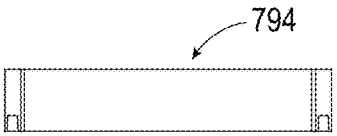
Figure 60H:
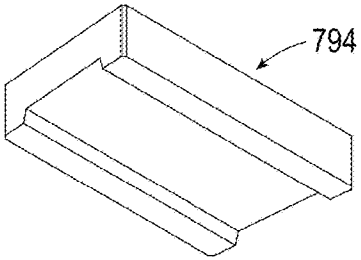
Figure 60I:
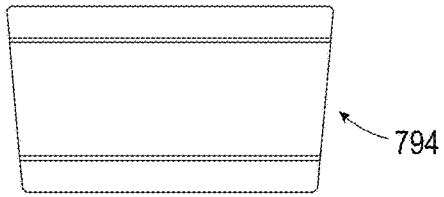
Figure 60J:
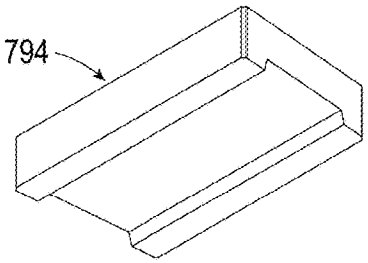
Figure 61B:
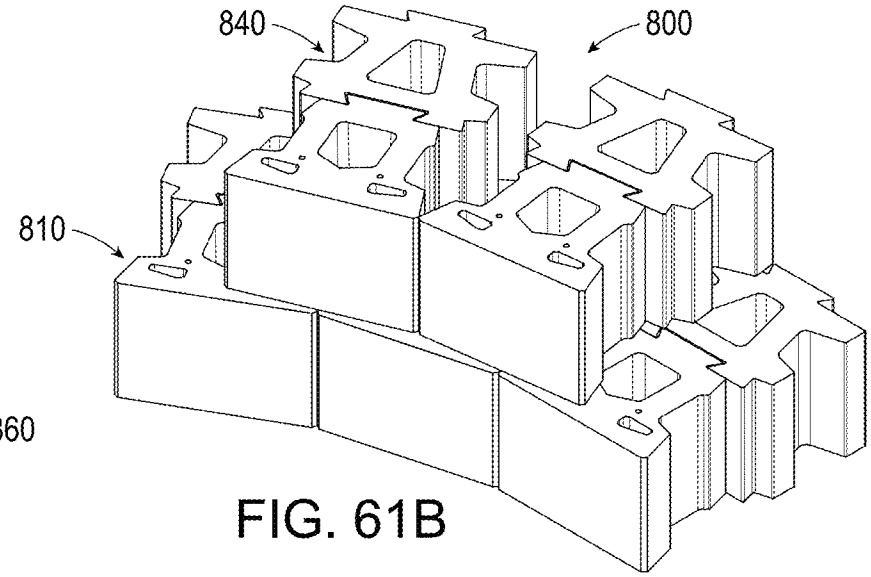
FIGS. 61-69 depict eighth embodiments of a segmented wall system with tail blocks and inter-course or inter-layer pin connections, in accordance with the present disclosure.
Figure 61D:
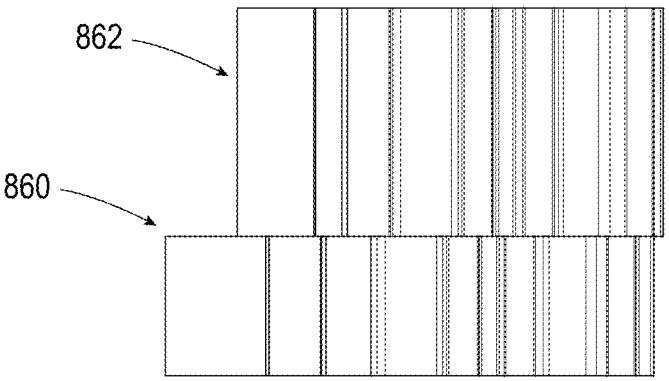
Figure 61A:
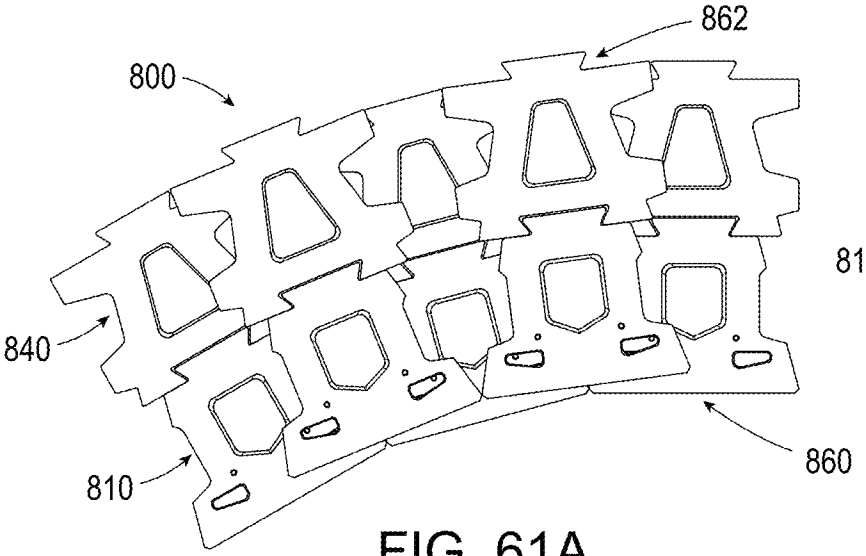
Figure 61C:
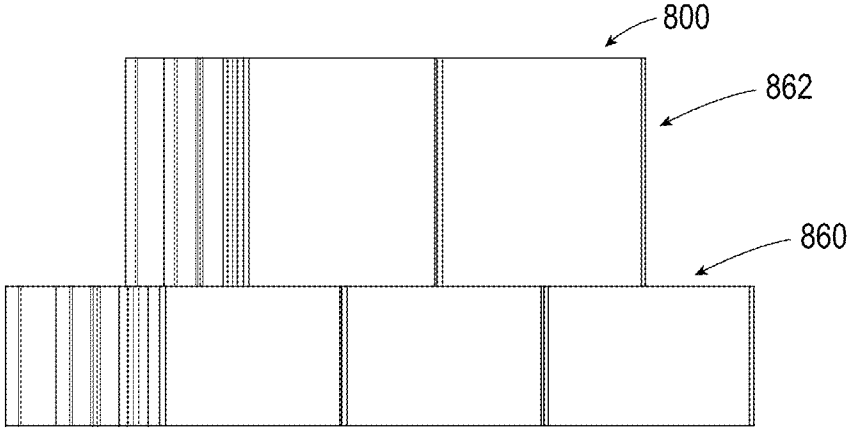
Figure 62B:
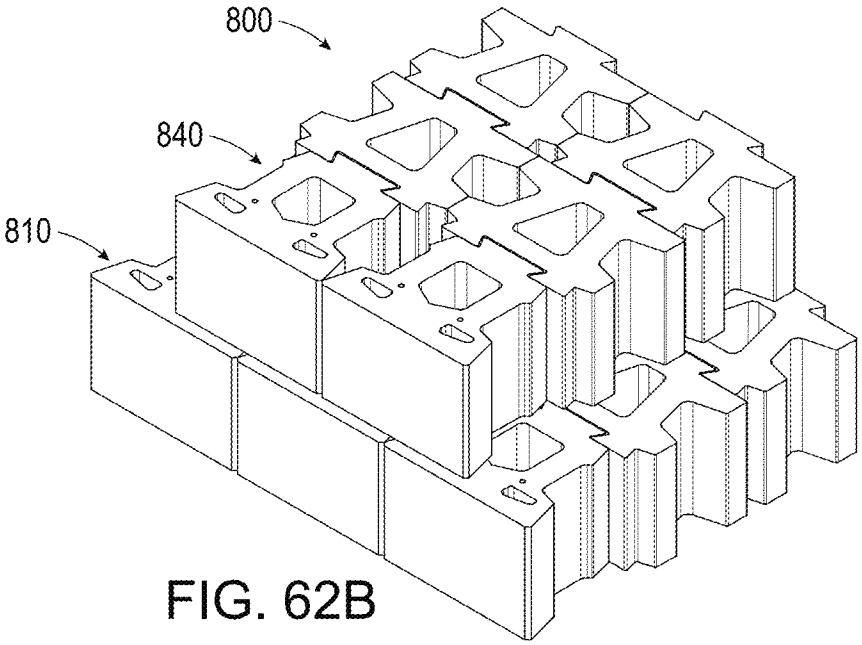
Figure 62D:
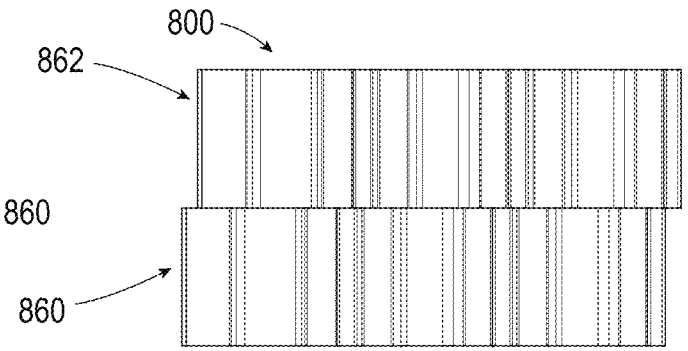
Figure 62A:
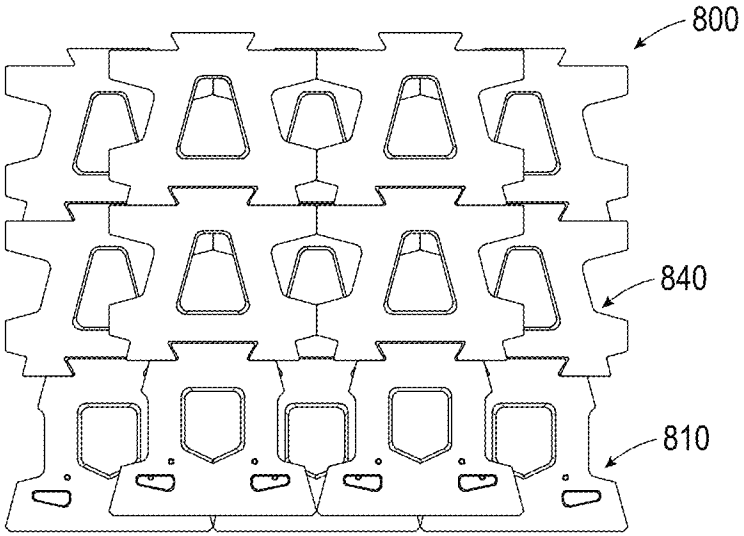
Figure 62C:
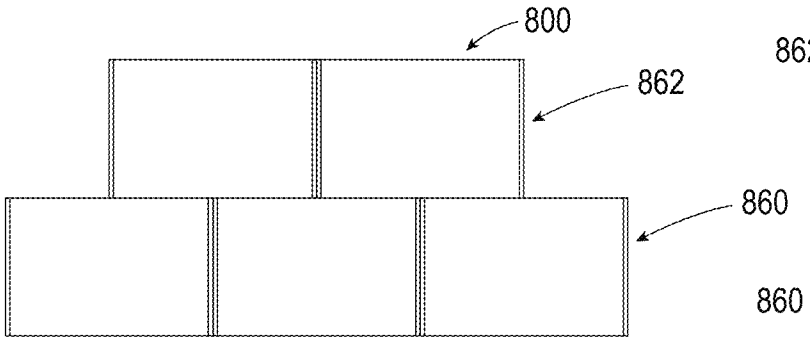
Figure 63B:
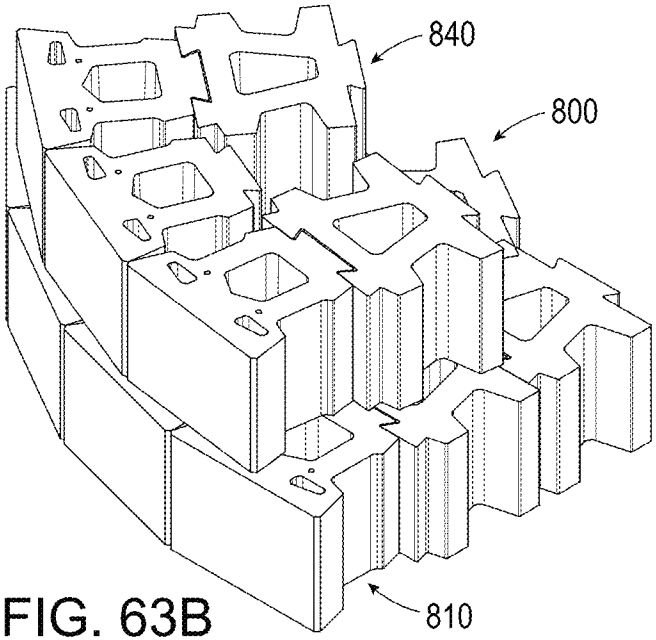
Figure 63A:
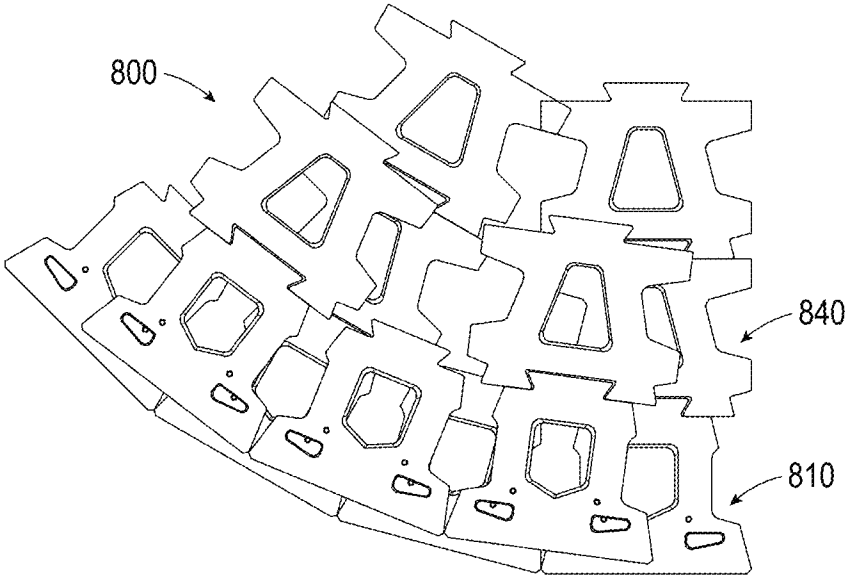
Figure 63D:
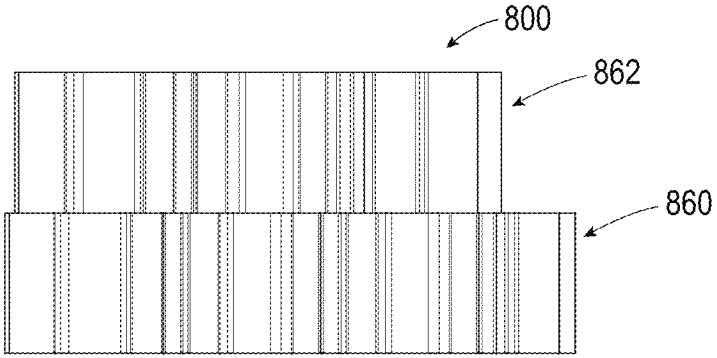
Figure 63C:
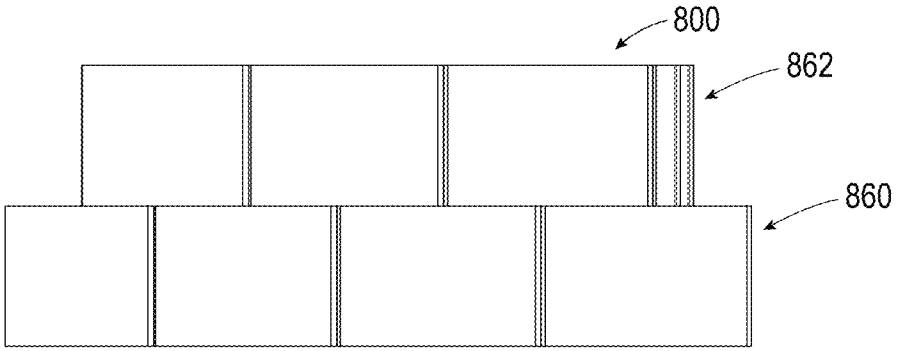
Figure 64B:
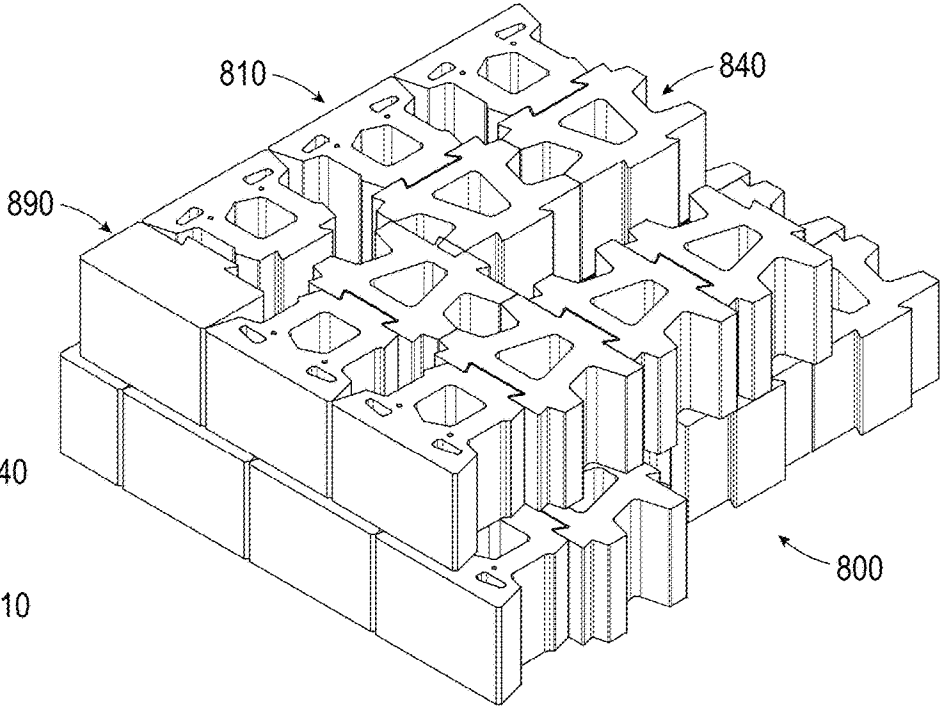
Figure 64A:
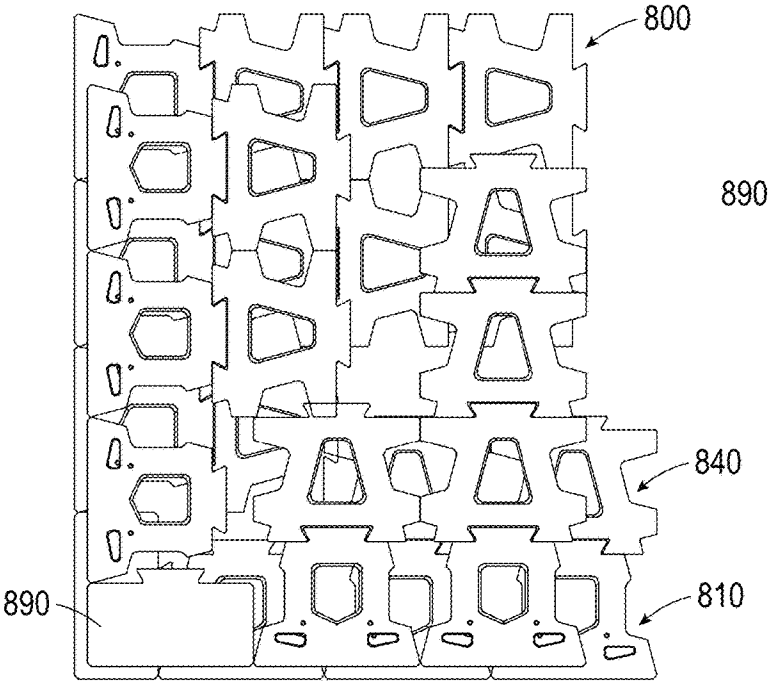
Figure 64D:
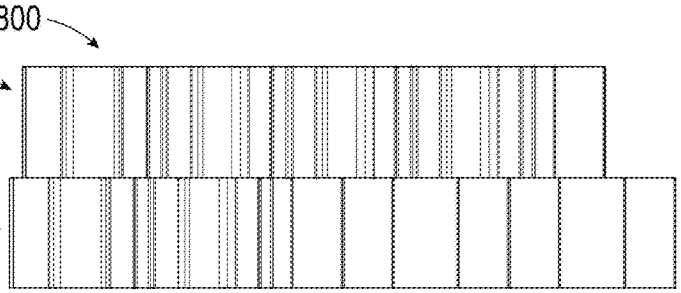
Figure 64C:
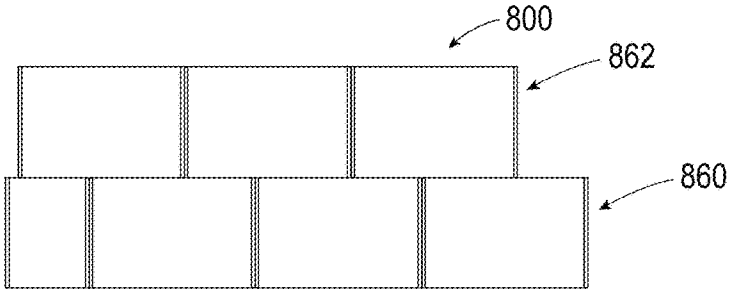
Figures 65A, 65B, 65C, 65D, 65E, 65F, 65G, 65H, 65I, 65J:
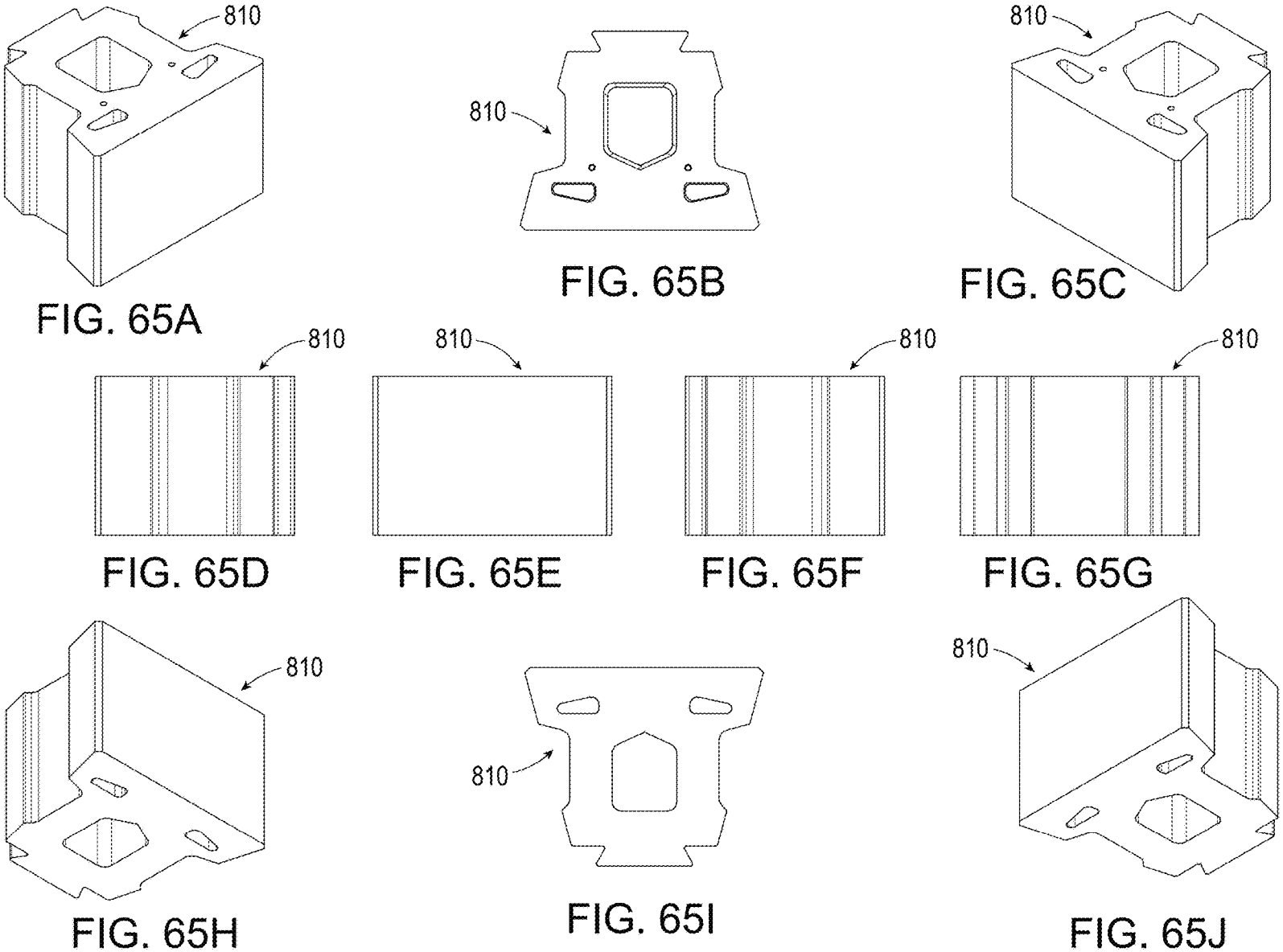
Figure 66A:
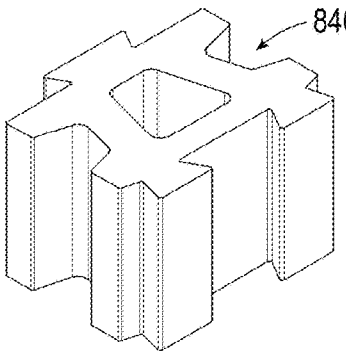
Figure 66B:
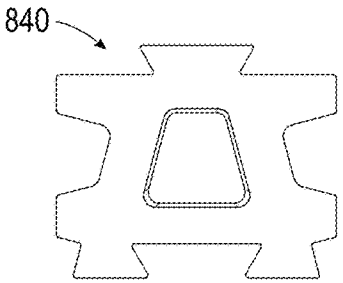
Figure 66C:
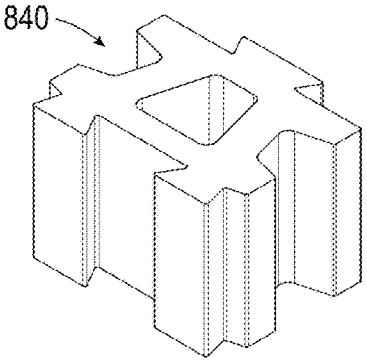
Figure 66D:
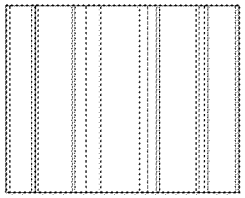
Figure 66E:
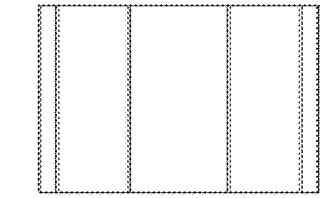
Figure 66F:
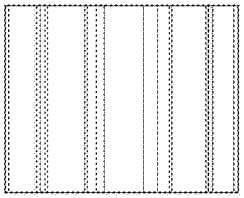
Figure 66G:
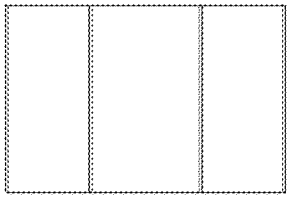
Figure 66H:
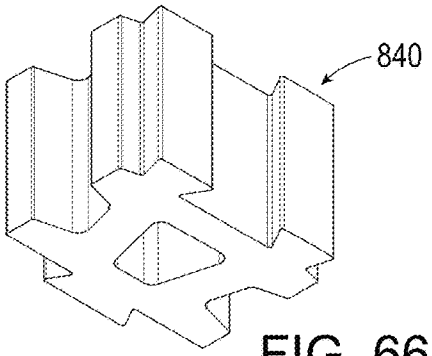
Figure 66I:
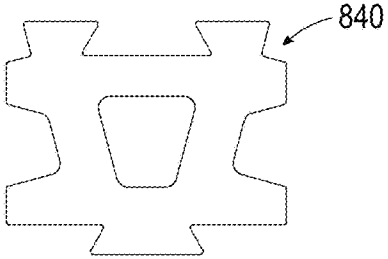
Figure 66J:
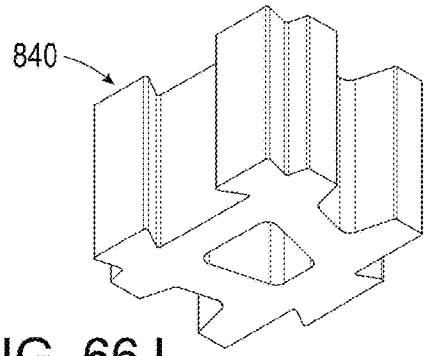
Figure 67A:
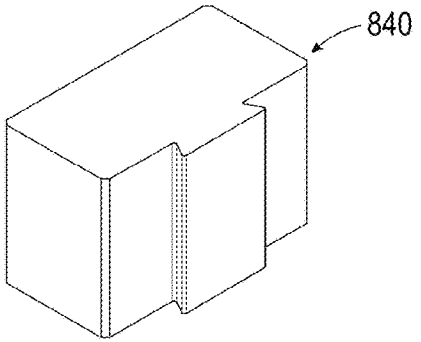
Figure 67B:
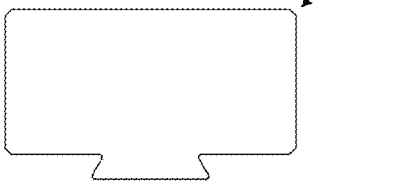
Figure 67C:
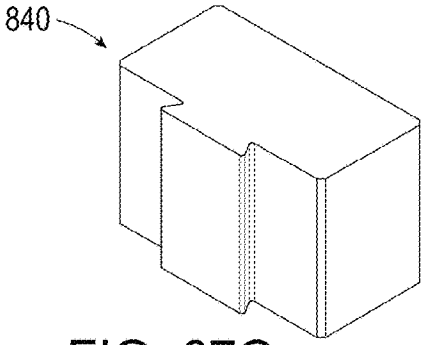
Figure 67D:
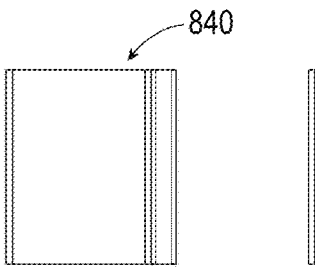
Figure 67E:
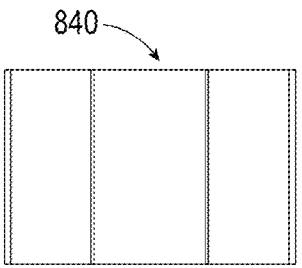
Figure 67F:
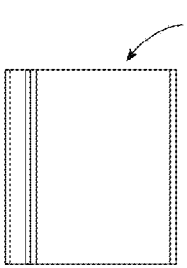
Figure 67G:
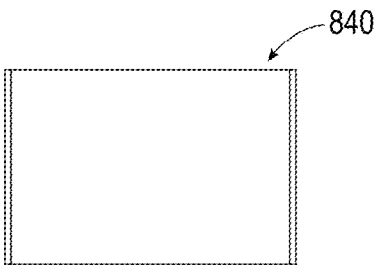
Figure 67H:
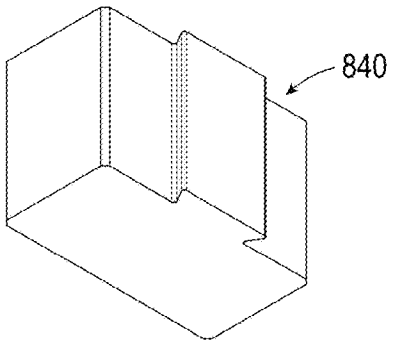
Figure 67I:
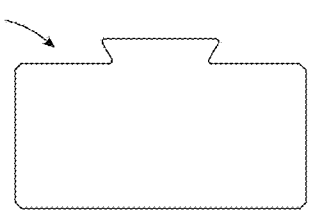
Figure 67J:
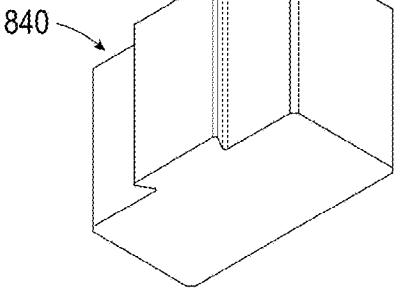
Figure 68A:
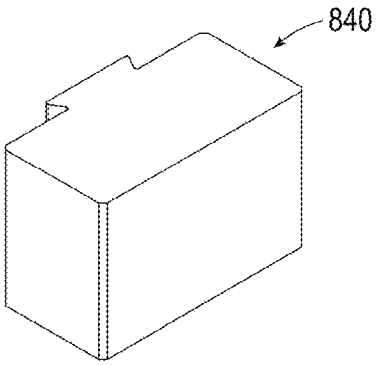
Figure 68B:
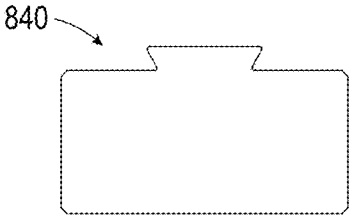
Figure 68C:
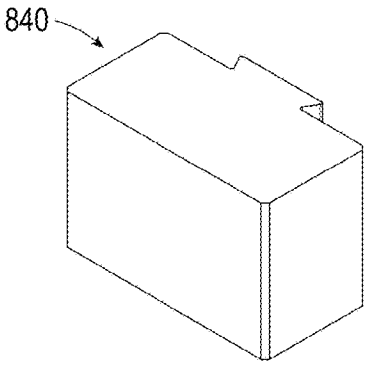
Figure 68D:
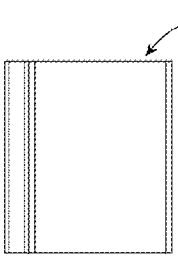
Figure 68E:
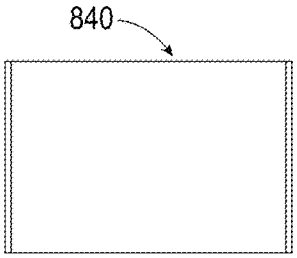
Figure 68F:
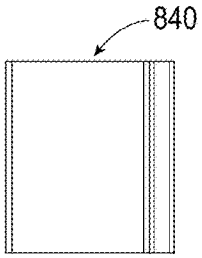
Figure 68G:
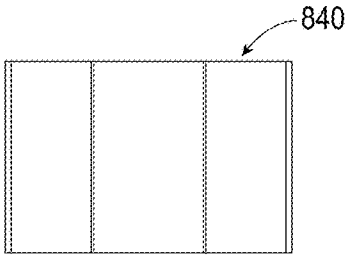
Figure 68H:
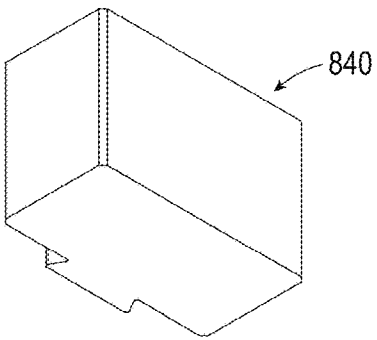
Figure 68I:
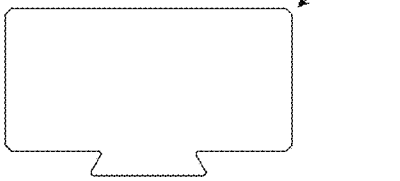
Figure 68J:
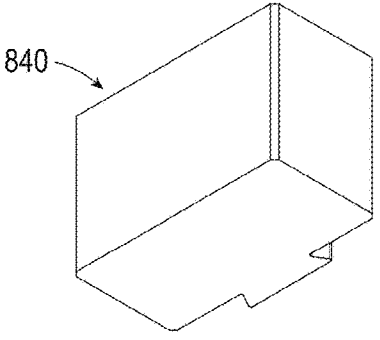
Figure 69B:
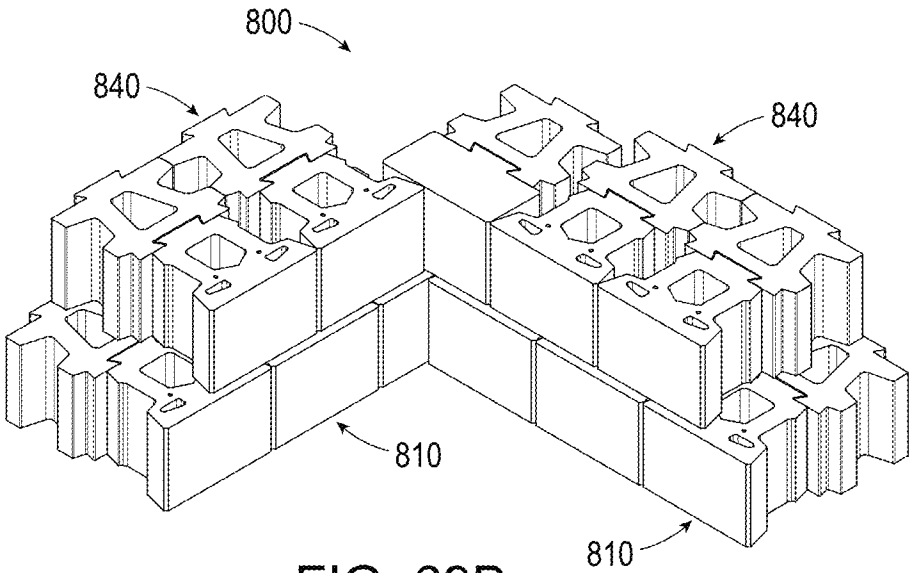
Figure 69A:
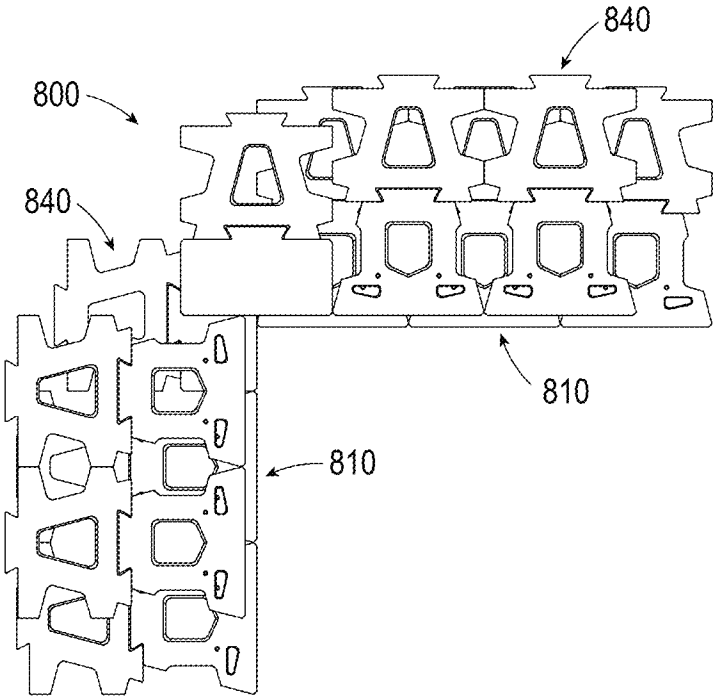
Figure 69D:
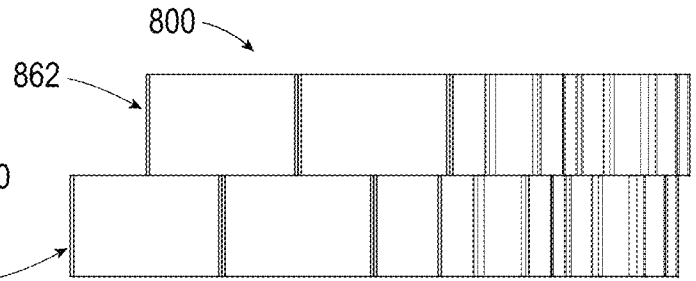
Figure 69C:
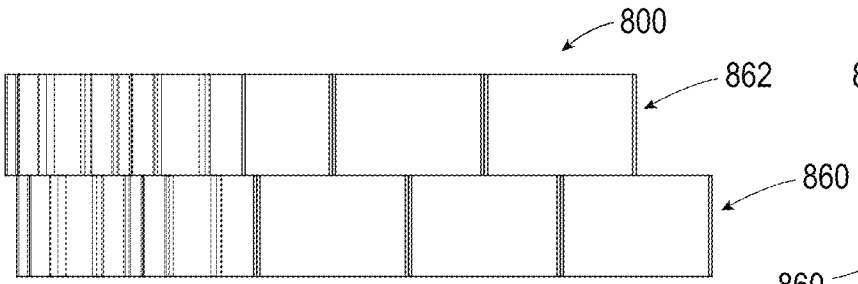
Figure 70:
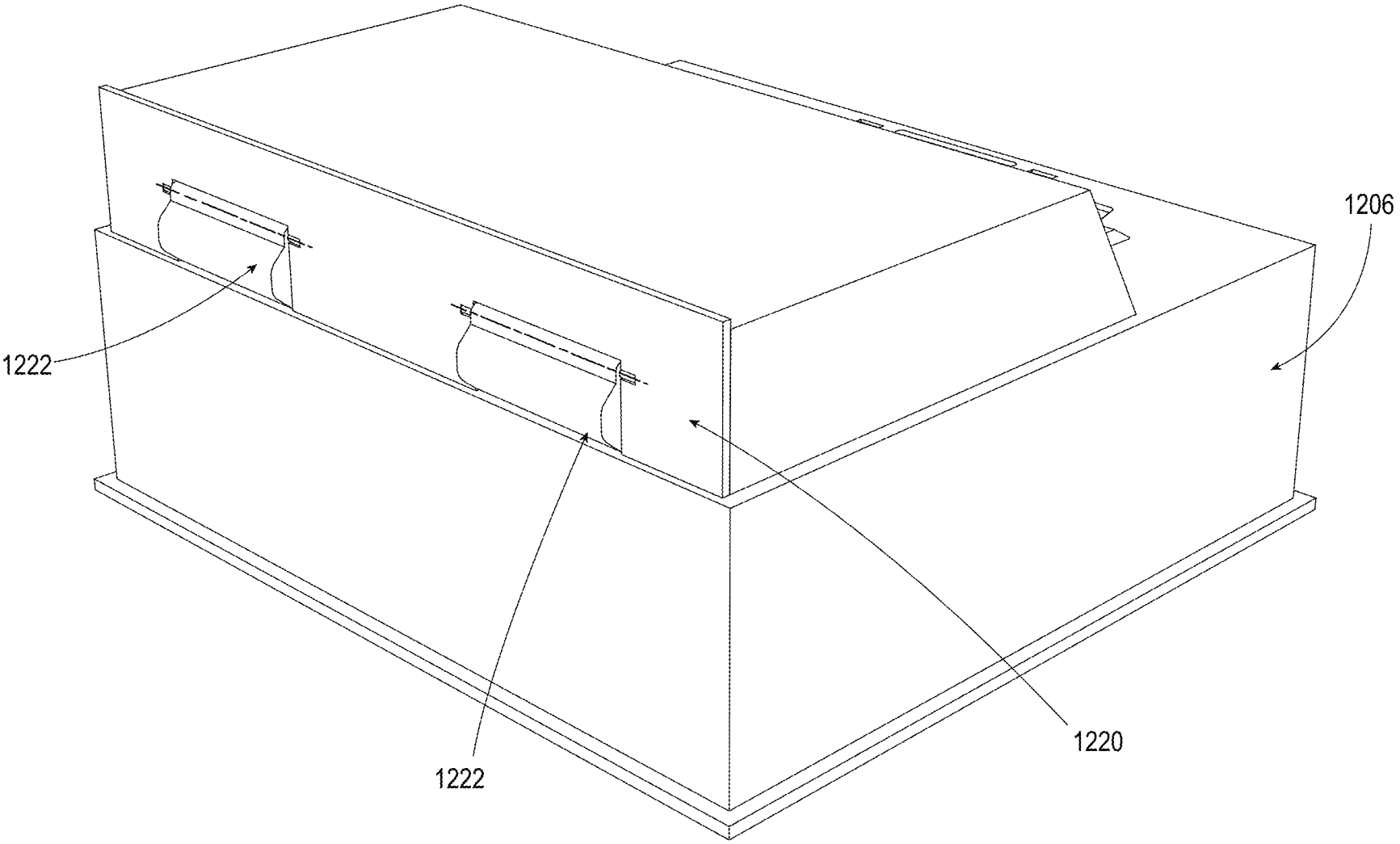
FIGS. 70-82 depict methods of manufacturing segmented wall blocks with lugs, in accordance with the present disclosure.
Figure 71:
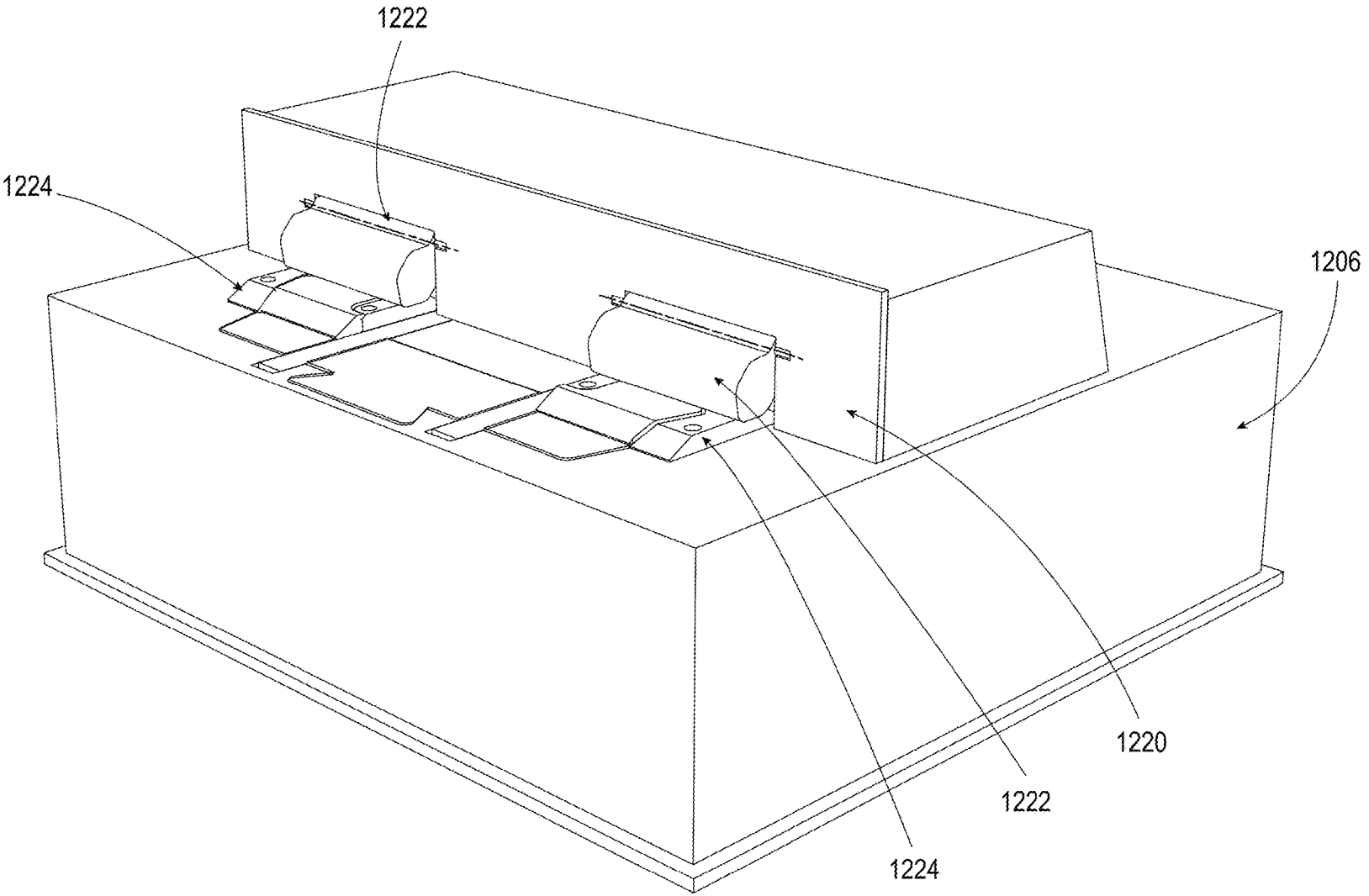
Figure 72:
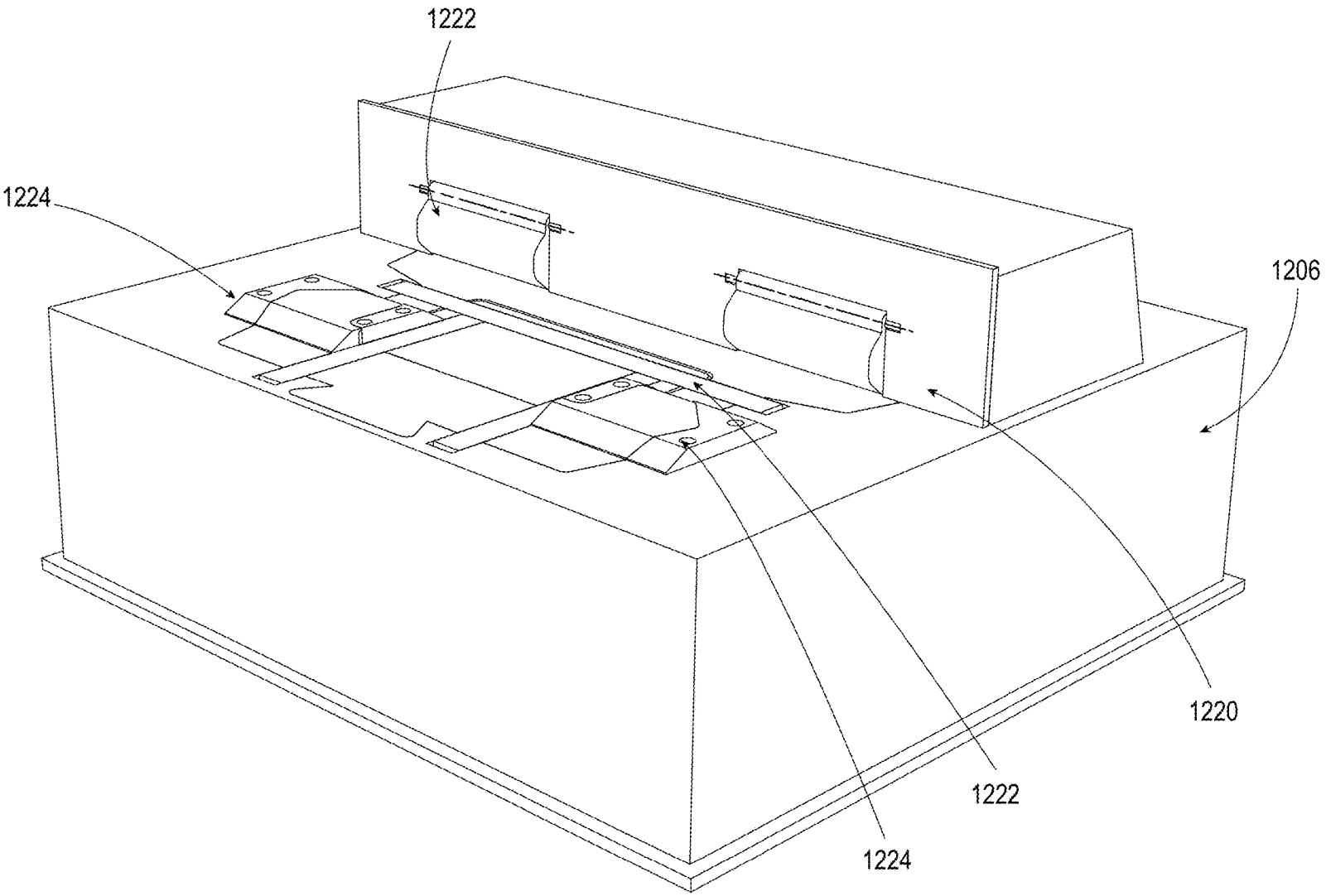
Figure 73:
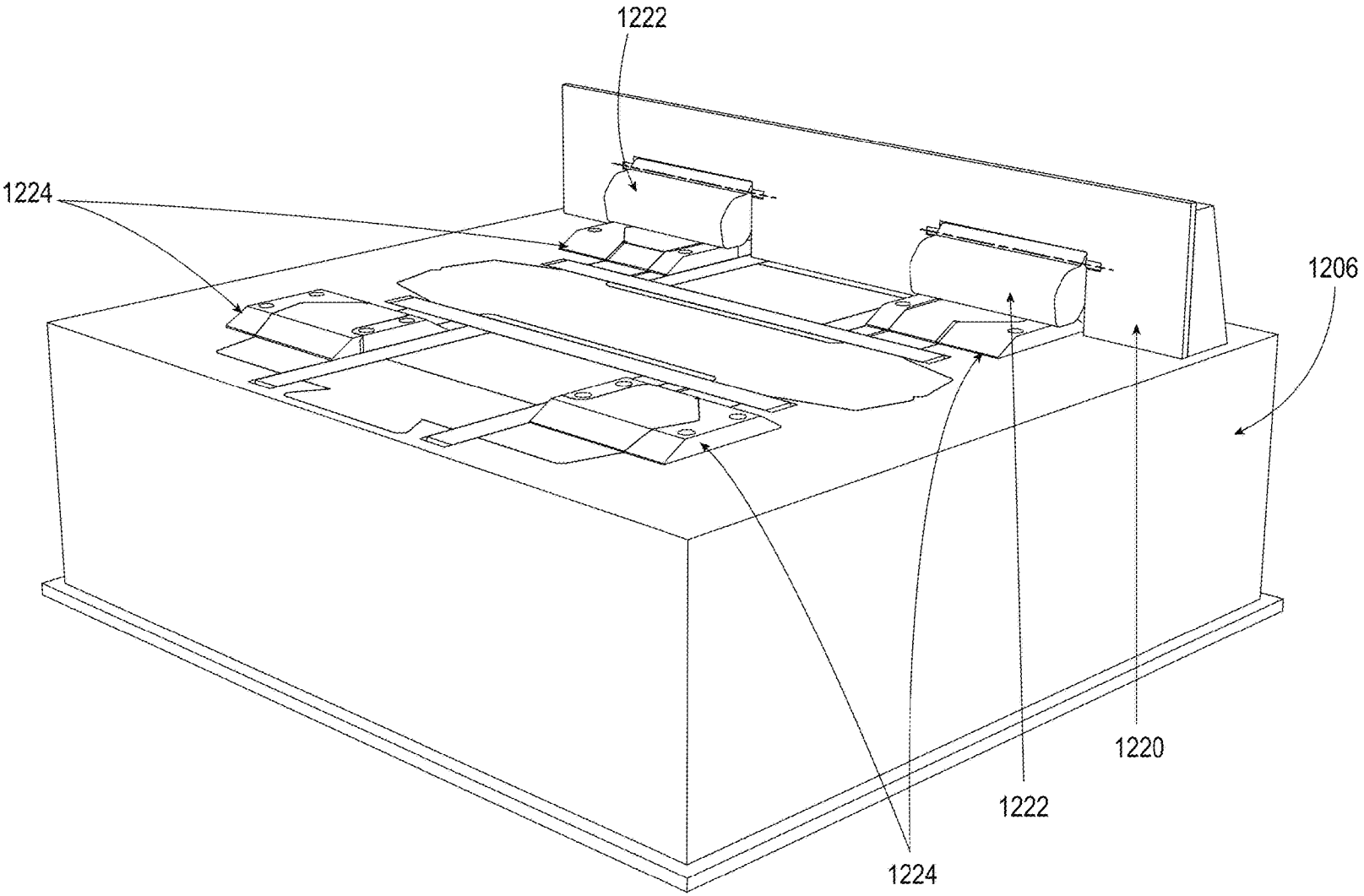
Figure 74:
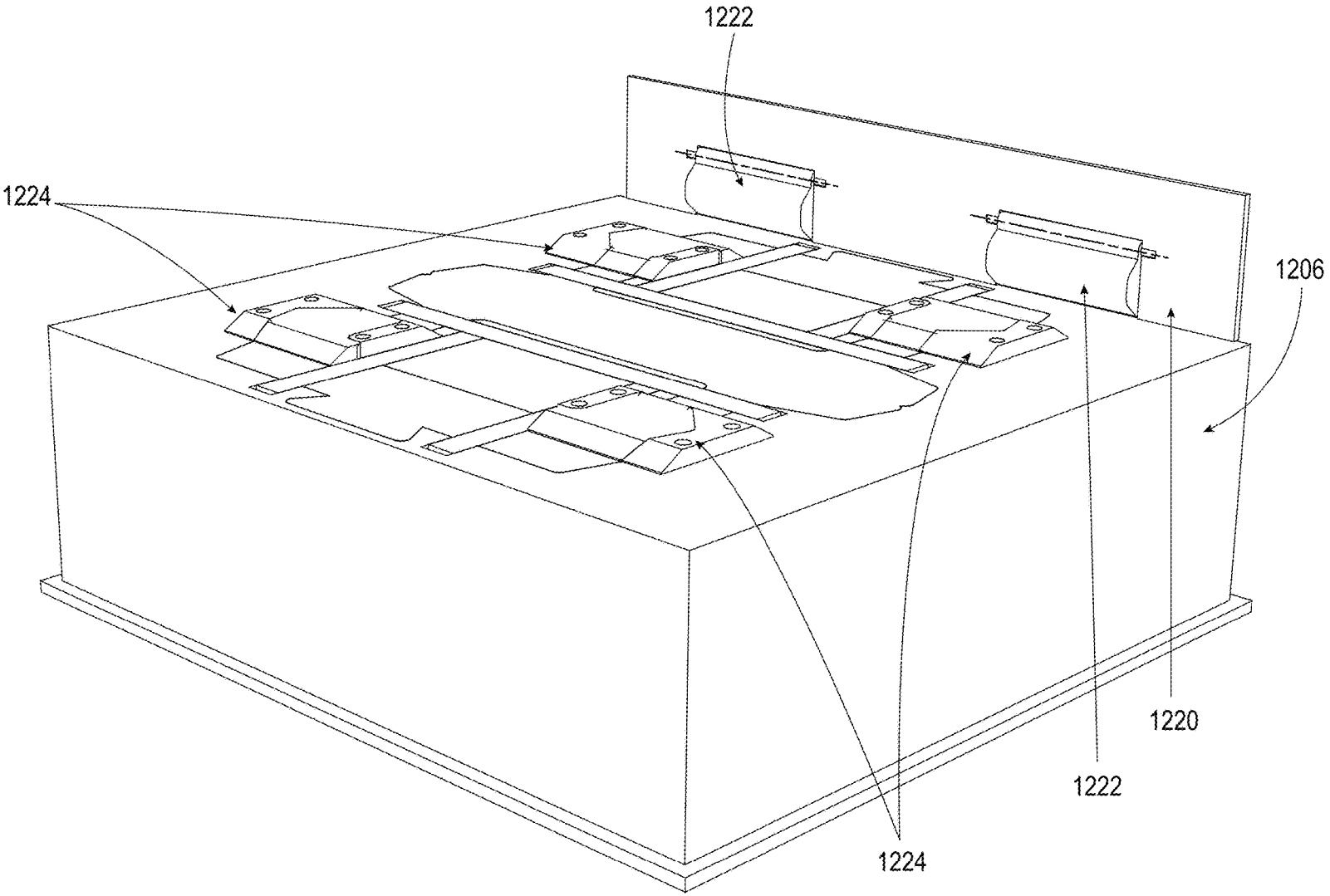
Figure 75:
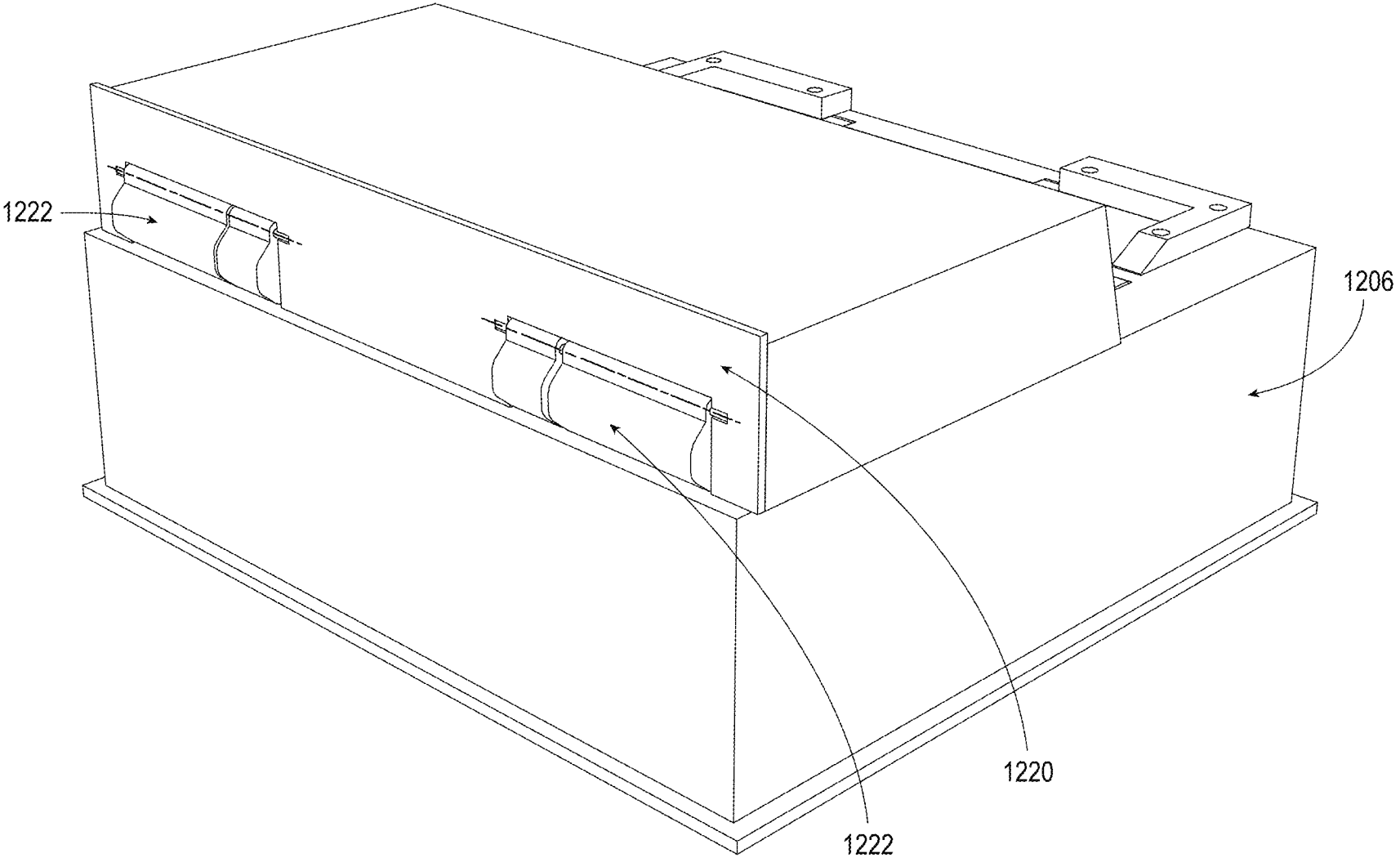
Figure 76:
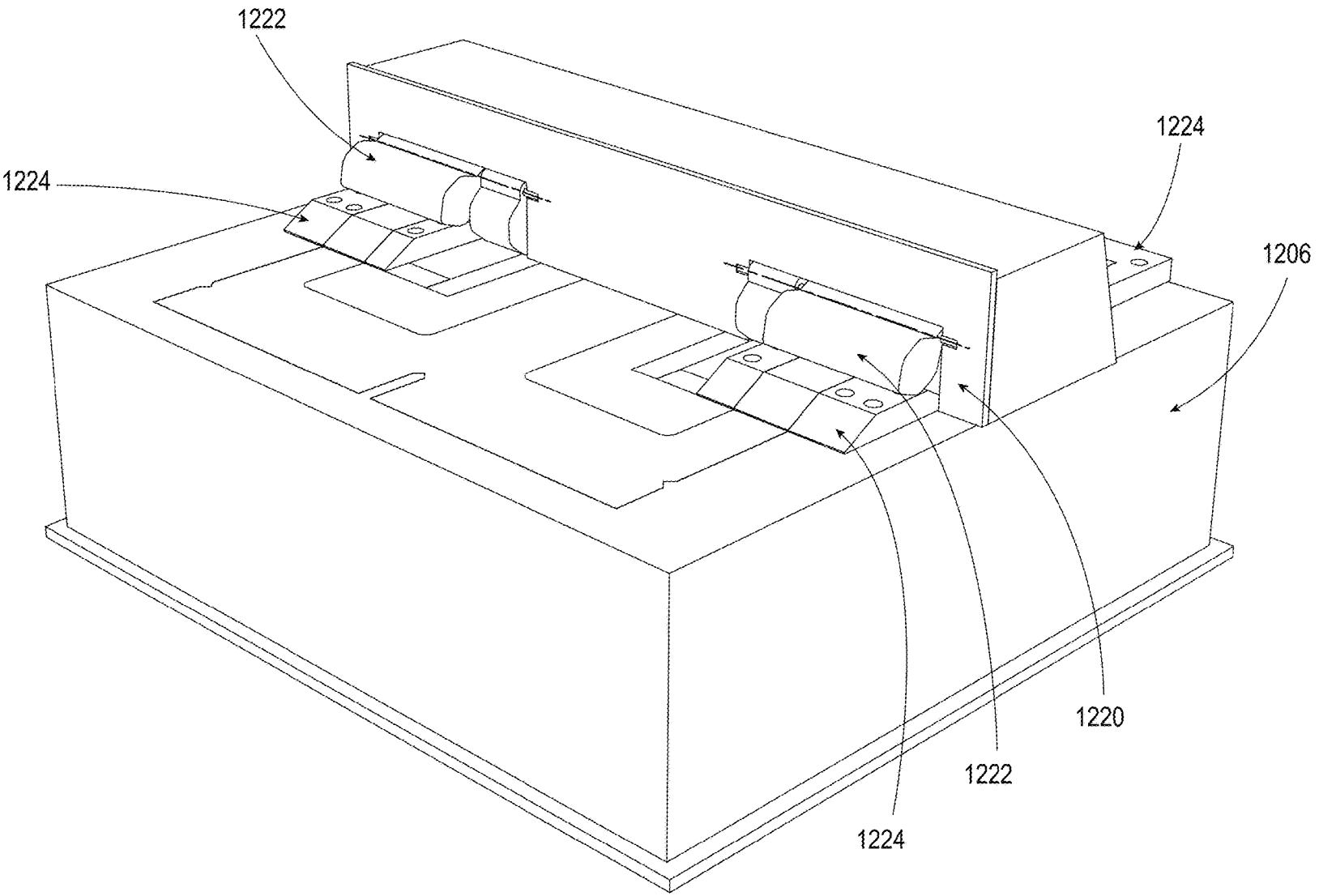
Figure 77:
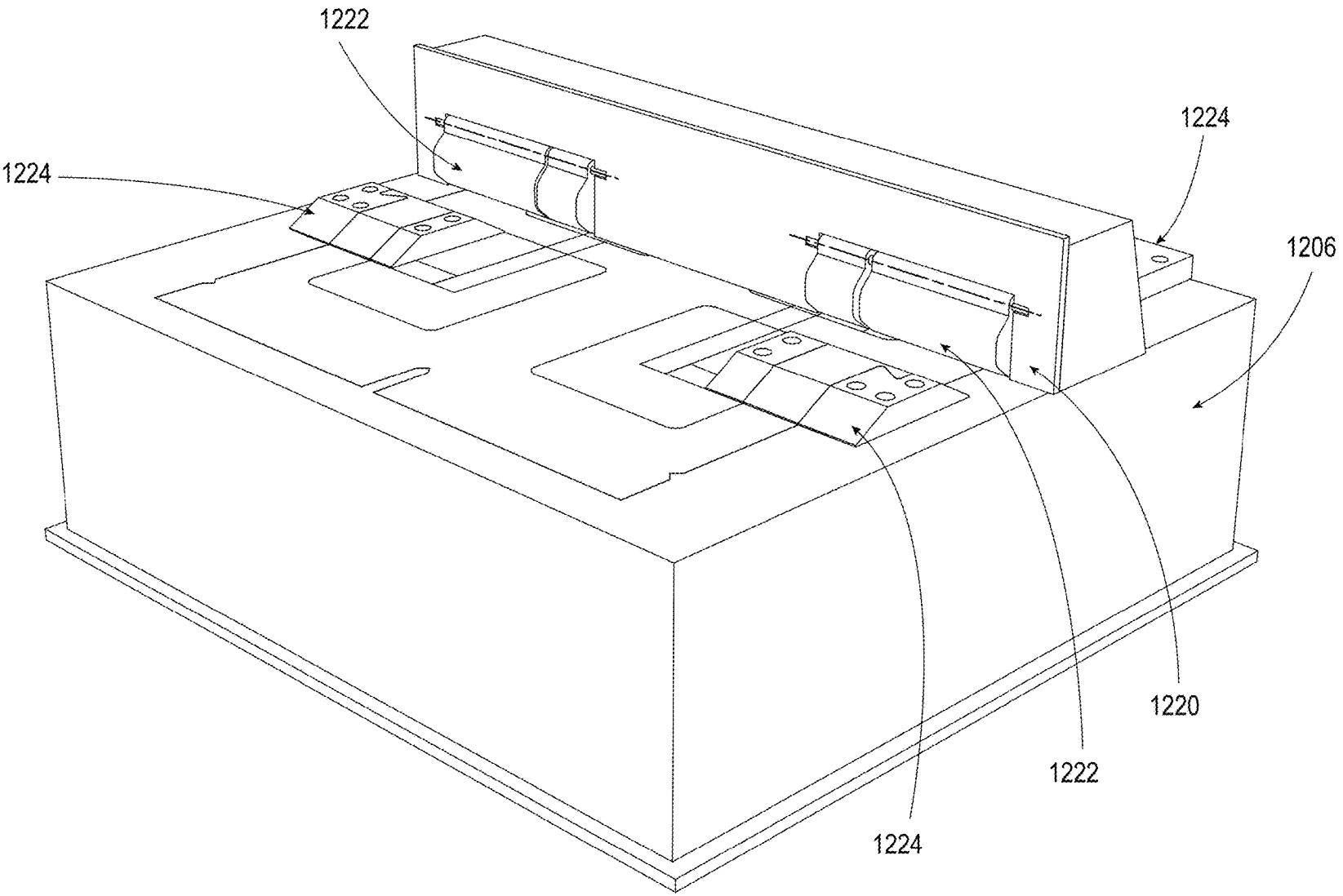
Figure 78:
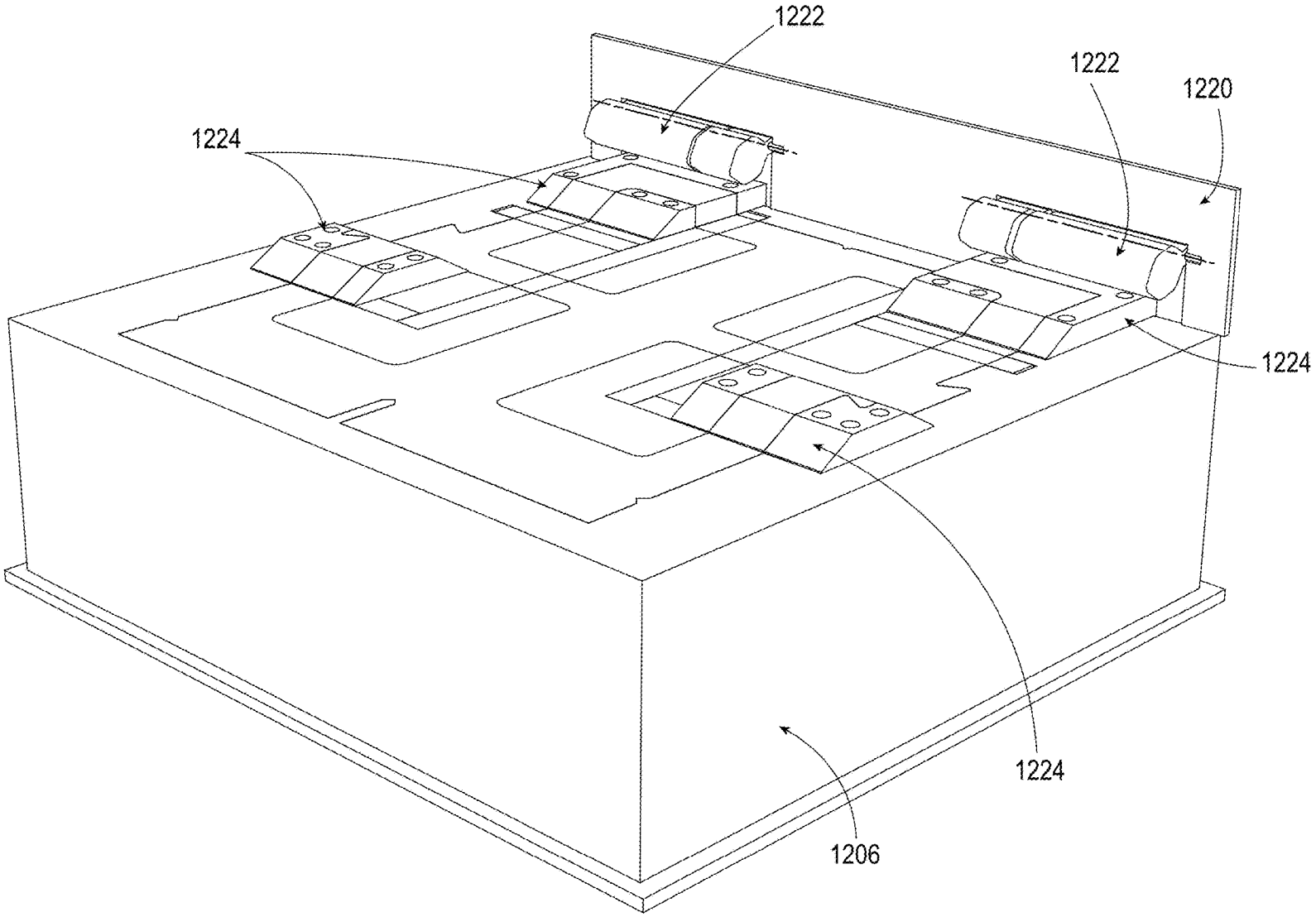

The converging, non-parallel relationship between the opposing shorter sides of the cap block 794 may allow various wall shape configurations, such as positioning the first longer side toward a front of a convex wall (as shown in FIGS. 57A-57C), positioning the second longer side toward a front of a concave wall (as shown in FIGS. 58A-58C), and alternating the first longer side and the second longer side for straight walls (as shown in FIGS. 59A-59C). The cap blocks 794 may be made of a rugged, weather resistant material, such as pre-cast concrete (e.g., dry cast or wet cast). Other suitable materials are plastic, reinforced fibers, wood, metal and stone.

In some examples, the wall system may further include use of reinforced earth techniques such as geogrid reinforcement, geosynthetic reinforcement, or the use of inextensible materials such as steel matrices. After placement of a course or layer of the wall, a geogrid material may be placed over the course or layer before placement of a next course or layer. The weight of the upper course or layer on the geogrid material sandwiched between two layers may hold the geogrid material in place.

In some examples, additional pins, stakes, or other connectors in the wall block 710, the tail block 740, or the fill material may be used to penetrate the apertures of the geogrid material to further hold it in place. The use of the geogrid material may form a lateral interlocking connection between wall blocks and tail blocks of a course or layer, which may further fortify the segmented wall 700.

FIGS. 61-69 depict eighth embodiments of a segmented wall system 800 with courses 860, 862 of wall blocks 810 and tail blocks 840, and inter-course or inter-layer pin connections, in accordance with the present disclosure. The segmented wall system 800 of FIGS. 61-69 may be formed using a combination of wall blocks 810 or corner blocks 890 and tail blocks 840, as shown. The wall blocks 810 and the tail blocks 840 of FIGS. 61-69 include many similar features as the wall blocks 110 and tail blocks 140 of FIGS. 1-7. Accordingly, a detailed description of the wall blocks 810 and tail blocks 840 are not included in the interest of brevity Upon analysis of FIGS. 61-69, one of skill in the art would appreciate and understand the common elements and the different elements in comparison to the wall blocks 110, 210, 410, 510, 610, 710 and tail blocks 140, 240, 340, 440, 540, 640, 740 described with reference to FIGS. 1-60.

FIGS. 70-82 depict methods of manufacturing segmented wall blocks with lugs, in accordance with the present disclosure. In an example, the methods depicted in FIGS. 70-82 may depict a method of manufacturing the wall blocks with lugs 776, 778 as depicted in FIGS. 47-59. The wall blocks being formed in FIGS. 70-82 include many similar features as the wall blocks of FIGS. 47-59. Many of those reference numbers are not repeated in FIGS. 70-82 in the interest of clarity and brevity. One of skill in the art would appreciate that those common elements exist as described with reference to FIGS. 47-59.

Typically, a wall block may be formed in a mold. Sidewalls of a mold may form the outer shape of the wall block. The sidewall portion of the mold may be positioned on a production pallet or board, and then filled with a material used to form the wall block (e.g., a concrete material, such as a dry-cast concrete material). A vertical cutoff bar may be pushed or pulled across a top portion of a mold to remove excess material. After the cutoff bar removes the excess material, a stripper shoe may be lowered onto the top of the mold to form a top surface of the block. The stripper shoe may apply a compression force to the top surface to compress the material within the mold to compact the material within the mold. After compression by the stripper shoe, the production pallet or board may be lowered to allow the formed block to slide out of the mold.

FIGS. 70-74 depict a cutoff bar 1220 progressively sliding across the top of a mold box 1206 for a first type of wall block. The cutoff bar 1220 pushes the excess material (e.g., depicted in brown color) across the top of the mold box 1206. Most of the bottom of the cutoff bar 1220 is straight and rigid, sliding across the top of the mold box 1206. However, the cutoff bar includes moveable portions 1222 that are configured to move over raised areas (e.g., lugs) to be formed in the top surface of the wall block.

The movable portions 1222 may have a pivot points (e.g., shafts or pins) to allow the movable portion 1222 to be raised to allow material to be left for raised portions of the wall block. In addition, the movable portions 1222 may be weighted or may have tension mechanisms that apply downward force to allow the movable portion to push excess material across the top of the mold box 1206. The top of the mold box 1206 may include raised portions (or raised features) 1224 that allow excess fill material to be left behind for certain features to be formed in the top of the wall block, such as lugs or weight bearing pads. The movable portions 1222 of the cutoff bar 1220 and raised portions 1224 may be aligned such that when the cutoff bar 1220 is pushed or pulled across the top of the mold box 1206, the movable portions 1222 move over the raised portions 1224.

It is appreciated that the example movable portions 1222 and the raised portions 1224 are exemplary, and that more or fewer of the movable portions 1222 and/or the raised portions 1224 may be included, the movable portions 1222 and/or the raised portions 1224 may be positioned, sized, or have different height than depicted, or any combination thereof, without departing from the scope of the disclosure. The movable portions 1222 of the cutoff bar 1220 may be segmented or split such that not all of the movable portion moves together.

The movable portions 1222 of the cutoff bar 1220 may have a different shape than the rounded shape. For example, the movable portions 1222 of the cutoff bar 1220 may have a polygon shape (e.g., triangle, rectangle, pentagon, hexagon, octagon, etc.). In another example, the movable portions 1222 of the cutoff bar 1220 may have a "T" or "Y" shape. In yet another example, the movable portions 1222 of the cutoff bar 1220 may have a hollowed-out area on one or both sides to form a sort of scoop to catch and remove material.

In some examples, the movable portions 1222 of the cutoff bar 1220 may include a mechanism to apply downward force to return the movable portions 1222 of the cutoff bar 1220 to being in alignment with the fixed portion of the cutoff bar 1220 after a deflection, such as a spring or spring-like mechanism, a hydraulic, electrical, or pneumatic actuator, or any other type of mechanism capable of applying a downward force. In some example, the movable portions 1222 of the cutoff bar 1220 may also include a stopper or stopping mechanism to prevent the movable portions 1222 of the cutoff bar 1220 from rotating too far, such as setting a stopper to prevent the movable portions 1222 of the cutoff bar 1220 from rotating more than a predetermined height above the raised portions 1224.

In some examples, each of the movable portions 1222 of the cutoff bar 1220 may be configured to accommodate raised features on the wall block that are different heights and/or volumes. For example, as the cutoff bar 1220 moves across the top of the mold box and/or are discontinuous across the mold box 1206, a particular one of the movable portions 1222 may encounter a first one of the raised portions 1224 having a first height and may subsequently encounter a second one of the raised portions having a second height that is different than the first height.

The first one of the raised features 1224 may correspond to a first raised feature of the wall block and the second one of the raised features 1224 may correspond to a second raised feature of the wall block that has a different corresponding volume or height when fully formed. The movable portions 1222 of the cutoff bar 1220 may encounter more than two raised features 1224 with more than two different heights without departing from the scope of the disclosure.

FIGS. 75-78 depict a cutoff bar 1220 progressively sliding across the top of a mold box 1206 for a second type of wall block. The stripper shoe 1010 pushes the excess material (e.g., depicted in brown color) across the top of the mold box 1206. Most of the bottom of the cutoff bar 1220 is straight and rigid, sliding across the top of the mold box 1206.

However, the cutoff bar includes moveable portions 1222 that are configured to move over raised areas (e.g., lugs) to be formed in the top surface of the wall block.

The movable portions 1222 may have a pivot points (e.g., shafts or pins) to allow the movable portion 1222 to be raised to allow material to be left for raised portions of the wall block. In addition, the movable portions 1222 may be weighted or may have tension mechanisms that apply downward force to allow the movable portion to push excess material across the top of the mold box 1206. The top of the mold box 1206 may include raised portions 1224 that allow excess fill material to be left behind for certain features to be formed in the top of the wall block, such as lugs or weight bearing pads. The movable portions 1222 of the cutoff bar 1220 and raised portions 1224 may be aligned such that when the cutoff bar 1220 is pushed or pulled across the top of the mold box 1206, the movable portions 1222 move over the raised portions 1224.

It is appreciated that the example movable portions 1222 and the raised portions 1224 are exemplary, and that more or fewer of the movable portions 1222 and/or the raised portions 1224 may be included, the movable portions 1222 and/or the raised portions 1224 may be positioned, sized, or have different height than depicted, or any combination thereof, without departing from the scope of the disclosure. The movable portions 1222 of the cutoff bar 1220 may have a different shape than the rounded shape. For example, the movable portions 1222 of the cutoff bar 1220 may have a polygon shape (e.g., triangle, rectangle, pentagon, hexagon, octagon, etc.). In another example, the movable portions 1222 of the cutoff bar 1220 may have a "T" or "Y" shape. In yet another example, the movable portions 1222 of the cutoff bar 1220 may have a hollowed-out area on one or both sides to form a sort of scoop to catch and remove material.

In some examples, the movable portions 1222 of the cutoff bar 1220 may include a mechanism to apply downward force to return the movable portions 1222 of the cutoff bar 1220 to being in alignment with the fixed portion of the cutoff bar 1220 after a deflection, such as a spring or spring-like mechanism, a hydraulic, electrical, or pneumatic actuator, or any other type of mechanism capable of applying a downward force. In some example, the movable portions 1222 of the cutoff bar 1220 may also include a stopper or stopping mechanism to prevent the movable portions 1222 of the cutoff bar 1220 from rotating too far, such as setting a stopper to prevent the movable portions 1222 of the cutoff bar 1220 from rotating more than a predetermined height above the raised portions 1224.

In some examples, each of the movable portions 1222 of the cutoff bar 1220 may be configured to accommodate raised features on the wall block that are different heights and/or volumes. For example, as the cutoff bar 1220 moves across the top of the mold box and/or are discontinuous across the mold box 1206, a particular one of the movable portions 1222 may encounter a first one of the raised portions 1224 having a first height and may subsequently encounter a second one of the raised portions having a second height that is different than the first height. The first one of the raised features 1224 may correspond to a first raised feature of the wall block and the second one of the raised features 1224 may correspond to a second raised feature of the wall block that has a different corresponding volume or height when fully formed. The movable portions 1222 of the cutoff bar 1220 may encounter more than two raised features 1224 with more than two different heights without departing from the scope of the disclosure.

Figure 79:
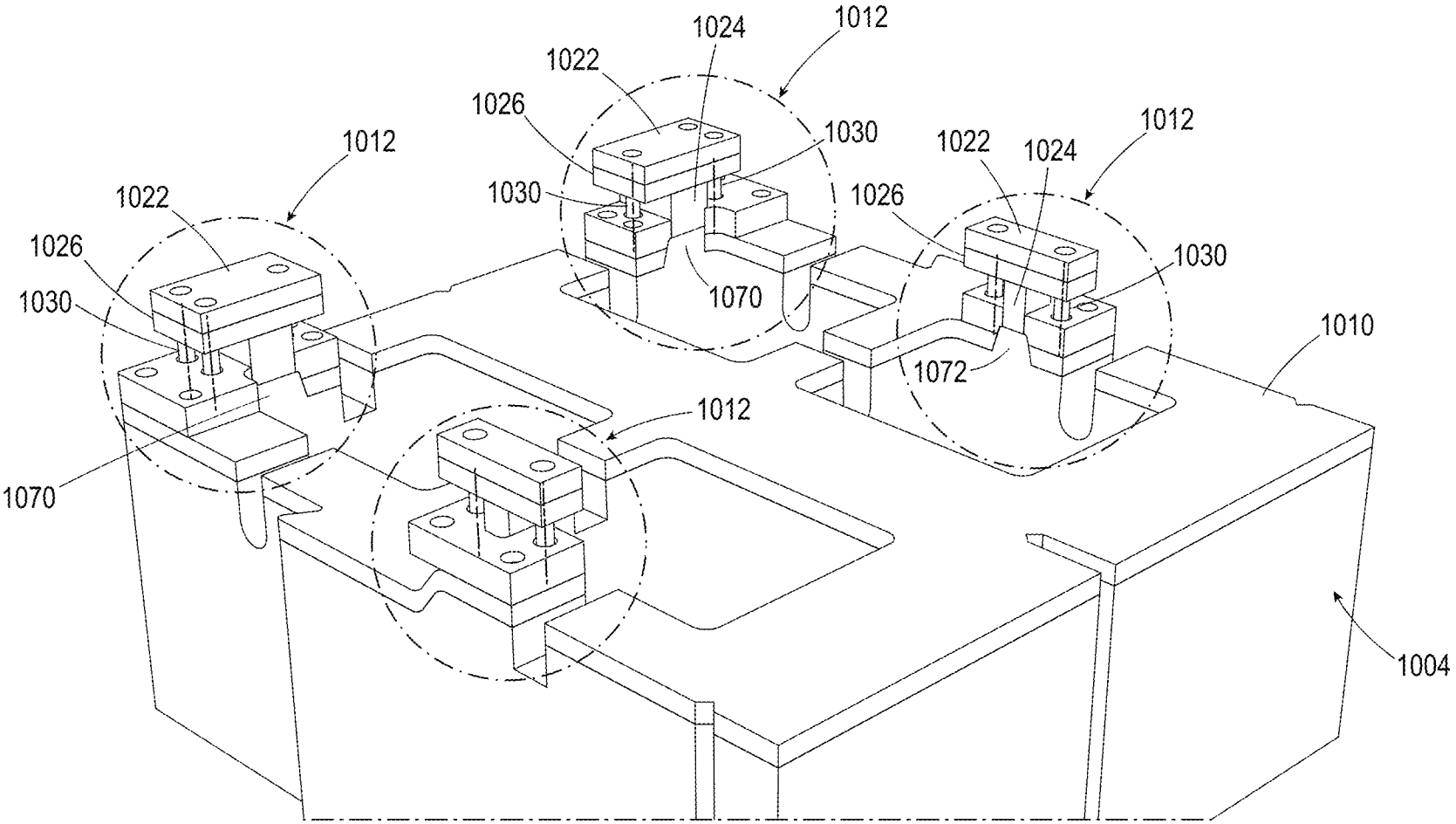
Figure 80:
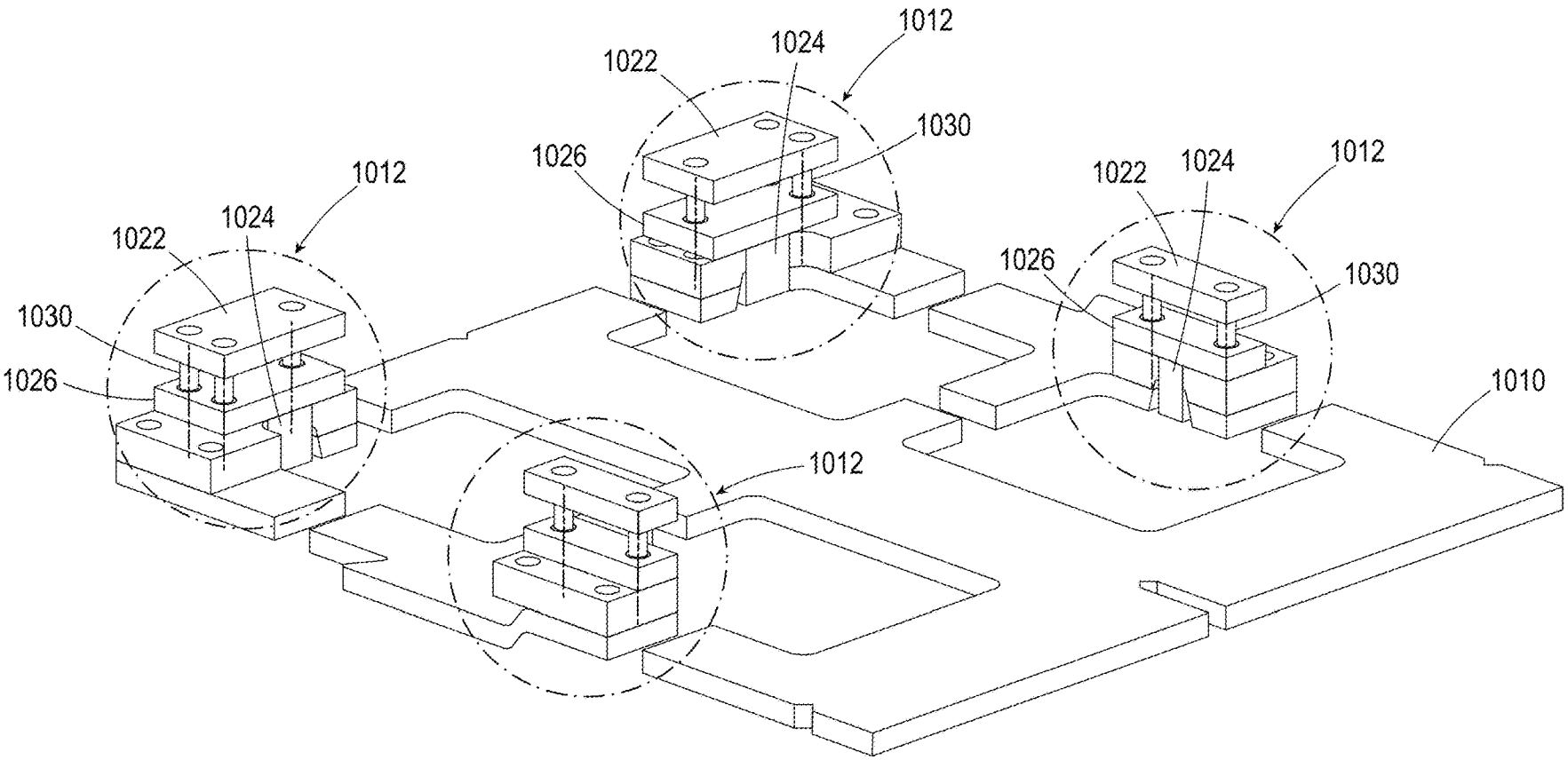

FIGS. 79 and 80 depict a stripper shoe 1010 configured to compress wall block material 1004 in a mold box (not shown) for a first type of wall block. The stripper shoe 1010 includes multiple movable mechanical mechanisms that operate up and down by gravity with the compaction and stripping cycle of the production machines 1012 that are configured to form raised areas (e.g., lugs 1070, 1072 or other raised areas) on the top of the wall block.

The movable mechanical mechanisms that operate up and down by gravity with the compaction and stripping cycle of the production machines 1012 include movable portions (e.g., stripper shoes 1024 that form the tops of the lugs 1070, 1072 and moveable plates 1026 to which the stripper shoes 1024 are attached) that slide along pins 1030 to move a bottom surface of the stripper shoes 1024 into contact with the wall block material 1004 to form a lug 1070. 1072 higher than the bottom surface of the main portion of the stripper shoe 1010, which is in contact with the top of the wall block material 1004 during compression. The upper plate 1022 provides a stop to set an upper limit for the movable portions.

When the stripper shoe 1010 is raised after compression, the movable mechanical mechanisms that operate up and down by gravity with the compaction and stripping cycle of the production machines 1012 may slide down along the pins to lower the bottom portion to be in alignment with the rest of the stripper shoe 1010. The dark purple blocks provide a lower stop for the movable portions to align the bottom surfaces of the movable portion and the bottom surface of the stripper shoe 1010.

In between block formation, the bottom portion of the stripper shoe may be scraped or brushed off to prevent material stuck on the stripper show from forming defects in subsequent blocks. The movable mechanical mechanisms that operate up and down by gravity with the compaction and stripping cycle of the production machines 1012 being able to move down for the cleaning may prevent material from being stuck up in the raised portion during this cleaning process.

Figure 81:
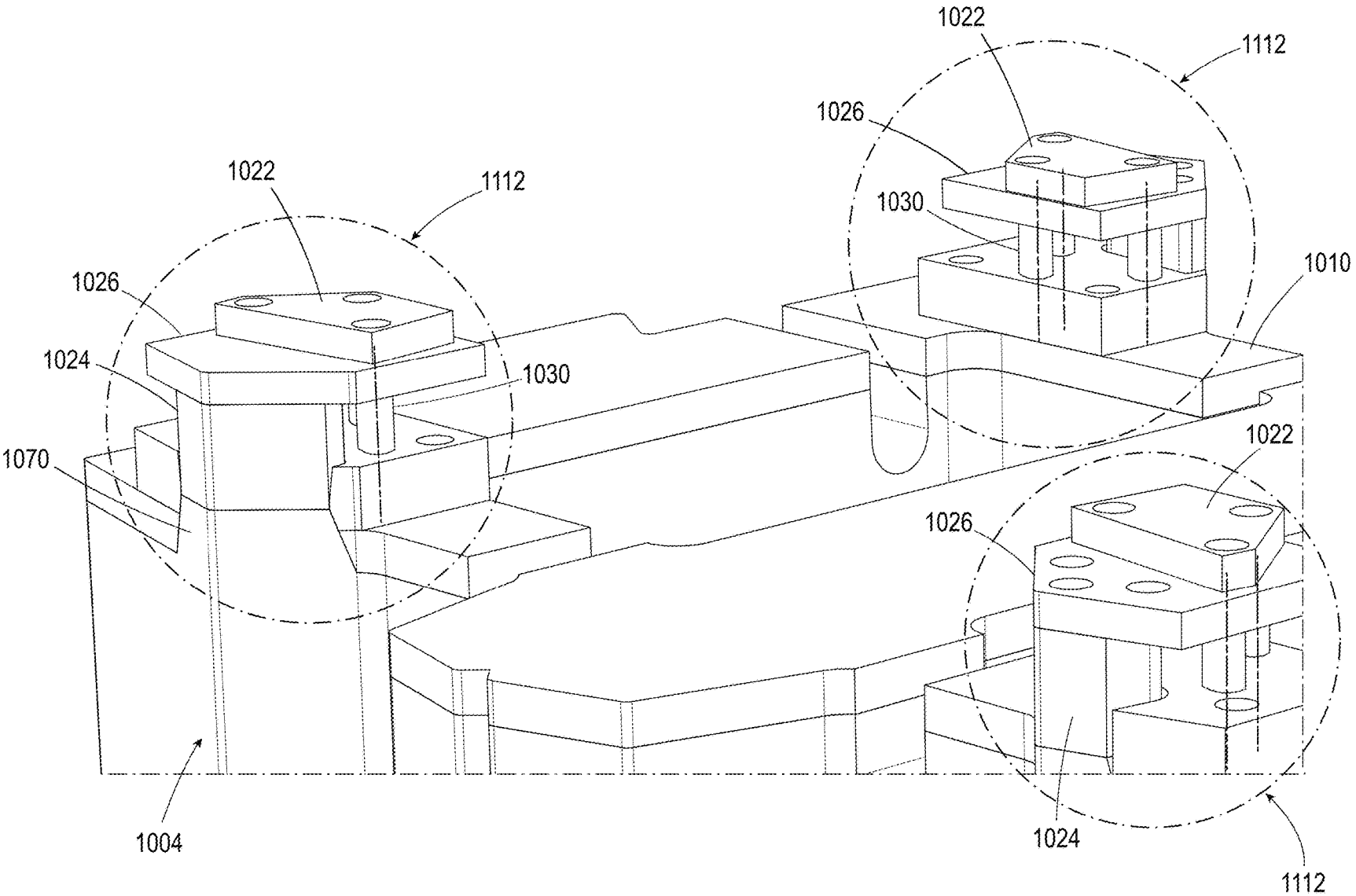
Figure 82:
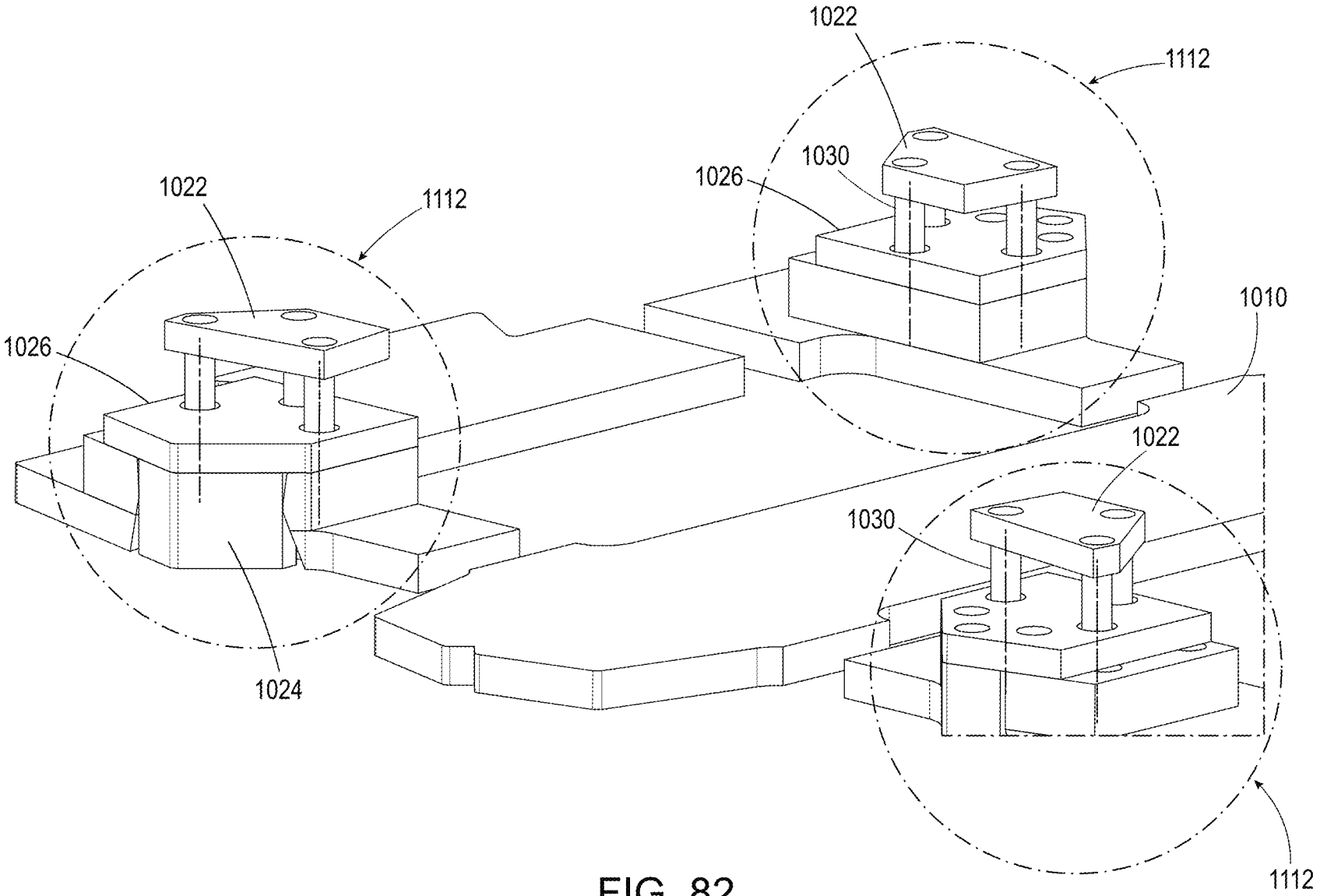

FIGS. 81 and 82 depict a stripper shoe 1010 configured to compress wall block material 1004 in a mold box (not shown) for a second type of wall block. The stripper shoe 1010 includes multiple movable mechanical mechanisms that operate up and down by gravity with the compaction and stripping cycle of the production machines 1012 that are configured to form raised areas (e.g., lugs 1070, 1072 or other raised areas) on the top of the wall block.

The movable mechanical mechanisms that operate up and down by gravity with the compaction and stripping cycle of the production machines 1012 include movable portions (e.g., stripper shoes 1024 that form the top of the lugs 1070, 1072 and moveable plates 1026 to which the stripper shoes 1024 are attached) that slide along pins to move a bottom surface of the stripper shoes 1024 into contact with the wall block material 1004 to form a lug 1070, 1072 higher than the bottom surface of the main portion of the stripper shoe 1010, which is in contact with the top of the wall block material 1004 during compression. The upper plate 1022 provides a stop to set an upper limit for the movable portions.

When the stripper shoe 1010 is raised after compression, the movable mechanical mechanisms that operate up and down by gravity with the compaction and stripping cycle of the production machines 1012 may slide down along the pins to lower the bottom portion to be in alignment with the rest of the stripper shoe 1010. The dark purple blocks provide a lower stop for the movable portions to align the bottom surfaces of the movable portion and the bottom surface of the stripper shoe 1010.

In between block formation, the bottom portion of the stripper shoe may be scraped or brushed off to prevent material stuck on the stripper show from forming defects in subsequent blocks. The movable mechanical mechanisms that operate up and down by gravity with the compaction and stripping cycle of the production machines 1012 being able to move down for the cleaning may prevent material from being stuck up in the raised portion during this cleaning process.

Although the detailed description describes certain preferred embodiments and examples, it will be understood by those skilled in the art that the scope of the disclosure extends beyond the specifically disclosed embodiments to other alternative embodiments and/or uses of the embodiments and obvious modifications and equivalents thereof. In addition, other modifications which are within the scope of the disclosure will be readily apparent to those of skill in the art. It is also contemplated that various combination or sub-combination of the specific features and aspects of the embodiments may be made and still fall within the scope of the disclosure. It should be understood that various features and aspects of the disclosed embodiments can be combined with or substituted for one another in order to form varying mode of the disclosed embodiments. Thus, it is intended that the scope of at least some of the present disclosure should not be limited by the particular disclosed embodiments described above.

What is claimed is:

1. A segmented wall system comprising:

a plurality of wall blocks, each comprising a front portion having a front side and a rear portion having a rear side opposing the front side;

a plurality of tail blocks, each comprising a front portion having a first end and a rear portion having a second end opposing the first end;

a first course extending in a first direction and comprising a first wall block and a second wall block of the wall blocks and a first tail block and a second tail block of the tail blocks, wherein the rear side of the first wall block is connected to the first end of the first tail block and the rear side of the second wall block is connected to the first end of the second tail block; and a second course stacked on the first course, wherein the second course comprises a third wall block of the wall blocks having the rear side thereof connected to the first end of a third tail block of the tail blocks, wherein the rear portion of said tail block has a width in the first direction that is greater than a width in the first direction of the rear side of said wall block.

2. The segmented wall system of claim 1, wherein a first part of the third tail block is stacked on part of the first tail block and a second part of the third tail block is stacked on part of the second tail block.

3. The segmented wall system of claim 1, wherein:

each of the first tail blocks includes a pair of opposing neck portions extending between the front portion and the rear portion, with an opening between the pair of opposing neck portions.

4. The segmented wall system of claim 3, wherein the opposing neck portions are parallel with one another.

5. The segmented wall system of claim 3, wherein the opposing neck portions have a non-parallel relationship with one another.

6. The segmented wall system of claim 5, wherein the neck portions merge at or adjacent the rear portion of the tail block.

7. The segmented wall system of claim 3, wherein:

each of the third wall blocks includes first and second neck portions extending between the front portion and the rear portion, with an opening between the first and second neck portions; and wherein the third wall block is connected to the third tail block with a front portion of a first of the opposing neck portions of the third tail block aligned with a rear portion of the first neck portion of the third wall block, and with a front portion of a second of the opposing neck portions of the third tail block aligned with a rear portion of the second neck portion of the third wall block.

8. The segmented wall system of claim 3, wherein one of the opposing neck portions of the third tail block is at least partially stacked on one of the opposing neck portions of the second tail block.

9. The segmented wall system of claim 1, wherein:

each of the tail blocks includes a neck portion extending between the front portion and the rear portion;

wherein a first end of the neck portion adjacent the front portion of the respective tail block and a second end of the neck portion adjacent the rear portion of the respective tail block are flared such that a middle of the neck portion is narrower than the first and second ends, and wherein at least part of the front portion and/or the first end of the neck portion of the third tail block is stacked on at least part of the front portion of the first tail block.

10. The segmented wall system of claim 1, wherein:

the rear side of the third wall block and the first end of the third tail block have a common height measured perpendicular to the width of said rear side and the width of said first end; and a dovetail connection is provided between the rear side of the third wall block and first end of the third tail block, wherein the dovetail connection has the common height.

11. The segmented wall system of claim 10, wherein the rear side of the third wall block has a male portion of the dovetail connection and the first end of the third tail block has a female portion of the dovetail connection.

12. The segmented wall system of claim 1, wherein:

the first wall block is positioned adjacent the second wall block; and wherein the first course further includes a fourth tail block of the tail blocks, positioned between the first and second tail blocks, wherein part of the third tail block is stacked on part of the fourth tail block.

13. The segmented wall system of claim 12, wherein the third tail block is horizontally aligned with the fourth tail block in the first direction.

14. The segmented wall system of claim 1, wherein:

the first wall block includes a first engagement protrusion comprising a first raised area positioned on a top surface of the first wall block; and wherein the first engagement protrusion is configured to engage within an aperture defined between the front portion and the rear portion of the third wall block.

15. The segmented wall system of claim 14, wherein:

the second wall block includes a second engagement protrusion comprising a second raised area positioned on a top surface of the second wall block; and wherein the second engagement protrusion is configured to engage within the aperture defined in the third wall block.

16. The segmented wall system of claim 1, wherein:

the first course comprises a first corner block positioned adjacent the first wall block; and the second course comprises a second corner block positioned adjacent the third wall block.

17. The segmented wall system of claim 16, further comprising a first raised area defining a first engagement protrusion extending from a top surface of the first corner block, and configured to engage within an aperture defined in the second corner block.

18. The segmented wall system of claim 16, further comprising a second raised area defining a second engagement protrusion extending from the top surface of the first corner block, and configured to engage within an aperture defined in a fourth wall block of an adjoining wall segment of the segmented wall system, extending in a different direction from the first direction.

19. The segmented wall system of claim 1, further comprising a first dovetail connection defined on the rear side of the third wall block, connected to a second complementary dovetail connection defined on the first end of the third tail block.

* * * * *